US011588277B2

(12) United States Patent
Jiang

(10) Patent No.: US 11,588,277 B2
(45) Date of Patent: Feb. 21, 2023

(54) HIGH-FREQUENCY ELECTRICAL CONNECTOR WITH LOSSY MEMBER

(71) Applicant: Amphenol East Asia Ltd., Taoyuan (TW)

(72) Inventor: Jong-Shiun Jiang, New Taipei (TW)

(73) Assignee: Amphenol East Asia Ltd., Taoyuan (TW)

( * ) Notice: Subject to any disclaimer, the term of this patent is extended or adjusted under 35 U.S.C. 154(b) by 184 days.

(21) Appl. No.: 17/089,934

(22) Filed: Nov. 5, 2020

(65) Prior Publication Data

US 2021/0135404 A1 May 6, 2021

Related U.S. Application Data

(60) Provisional application No. 62/931,339, filed on Nov. 6, 2019.

(51) Int. Cl.
*H01R 33/00* (2006.01)
*H01R 13/6582* (2011.01)
(Continued)

(52) U.S. Cl.
CPC ..... *H01R 13/6582* (2013.01); *H01R 12/585* (2013.01); *H01R 13/6461* (2013.01); *H01R 13/6585* (2013.01)

(58) Field of Classification Search
CPC ..... H01R 13/6581; H01R 13/6582; H01R 13/6583; H01R 13/6584; H01R 13/6585;
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1175101 A 3/1998
CN 1192068 A 9/1998
(Continued)

OTHER PUBLICATIONS

Chinese Office Action for Chinese Application No. 201780097919.9, dated Dec. 3, 2021.
(Continued)

*Primary Examiner* — Khiem M Nguyen
(74) *Attorney, Agent, or Firm* — Wolf, Greenfield & Sacks, P.C.

(57) ABSTRACT

An electrical connector including a compressible lossy member is provided. The electrical connector comprises an insulative member, a plurality of terminals supported by the insulative member and disposed in a row along a row direction, and a compressible lossy member disposed in a recess of the insulative member. The lossy member includes a body portion elongated in the row direction and a plurality of projections extending from the body portion. The projections of the lossy member project toward and make contact with contact surfaces of first terminals of the plurality of terminals. At least a part of the body portion is compressible and is in a state of compression when the projections are pressed against the first terminals.

27 Claims, 35 Drawing Sheets

(51) Int. Cl.
*H01R 12/58* (2011.01)
*H01R 13/6585* (2011.01)
*H01R 13/6461* (2011.01)

(58) Field of Classification Search
CPC H01R 13/6586; H01R 13/6587; H01R 12/58; H01R 12/585
USPC ..... 439/79, 660
See application file for complete search history.

(56) References Cited

U.S. PATENT DOCUMENTS 3,134,950 A 5/1964 Cook
3,322,885 A 5/1967 May et al.
3,530,422 A 9/1970 Goodman
3,631,381 A 12/1971 Pittman
3,786,372 A 1/1974 Epis et al.
3,825,874 A 7/1974 Peverill
3,863,181 A 1/1975 Glance et al.
3,977,757 A 8/1976 Yurtin
4,155,613 A 5/1979 Brandeau
4,195,272 A 3/1980 Boutros
4,276,523 A 6/1981 Boutros et al.
4,286,837 A 9/1981 Yasutake et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,687,267 A 8/1987 Header
4,728,762 A 3/1988 Roth et al.
4,751,479 A 6/1988 Parr
4,761,147 A 8/1988 Gauthier
4,787,548 A 11/1988 Abbagnaro et al.
4,806,107 A 2/1989 Arnold et al.
4,846,724 A 7/1989 Sasaki et al.
4,846,727 A 7/1989 Glover et al.
4,871,316 A 10/1989 Herrell et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,171,161 A 12/1992 Kachlic
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,885,088 A 3/1999 Brennan et al.
5,924,899 A 7/1999 Paagman
5,981,869 A 11/1999 Kroger
5,982,253 A 11/1999 Perrin et al.
5,993,259 A 11/1999 Stokoe et al.
6,019,616 A 2/2000 Yagi et al.
6,152,747 A 11/2000 McNamara
6,168,469 B1 1/2001 Lu
6,174,202 B1 1/2001 Mitra
6,174,203 B1 1/2001 Asao
6,174,944 B1 1/2001 Chiba et al.
6,217,372 B1 4/2001 Reed
6,293,827 B1 9/2001 Stokoe
6,296,491 B1 10/2001 Pickles
6,296,496 B1 10/2001 Trammel
6,299,438 B1 10/2001 Sahagian et al.
6,299,483 B1 10/2001 Cohen et al.
6,315,615 B1 11/2001 Raistrick
6,322,395 B1 11/2001 Nishio et al.
6,328,601 B1 12/2001 Yip et al.
6,347,962 B1 2/2002 Kline
6,350,134 B1 2/2002 Fogg et al.
6,361,363 B1 3/2002 Hwang
6,364,711 B1 4/2002 Berg et al.
6,375,510 B2 4/2002 Asao
6,379,188 B1 4/2002 Cohen et al.
6,394,842 B1 5/2002 Sakurai et al.
6,398,588 B1 6/2002 Bickford
6,409,543 B1 6/2002 Astbury, Jr. et al.
6,447,170 B1 9/2002 Takahashi et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,540,559 B1 4/2003 Kemmick et al.
6,551,140 B2 4/2003 Billman et al.
6,554,647 B1 4/2003 Cohen et al.
6,565,387 B2 5/2003 Cohen
6,565,390 B2 5/2003 Wu
6,579,116 B2 6/2003 Brennan et al.
6,582,244 B2 6/2003 Fogg et al.
6,592,381 B2 7/2003 Cohen et al.
6,595,801 B1 7/2003 Leonard et al.
6,595,802 B1 7/2003 Watanabe et al.
6,602,095 B2 8/2003 Astbury, Jr. et al.
6,607,402 B2 8/2003 Cohen et al.
6,609,922 B2 8/2003 Torii
6,616,864 B1 9/2003 Jiang et al.
6,652,318 B1 11/2003 Winings et al.
6,652,319 B1 11/2003 Billman
6,655,966 B2 12/2003 Rothermel et al.
6,709,294 B1 3/2004 Cohen et al.
6,713,672 B1 3/2004 Stickney
6,726,492 B1 4/2004 Yu
6,743,057 B2 6/2004 Davis et al.
6,776,659 B1 8/2004 Stokoe et al.
6,786,771 B2 9/2004 Gailus
6,808,420 B2 10/2004 Whiteman, Jr. et al.
6,814,619 B1 11/2004 Stokoe et al.
6,830,489 B2 12/2004 Aoyama
6,872,085 B1 3/2005 Cohen et al.
6,875,031 B1 4/2005 Korsunsky et al.
6,932,649 B1 8/2005 Rothermel et al.
6,979,202 B2 12/2005 Benham et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,086,872 B2 8/2006 Myer et al.
7,094,102 B2 8/2006 Cohen et al.

(56) References Cited

U.S. PATENT DOCUMENTS 7,104,842 B1 9/2006 Huang et al.
7,108,556 B2 9/2006 Cohen et al.
7,156,672 B2 1/2007 Fromm et al.
7,163,421 B1 1/2007 Cohen et al.
7,232,344 B1 6/2007 Gillespie et al.
7,285,018 B2 10/2007 Kenny et al.
7,316,585 B2 1/2008 Smith et al.
7,318,740 B1 1/2008 Henry et al.
7,320,614 B2 1/2008 Toda et al.
7,322,845 B2 1/2008 Regnier et al.
7,331,822 B2 2/2008 Chen n
7,335,063 B2 2/2008 Cohen et al.
7,364,464 B2 4/2008 Iino et al.
7,371,117 B2 5/2008 Gailus
7,407,413 B2 8/2008 Minich
7,467,977 B1 12/2008 Yi et al.
7,473,124 B1 1/2009 Briant et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,604,502 B2 10/2009 Pan
7,645,165 B2 1/2010 Wu et al.
7,690,946 B2 4/2010 Knaub et al.
7,699,644 B2 4/2010 Szczesny et al.
7,722,401 B2 5/2010 Kirk et al.
7,727,027 B2 6/2010 Chiang et al.
7,727,028 B1 6/2010 Zhang et al.
7,731,537 B2 6/2010 Amleshi et al.
7,753,731 B2 7/2010 Cohen et al.
7,771,233 B2 8/2010 Gailus
7,789,676 B2 9/2010 Morgan et al.
7,794,240 B2 9/2010 Cohen et al.
7,794,278 B2 9/2010 Cohen et al.
7,806,729 B2 10/2010 Nguyen et al.
7,824,192 B2 11/2010 Lin et al.
7,871,296 B2 1/2011 Fowler et al.
7,874,873 B2 1/2011 Do et al.
7,883,369 B1 2/2011 Sun et al.
7,887,371 B2 2/2011 Kenny et al.
7,887,379 B2 2/2011 Kirk
7,906,730 B2 3/2011 Atkinson et al.
7,914,304 B2 3/2011 Cartier et al.
7,946,889 B2 5/2011 Mizumura
7,985,097 B2 7/2011 Gulla
7,993,147 B2 8/2011 Cole et al.
8,018,733 B2 9/2011 Jia
8,083,553 B2 12/2011 Manter et al.
8,123,544 B2 2/2012 Kobayashi
8,182,289 B2 5/2012 Stokoe et al.
8,215,968 B2 7/2012 Cartier et al.
8,216,001 B2 7/2012 Kirk
8,262,411 B2 9/2012 Kondo
8,272,877 B2 9/2012 Stokoe et al.
8,337,247 B2 12/2012 Zhu
8,348,701 B1 1/2013 Lan et al.
8,371,875 B2 2/2013 Gailus
8,382,524 B2 2/2013 Khilchenko et al.
8,440,637 B2 5/2013 Elmen
8,480,432 B2 7/2013 Wu
8,506,319 B2 8/2013 Ritter et al.
8,506,331 B2 8/2013 Wu
8,545,253 B2 10/2013 Amidon et al.
8,550,861 B2 10/2013 Cohen et al.
8,597,051 B2 12/2013 Yang et al.
8,657,627 B2 2/2014 McNamara et al.
8,715,003 B2 5/2014 Buck et al.
8,715,005 B2 5/2014 Pan
8,740,637 B2 6/2014 Wang et al.
8,764,492 B2 7/2014 Chiang
8,771,016 B2 7/2014 Atkinson et al.
8,864,506 B2 10/2014 Little et al.
8,864,521 B2 10/2014 Atkinson et al.
8,905,777 B2 12/2014 Zhu et al.
8,926,377 B2 1/2015 Kirk et al.
8,944,831 B2 2/2015 Stoner et al.
8,968,034 B2 3/2015 Hsu
8,998,642 B2 4/2015 Manter et al.
9,004,942 B2 4/2015 Paniagua
9,011,177 B2 4/2015 Lloyd et al.
9,022,806 B2 5/2015 Cartier, Jr. et al.
9,028,281 B2 5/2015 Kirk et al.
9,065,230 B2 6/2015 Milbrand, Jr.
9,124,009 B2 9/2015 Atkinson et al.
9,219,335 B2 12/2015 Atkinson et al.
9,225,085 B2 12/2015 Cartier, Jr. et al.
9,257,778 B2 * 2/2016 Buck ..... H01R 13/516
9,257,794 B2 2/2016 Wanha et al.
9,263,835 B2 2/2016 Guo
9,281,590 B1 3/2016 Liu et al.
9,287,668 B2 3/2016 Chen et al.
9,300,074 B2 3/2016 Gailus
9,337,585 B1 5/2016 Yang
9,350,095 B2 5/2016 Arichika et al.
9,450,344 B2 9/2016 Cartier, Jr. et al.
9,484,674 B2 11/2016 Cartier, Jr. et al.
9,509,101 B2 11/2016 Cartier, Jr. et al.
9,520,686 B2 12/2016 Hu et al.
9,520,689 B2 12/2016 Cartier, Jr. et al.
9,537,250 B2 1/2017 Kao et al.
9,640,915 B2 5/2017 Phillips et al.
9,692,183 B2 6/2017 Phillips et al.
9,742,132 B1 8/2017 Hsueh
9,831,605 B2 * 11/2017 Buck ..... H01R 12/7005
9,843,135 B2 12/2017 Guetig et al.
9,935,385 B2 4/2018 Phillips et al.
9,972,945 B1 5/2018 Huang et al.
9,997,871 B2 6/2018 Zhong et al.
10,122,129 B2 11/2018 Milbrand, Jr. et al.
10,135,197 B2 11/2018 Little et al.
10,211,577 B2 2/2019 Milbrand, Jr. et al.
10,243,304 B2 3/2019 Kirk et al.
10,270,191 B1 4/2019 Li et al.
10,276,995 B2 4/2019 Little
10,283,910 B1 5/2019 Chen et al.
10,320,102 B2 6/2019 Phillips et al.
10,348,040 B2 7/2019 Cartier, Jr. et al.
10,381,767 B1 8/2019 Milbrand, Jr. et al.
10,431,936 B2 10/2019 Horning et al.
10,439,311 B2 10/2019 Phillips et al.
10,511,128 B2 12/2019 Kirk et al.
10,541,482 B2 1/2020 Sasame et al.
10,601,181 B2 3/2020 Lu et al.
10,777,921 B2 9/2020 Lu et al.
10,797,446 B2 10/2020 Liu et al.
10,826,214 B2 11/2020 Phillips et al.
10,833,437 B2 11/2020 Huang et al.
10,840,622 B2 11/2020 Sasame et al.
10,965,064 B2 3/2021 Hsu et al.
11,146,025 B2 10/2021 Lu et al.
11,189,971 B2 11/2021 Lu
11,264,755 B2 3/2022 Te
2001/0012730 A1 8/2001 Ramey et al.
2001/0042632 A1 11/2001 Manov et al.
2001/0046810 A1 11/2001 Cohen et al.
2002/0042223 A1 4/2002 Belopolsky et al.
2002/0061671 A1 5/2002 Torii
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2002/0123266 A1 9/2002 Ramey et al.
2002/0132518 A1 9/2002 Kobayashi
2002/0146926 A1 10/2002 Fogg et al.
2003/0119360 A1 6/2003 Jiang et al.
2003/0220018 A1 11/2003 Winings et al.
2004/0005815 A1 1/2004 Mizumura et al.
2004/0020674 A1 2/2004 McFadden et al.
2004/0058572 A1 3/2004 Fromm et al.
2004/0115968 A1 6/2004 Cohen
2004/0121652 A1 6/2004 Gailus
2004/0171305 A1 9/2004 McGowan et al.
2004/0196112 A1 10/2004 Welbon et al.
2004/0235352 A1 11/2004 Takemasa

(56) References Cited

U.S. PATENT DOCUMENTS

2004/0259419 A1 12/2004 Payne et al.
2005/0048818 A1 3/2005 Pan
2005/0048838 A1 3/2005 Korsunsky et al.
2005/0048842 A1 3/2005 Benham et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0019525 A1 1/2006 Lloyd et al.
2006/0068640 A1 3/2006 Gailus
2006/0166560 A1 7/2006 Shuey et al.
2006/0255876 A1 11/2006 Kushta et al.
2006/0276082 A1 12/2006 Hung et al.
2006/0292932 A1 12/2006 Benham et al.
2007/0004282 A1 1/2007 Cohen et al.
2007/0004828 A1 1/2007 Khabbaz
2007/0021000 A1 1/2007 Laurx
2007/0021001 A1 1/2007 Laurx et al.
2007/0021002 A1 1/2007 Laurx et al.
2007/0021003 A1 1/2007 Laurx et al.
2007/0021004 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0155241 A1 7/2007 Lappohn
2007/0197063 A1 8/2007 Ngo et al.
2007/0218765 A1 9/2007 Cohen et al.
2007/0243764 A1 10/2007 Liu et al.
2007/0293084 A1 12/2007 Ngo
2008/0020640 A1 1/2008 Zhang et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0203259 A1 8/2009 Nguyen et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2009/0305553 A1 12/2009 Thomas et al.
2010/0048058 A1 2/2010 Morgan et al.
2010/0068934 A1 3/2010 Li et al.
2010/0075538 A1 3/2010 Ohshida
2010/0081302 A1 4/2010 Atkinson et al.
2010/0112846 A1 5/2010 Kotaka
2010/0124851 A1 5/2010 Xiong et al.
2010/0144167 A1 6/2010 Fedder et al.
2010/0203772 A1 8/2010 Mao et al.
2010/0291806 A1 11/2010 Minich et al.
2010/0294530 A1 11/2010 Atkinson et al.
2011/0003509 A1 1/2011 Gailus
2011/0067237 A1 3/2011 Cohen et al.
2011/0104948 A1 5/2011 Girard, Jr. et al.
2011/0130038 A1 6/2011 Cohen et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0184145 A1 7/2012 Zeng
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0065454 A1 3/2013 Milbrand, Jr.
2013/0078870 A1 3/2013 Milbrand, Jr.
2013/0078871 A1 3/2013 Milbrand, Jr.
2013/0090001 A1 4/2013 Kagotani
2013/0109232 A1 5/2013 Paniaqua
2013/0143442 A1 6/2013 Cohen et al.
2013/0196553 A1 8/2013 Gailus
2013/0217263 A1 8/2013 Pan
2013/0225006 A1 8/2013 Khilchenko et al.
2013/0237100 A1 9/2013 Affeltranger
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0024263 A1 1/2014 Dong et al.
2014/0057498 A1 2/2014 Cohen
2014/0113487 A1 4/2014 Chen et al.
2014/0273557 A1 9/2014 Cartier, Jr. et al.
2014/0273627 A1 9/2014 Cartier, Jr. et al.
2014/0370729 A1 12/2014 Wang
2014/0377992 A1 12/2014 Chang et al.
2015/0056856 A1 2/2015 Atkinson et al.
2015/0072546 A1 3/2015 Li
2015/0099408 A1 4/2015 Myer et al.
2015/0111401 A1 4/2015 Guo
2015/0111427 A1 4/2015 Foxconn
2015/0126068 A1 5/2015 Fang
2015/0140866 A1 5/2015 Tsai et al.
2015/0214673 A1 7/2015 Gao et al.
2015/0236451 A1 8/2015 Cartier, Jr. et al.
2015/0236452 A1 8/2015 Cartier, Jr. et al.
2015/0255904 A1 9/2015 Ito
2015/0255926 A1 9/2015 Paniagua
2015/0340798 A1 11/2015 Kao et al.
2016/0149343 A1 5/2016 Atkinson et al.
2016/0268744 A1 9/2016 Little et al.
2017/0077654 A1 3/2017 Yao et al.
2017/0352970 A1 12/2017 Liang et al.
2018/0062323 A1 3/2018 Kirk et al.
2018/0076555 A1 3/2018 Scholeno et al.
2018/0145438 A1 5/2018 Cohen
2018/0198220 A1 7/2018 Sasame et al.
2018/0205177 A1 7/2018 Zhou et al.
2018/0212376 A1 7/2018 Wang et al.
2018/0212385 A1 7/2018 Little
2018/0219331 A1 8/2018 Cartier, Jr. et al.
2018/0241156 A1 8/2018 Huang et al.
2018/0269607 A1 9/2018 Wu et al.
2018/0331444 A1 11/2018 Ono
2019/0006778 A1 1/2019 Fan et al.
2019/0044284 A1 2/2019 Dunham
2019/0052019 A1 2/2019 Huang et al.
2019/0067854 A1 2/2019 Ju et al.
2019/0173209 A1 6/2019 Lu et al.
2019/0173232 A1 6/2019 Lu et al.
2019/0214755 A1 7/2019 Manickam
2019/0334292 A1 10/2019 Cartier, Jr. et al.
2020/0021052 A1 1/2020 Milbrand, Jr. et al.
2020/0076135 A1 3/2020 Tang et al.
2020/0153134 A1 5/2020 Sasame et al.
2020/0161811 A1 5/2020 Lu
2020/0203865 A1 6/2020 Wu et al.
2020/0203867 A1 6/2020 Lu
2020/0203886 A1 6/2020 Wu et al.
2020/0235529 A1 7/2020 Kirk et al.
2020/0259294 A1 8/2020 Lu
2020/0266584 A1 8/2020 Lu
2020/0335914 A1 10/2020 Hsu et al.
2020/0358226 A1 11/2020 Lu et al.
2020/0395698 A1 12/2020 Hou et al.
2020/0403350 A1 12/2020 Hsu
2021/0036452 A1 2/2021 Phillips et al.
2021/0050683 A1 2/2021 Sasame et al.
2021/0135389 A1 5/2021 Jiang

(56) References Cited

U.S. PATENT DOCUMENTS

| | | | |
|---|---|---|---|
| 2021/0135403 | A1 | 5/2021 | Yang et al. |
| 2021/0203104 | A1 | 7/2021 | Chen |
| 2021/0218195 | A1 | 7/2021 | Hsu et al. |
| 2021/0399449 | A1 | 12/2021 | Guo et al. |
| 2022/0059954 | A1 | 2/2022 | Yue |
| 2022/0069496 | A1 | 3/2022 | Yi et al. |

FOREIGN PATENT DOCUMENTS

| | | | |
|---|---|---|---|
| CN | 1275825 | A | 12/2000 |
| CN | 2519434 | Y | 10/2002 |
| CN | 1179448 | C | 12/2004 |
| CN | 1650479 | A | 8/2005 |
| CN | 1799290 | A | 7/2006 |
| CN | 2896615 | Y | 5/2007 |
| CN | 1996678 | A | 7/2007 |
| CN | 2930006 | Y | 8/2007 |
| CN | 101019277 | A | 8/2007 |
| CN | 101176389 | A | 5/2008 |
| CN | 101208837 | A | 6/2008 |
| CN | 101312275 | A | 11/2008 |
| CN | 201323275 | Y | 10/2009 |
| CN | 101600293 | A | 12/2009 |
| CN | 201374434 | Y | 12/2009 |
| CN | 101752700 | A | 6/2010 |
| CN | 101790818 | A | 7/2010 |
| CN | 101120490 | B | 11/2010 |
| CN | 101926055 | A | 12/2010 |
| CN | 201846527 | U | 5/2011 |
| CN | 102106041 | A | 6/2011 |
| CN | 201868621 | U | 6/2011 |
| CN | 102195173 | A | 9/2011 |
| CN | 102224640 | A | 10/2011 |
| CN | 102232259 | A | 11/2011 |
| CN | 102239605 | A | 11/2011 |
| CN | 102292881 | A | 12/2011 |
| CN | 101600293 | B | 5/2012 |
| CN | 102456990 | A | 5/2012 |
| CN | 102487166 | A | 6/2012 |
| CN | 102593661 | A | 7/2012 |
| CN | 102598430 | A | 7/2012 |
| CN | 202395248 | U | 8/2012 |
| CN | 102694318 | A | 9/2012 |
| CN | 102738621 | A | 10/2012 |
| CN | 102859805 | A | 1/2013 |
| CN | 202695788 | U | 1/2013 |
| CN | 202695861 | U | 1/2013 |
| CN | 203445304 | U | 2/2014 |
| CN | 103840285 | A | 6/2014 |
| CN | 203690614 | U | 7/2014 |
| CN | 204030057 | U | 12/2014 |
| CN | 204167554 | U | 2/2015 |
| CN | 104409906 | A | 3/2015 |
| CN | 104577577 | A | 4/2015 |
| CN | 104659573 | A | 5/2015 |
| CN | 204349140 | U | 5/2015 |
| CN | 204577746 | U | 8/2015 |
| CN | 204696287 | U | 10/2015 |
| CN | 105633660 | A | 6/2016 |
| CN | 105703103 | A | 6/2016 |
| CN | 106099546 | A | 11/2016 |
| CN | 107069281 | A | 8/2017 |
| CN | 304240766 | S | 8/2017 |
| CN | 304245430 | S | 8/2017 |
| CN | 206712072 | U | 12/2017 |
| CN | 206712089 | U | 12/2017 |
| CN | 107706632 | A | 2/2018 |
| CN | 207677189 | U | 7/2018 |
| CN | 208078300 | U | 11/2018 |
| CN | 208209042 | U | 12/2018 |
| CN | 208797273 | U | 4/2019 |
| CN | 210326355 | U | 4/2020 |
| CN | 112072400 | A | 12/2020 |
| CN | 107706675 | B | 4/2021 |
| CN | 212874843 | U | 4/2021 |
| CN | 113517619 | A | 10/2021 |
| DE | 60216728 | T2 | 11/2007 |
| EP | 0 560 551 | A1 | 9/1993 |
| EP | 0820124 | A2 | 1/1998 |
| EP | 1 018 784 | A1 | 7/2000 |
| EP | 1 779 472 | A1 | 5/2007 |
| EP | 2 169 770 | A2 | 3/2010 |
| EP | 2 405 537 | A1 | 1/2012 |
| GB | 1049435 | A | 11/1966 |
| GB | 1272347 | A | 4/1972 |
| JP | H3-156761 | A2 | 7/1991 |
| JP | H07-302649 | A | 11/1995 |
| JP | 2001-510627 | A | 7/2001 |
| JP | 2002-151190 | A2 | 5/2002 |
| JP | 2006-344524 | A | 12/2006 |
| JP | 2010-129173 | A | 6/2010 |
| MX | 9907324 | A1 | 8/2000 |
| TW | 200835073 | A | 8/2008 |
| TW | M357771 | U | 5/2009 |
| TW | M474278 | U | 3/2014 |
| TW | I535129 | B | 5/2016 |
| TW | M534922 | U | 1/2017 |
| TW | I596840 | B | 8/2017 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| TW | M605564 | U | 12/2020 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124052 | A2 | 10/2008 |
| WO | WO 2008/124054 | A2 | 10/2008 |
| WO | WO 2008/124057 | A1 | 10/2008 |
| WO | WO 2008/124101 | A2 | 10/2008 |
| WO | WO 2010/030622 | A1 | 3/2010 |
| WO | WO 2010/039188 | A1 | 4/2010 |
| WO | WO 2011/100740 | A2 | 8/2011 |
| WO | WO 2017/007429 | A1 | 1/2017 |

OTHER PUBLICATIONS

International Search Report and Written Opinion dated Nov. 29, 2021 for International Application No. PCT/CN2021/114671.

International Search Report and Written Opinion dated Jul. 18, 2019 for International Application No. PCT/CN2018/118798.

[No Author Listed], Mini Cool Edge IO—The Ideal Solution to Transmit Next Generation High-Speed Signal to Designated Area in Your System. Jul. 25, 2018. 2 pages. URL:https://www.amphenol-icc.com/connect/mini-cool-edge-io-the-ideal-solution-to-transmit-next-generation-high-speedsignal.html [retrieved on Apr. 11, 2022].

[No Author Listed], Mini Cool Edge IO Connector. Commercial IO. Amphenol ICC. 5 pages. URL:https://cdn.amphenol-icc.com/media/wysiwyg/files/documentation/datasheet/inputoutput/io_mini_cool_edge_io.pdf [retrieved on Apr. 11, 2022].

[No Author Listed], MCIO 124pos 85ohm. Amphenol Assembletech. 1 page. URL:http://www.amphenol-ast.com/v3/en/overview.aspx?classId=234 [retrieved on Apr. 11, 2022].

Chinese communication for Chinese Application No. 201580014851.4, dated Jun. 1, 2020.

Chinese Office Action dated Jan. 18, 2021 in connection with Chinese Application No. 202010031395.7.

Chinese Office Action for Application No. 201680051491.X dated Apr. 30, 2019.

(56) References Cited

OTHER PUBLICATIONS

Chinese Office Action for Chinese Application No. 201580014851.4 dated Sep. 4, 2019.
Chinese Office Action for Chinese Application No. 201780064531.9 dated Jan. 2, 2020.
Chinese Office Action for Chinese Application No. 201780097919.9, dated Mar. 10, 2021.
Extended European Search Report for European Application No. EP 11166820.8 dated Jan. 24, 2012.
Extended European Search Report dated May 19, 2021 in connection with European Application No. 17930428.2.
International Preliminary Report on Patentability Chapter II for International Application No. PCT/CN2017/108344 dated Mar. 6, 2020.
International Preliminary Report on Patentability for International Application No. PCT/US2010/056482 dated May 24, 2012.
International Preliminary Report on Patentability for International Application No. PCT/US2011/026139 dated Sep. 7, 2012.
International Preliminary Report on Patentability for International Application No. PCT/US2012/023689 dated Aug. 15, 2013.
International Preliminary Report on Patentability for International Application No. PCT/SG2016/050317 dated Jan. 18, 2018.
International Search Report and Written Opinion for International Application No. PCT/US2010/056482 dated Mar. 14, 2011.
International Search Report and Written Opinion for International Application No. PCT/US2011/026139 dated Nov. 22, 2011.
International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
International Search Report and Written Opinion for International Application No. PCT/CN2017/108344 dated Aug. 1, 2018.
International Search Report and Written Opinion for International Application No. PCT/US2005/034605 dated Jan. 26, 2006.
International Search Report and Written Opinion for International Application No. PCT/US2011/034747 dated Jul. 28, 2011.
International Search Report and Written Opinion for International Application No. PCT/SG2016/050317 dated Oct. 18, 2016.
International Search Report with Written Opinion for International Application No. PCT/US2006/025562 dated Oct. 31, 2007.
[No Author Listed], Carbon Nanotubes For Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], High Speed Backplane Connectors. Tyco Electronics. Product Catalog No. 1773095. Revised Dec. 2008. 1-40 pages.
[No Author Listed], Military Fibre Channel High Speed Cable Assembly, www.gore.com. 2008. [last accessed Aug. 2, 2012 via Internet Archive: Wayback Machine http://web.archive.org] Link archived: http://www.gore.com/en.sub.--xx/products/cables/copper/networking/militar-y/military.sub.--fibre . . . Last archive date Apr. 6, 2008.
[No Author Listed], SFF-TA-1016 Specification for Internal Unshielded High Speed Connector System. Rev 0.0.1. SNIA SFF TWG Technology Affiliate. Nov. 15, 2019. 40 pages.
Beaman, High Performance Mainframe Computer Cables. 1997 Electronic Components and Technology Conference. 1997;911-7.
Hsu et al., SMT Receptacle Connector With Side Latching, U.S. Appl. No. 17/216,463, filed Mar. 29, 2021.
Reich et al., Microwave Theory and Techniques. Boston Technical Publishers, Inc. 1965;182-91.
Shi et al. Improving Signal Integrity in Circuit Boards by Incorporating Absorbing Materials. 2001 Proceedings. 51st Electronic Components and Technology Conference, Orlando FL. 2001:1451-56.
U.S. Appl. No. 16/556,728, filed Aug. 30, 2019, Lu.
U.S. Appl. No. 16/556,778, filed Aug. 30, 2019, Lu.
U.S. Appl. No. 16/684,755, filed Nov. 15, 2019, Lu
U.S. Appl. No. 16/721,594, filed Dec. 19, 2019, Lu.
U.S. Appl. No. 16/760,400, filed Apr. 29, 2020, Hou et al.
U.S. Appl. No. 16/827,328, filed Mar. 23, 2020, Lu et al.
U.S. Appl. No. 16/905,593, filed Jun. 18, 2020, Hu.
U.S. Appl. No. 17/085,342, filed Oct. 30, 2020, Sasame et al.
U.S. Appl. No. 17/089,905, filed Nov. 5, 2020, Jiang.
U.S. Appl. No. 17/216,463, filed Mar. 29, 2021, Hsu et al.
CN 201580014851.4, Sep. 4, 2019, Chinese Office Action.
CN 201580014851.4, Jun. 1, 2020, Chinese Communication.
CN 201680051491.X, Apr. 30, 2019, Chinese Office Action.
CN 201780064531.9, Jan. 2, 2020, Chinese Office Action.
CN 201780097919.9, Mar. 10, 2021 Chinese Office Action.
CN 202010031395.7, Jan. 18, 2021, Chinese Office Action.
EP 11166820.8, Jan. 24, 2012, Extended European Search Report.
EP 17930428.2, May 19, 2021, Extended European Search Report.
PCT/CN2017/108344, Aug. 1, 2018, International Search Report and Written Opinion.
PCT/CN2017/108344, Mar. 6, 2020, International Preliminary Report on Patentability Chapter II.
PCT/SG2016/050317, Oct. 18, 2016, International Search Report and Written Opinion.
PCT/SG2016/050317, Jan. 18, 2018, International Preliminary Report on Patentability.
PCT/US2005/034605, Jan. 26, 2006, International Search Report and Written Opinion.
PCT/US2006/025562, Oct. 31, 2007, International Search Report with Written Opinion.
PCT/US2010/056482, May 24, 2012, International Preliminary Report on Patentability.
PCT/US2010/056482, Mar. 14, 2011, International Search Report and Written Opinion.
PCT/US2011/026139, Sep. 7, 2012, International Preliminary Report on Patentability.
PCT/US2011/026139, Nov. 22, 2011, International Search Report and Written Opinion.
PCT/US2011/034747, Jul. 28, 2011, International Search Report and Written Opinion.
PCT/US2012/023689, Aug. 15, 2013, International Preliminary Report on Patentability.
PCT/US2012/023689, Sep. 12, 2012, International Search Report and Written Opinion.
PCT/US2012/060610, Mar. 29, 2013, International Search Report and Written Opinion.
PCT/US2015/012463, May 13, 2015, International Search Report and Written Opinion.
PCT/US2017/047905, Dec. 4, 2017, International Search Report and Written Opinion.
U.S. Appl. No. 16/998,845, filed Aug. 20, 2020, Yue.
U.S. Appl. No. 17/283,511, filed Apr. 7, 2021, Guo et al.
U.S. Appl. No. 17/402,255, filed Aug. 13, 2021, Yi et al.
CN 201780097919.9, Dec. 3, 2021, Chinese Office Action.
PCT/CN2018/118798, Jul. 18, 2019, International Search Report and Written Opinion.
PCT/CN2021/114671, Nov. 29, 2021, International Search Report and Written Opinion.

* cited by examiner

HIGH-FREQUENCY ELECTRICAL CONNECTOR WITH LOSSY MEMBER

RELATED APPLICATIONS

This application claims priority to and the benefit under 35 U.S.C. § 119(e) of U.S. Application Ser. No. 62/931,339, filed Nov. 6, 2019, entitled "HIGH-FREQUENCY ELECTRICAL CONNECTOR WITH LOSSY MEMBER", which is hereby incorporated by reference in its entirety.

FIELD OF THE INVENTION

This disclosure relates generally to electrical interconnection systems and more specifically to electrical connectors able to carry high-frequency signals.

BACKGROUND

Electrical connectors are used in many electronic systems. In general, various electronic devices (e.g., smart phones, tablet computers, desktop computers, notebook computers, digital cameras, and the like) have been provided with assorted types of connectors whose primary purpose is to enable an electronic device to exchange data, commands, and/or other signals with one or more other electronic devices. Electrical connectors are basic components needed to make some electrical systems functional. Signal transmission to transfer information (e.g., data, commands, and/or other electrical signals) often utilize electrical connectors between electronic devices, between components of an electronic device, and between electrical systems that may include multiple electronic devices.

It is generally easier and more cost effective to manufacture an electrical system as separate electronic assemblies, such as printed circuit boards ("PCBs"), which may be communicatively joined together with electrical connectors. In some scenarios, the PCBs to be joined may each have connectors mounted on them. The connectors may be mated together directly to interconnect the PCBs.

In other scenarios, the PCBs may be connected indirectly via a cable. Electrical connectors may nonetheless be used to make such connections. For example, the cable may be terminated at one or both ends with a plug type of electrical connector ("plug connector" herein). A PCB may be equipped with a receptacle type of electrical connector ("receptacle connector" herein) into which the plug connector may be inserted to connect the cable to the PCB. A similar arrangement may be used at the other end of the cable, to connect the cable to another PCB, so that signals may pass between the PCBs via the cable.

For electronic devices that require a high-density, high-speed connector, techniques may be used to reduce interference between conductive elements within the connectors, and to provide other desirable electrical properties. One such technique involves the use of shield members between or around adjacent signal conductive elements of a connector system. The shields may prevent signals carried on one conductive element from creating "crosstalk" on another conductive element. The shields may also have an impact on an impedance of the conductive elements, which may further contribute to desirable electrical properties of the connector system.

Another technique that may be used to control performance characteristics of a connector entails transmitting signals differentially. Differential signals result from signals carried on a pair of conducting paths, called a "differential pair." The voltage difference between the conductive paths represents the differential signal. In general, a differential pair is designed with preferential coupling between the conducting paths of the pair. For example, the two conducting paths of a differential pair may be arranged to run closer to each other than to other adjacent signal paths in the connector.

Amphenol Corporation, which is the assignee of the present technology described herein, also pioneered the use of a "lossy" material in connectors to improve performance, particularly the performances of high-speed, high-density connectors.

SUMMARY

Some embodiments of the technology disclosed herein are directed to an electrical connector. The electrical connector comprises an insulative member; a plurality of terminals supported by the insulative member and disposed in a row along a row direction, wherein each terminal of the plurality of terminals comprises a first end, a mounting end, and an intermediate portion joining the first end to the mounting end; and a compressible elastic lossy member disposed in a recess of the insulative member, the lossy member comprising a body portion elongated in the row direction and a plurality of projections extending from the body portion. The projections of the lossy member project toward and make contact with contact surfaces of first terminals of the plurality of terminals such that the projections are in a state of compression.

Some embodiments of the technology disclosed herein are directed to an electrical connector. The electrical connector comprises a first plurality of terminals and a second plurality of terminals; a longitudinal first insulative member molded around a segment of each of the intermediate portions of the first plurality of terminals; a longitudinal second insulative member molded around a segment of each of the intermediate portions of the second plurality of terminals, the second insulative member being configured to mate with the first insulative member such that a space is formed between the first and second insulative members; and a longitudinal elastic lossy member disposed in a state of compressive stress in the space between the first and second insulative members. The longitudinal elastic lossy member comprises a body portion and a plurality of projections extending from the body portion and contacting a plurality of first terminals of the first and second plurality of terminals through holes in the first and second insulative members.

Some embodiments of the technology disclosed herein are directed to a lossy member. The lossy member comprises a body portion extending along a first direction, the body portion comprising a first side and a second side opposite the first side; and a plurality of compressible projections extending away from the body portion from the first side and the second side of the body portion. The plurality of projections are configured to make contact with ground terminals of an electrical connector.

Some embodiments of the technology disclosed herein are directed to a method of manufacturing an electrical connector. The method comprises placing a lossy member comprising a body portion and a plurality of projections extending from the body portion proximate a first insulative member; and forming an assembly by coupling the first insulative member and a second insulative member so that the lossy member is compressed between the first insulative member and the second insulative member.

The features described herein in the various embodiments may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

DETAILED DESCRIPTION

Figure 1:
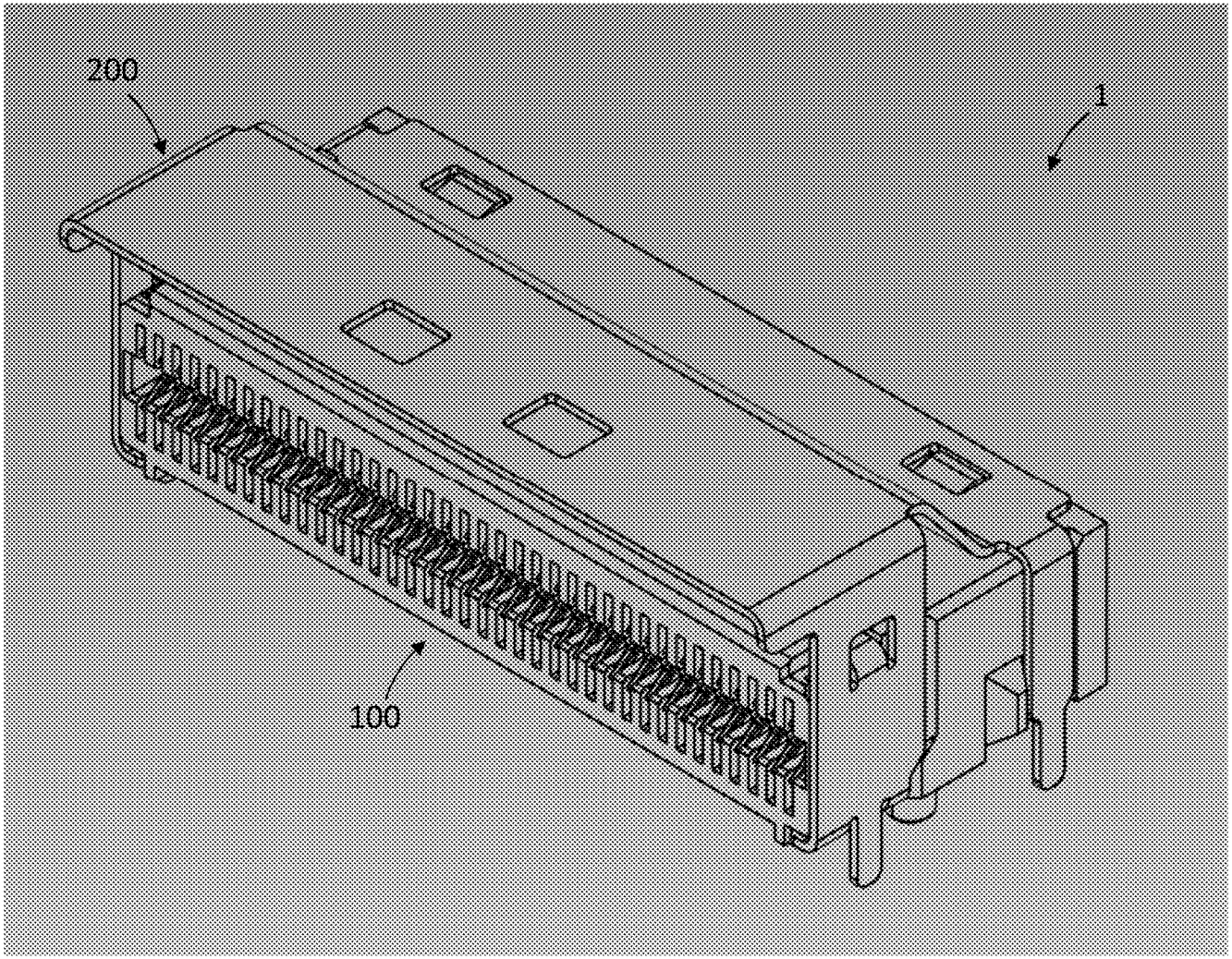
FIG. 1 is a top perspective view of a receptacle connector, according to some embodiments.

The inventors have recognized and appreciated techniques for manufacturing miniaturized electrical connectors that enable compact electronic system that processes high speed signals with good signal integrity. Such electrical connectors may have a low height, such as 5 mm or less, relative to a surface of a printed circuit board to which the connector system is mounted.

The inventors have further recognized and appreciated that the high-frequency performance of such a miniaturized electrical connector including a shorting member may be improved by configuring the connector so that compressive forces applied to the shorting member increase the electrical coupling between select ones of the conductive elements and the shorting member. The shorting member may be a lossy member, which may be formed of a lossy material, as described below. The select ones of the conductive members may be ground conductors. The improvement in electrical performance may be achieved in configurations in which the shorting bar has relatively small dimensions.

The shorting member may have surfaces configured for making contact to the select ones of the conductive members ("select conductive members" herein). The select conductive members may be supported by insulative members, which are configured to be coupled securely via interlocking members such that the shorting member is captured between the insulative members. By configuring the shorting member to be taller than the available space between the select conductive members and forming the shorting member to have compressible properties, it can be ensured that the shorting member makes reliable electrical contact to the select conductive members. The shorting member may be configured to have compressible properties by the choice of material used, the inclusion of through-holes in the shorting member structure, or a combination thereof. In some embodiments, the compressible material may be an elastic material (e.g., a material that springs back to its original or another shape when not under compressive stress).

A connector with the above-described configuration may function reliably despite variations in component sizes that may occur during manufacture of the components that are assembled to make the connector. Such variation, for example, may result in connectors in which the shorting member is manufactured separately from terminal subassemblies that carry the conductive members. The inventors have recognized and appreciate that, although the shorting member may be designed to contact the select conductive members, in some connectors, when assembled, manufacturing variations may prevent the shorting member from contacting some or all of the select conductive members. Compressing the shorting member between the insulative members so that the shorting member contacts and is urged against the select conductive members may increase electrical coupling between the shorting member and the select conductive members. If the select conductive members are already in contact with the shorting member before the insulative members are secured relative to each other, the additional compressive force may reduce the resistance of that contact, improving the performance of the shorting member. The compressive force on the shorting member may be increased by increasing the ratio of the height of the shorting member relative to the height of the space available for the shorting member between the insulative members. For example, the height of the shorting member when not compressed may be approximately 0.1 mm larger than the height of the space available for the shorting member. In some embodiments, when the shorting member is compressed, the height of the shorting member may be compressed by an amount in a range from 1% to 20% of the original, non-compressed height of the shorting member. In some embodiments, when the shorting member is compressed, the height of the shorting member may be compressed by an amount in a range from 2% to 10% of the original, non-compressed height of the shorting member. The inventors have further recognized and appreciate that forming the shorting member so that it may be compressed ensures that no damaging stress on the insulative members is caused by the compressive forces on the shorting member. Additionally, the inventors have recognized and appreciate that compressing the shorting member may ensure the components of the connector fit together in a repeatable manner, ensuring predictable connector performance despite manufacturing variations.

The select conductive members to which the shorting member is coupled may be ground conductors. In this regard, a shorting member included in the connector so as to electrically couple to the ground conductors may reduce resonances within the connector and therefore expand the operating frequency range of the connector. For example, when the connector is intended to operate at higher than typical frequencies (e.g., 25 GHz, 30 GHz, 35 GHz, 40 GHz, 45 GHz, etc.), the presence of the shorting member may reduce resonances that may occur at the higher frequencies, thereby enabling reliable operation at the higher frequencies and consequently increasing the operating range of the connector.

The presence of a shorting member may expand the frequency range over which the connector may operate, without increasing the distance between conductive elements. In some embodiments, conducting structures of a receptacle connector may support resonant modes at a fundamental frequency within a frequency range of interest for operation of the connector. In that scenario, the shorting member may alter the fundamental frequency of the resonant mode, such that it occurs outside the frequency range of interest. Without the fundamental frequency of the resonant mode in the frequency range of interest, one or more performance characteristics of the connector may be at an acceptable level over the frequency range of interest, whereas, in the absence of the shorting member, the performance characteristic(s) would be unacceptable.

The frequency range of interest may depend on the operating parameters of the system in which such the connector is used, but may generally have an upper limit between about 15 GHz and 120 GHz, such as 25, 30, 40, or 56 GHz, although higher frequencies or lower frequencies may be of interest in some applications. Some connector designs may have frequency ranges of interest that span only a portion of this range, such as 1 GHz to 10 GHz, or 3 GHz to 15 GHz, or 5 GHz to 35 GHz.

The operating-frequency range for an interconnection system may be defined based on the range of frequencies that pass through the interconnection system with acceptable signal integrity. Signal integrity may be measured in terms of a number of criteria that depend on the application for which the interconnection system is designed. Some of these criteria may relate to the propagation of a signal along a single-ended signal path, a differential signal path, a hollow waveguide, or any other type of signal path. The criteria may be specified as a limit or range of values for performance characteristics. Two examples of such characteristics are the attenuation of a signal along a signal path, and the reflection of a signal from a signal path.

Other characteristics may relate to interaction of signals on multiple distinct signal paths. Such characteristics may include, for example, near-end cross talk, defined as the portion of a signal injected on one signal path at one end of the interconnection system that is measurable at any other signal path on the same end of the interconnection system. Another such characteristic may be far-end cross talk, defined as the portion of a signal injected on one signal path at one end of the interconnection system that is measurable at any other signal path on the other end of the interconnection system.

As specific examples of criteria, it could be required that: signal-path attenuation be no more than 3 dB of power loss, a reflected-power ratio be no greater than −20 dB, and individual signal-path to signal-path crosstalk contributions be no greater than −50 dB. Because these characteristics are frequency dependent, the operating range of an interconnection system may be defined as the range of frequencies over which the specified criteria are met.

Designs of an electrical connector are described herein that improve signal integrity for high-frequency signals, such as at frequencies in the GHz range, including up to about 56 GHz or up to about 120 GHz or higher, while maintaining a high density, such as with an edge to edge spacing between adjacent contacts (e.g., conductive elements) of approximately 0.25 mm, with a center-to-center spacing between adjacent contacts in a row of between 0.5 mm and 0.8 mm, for example. The contacts may have a width of between 0.3 mm and 0.5 mm.

The shorting member may be formed of a lossy material. Materials that conduct, but with some loss, or materials that by a non-conductive physical mechanism absorbs electromagnetic energy over the frequency range of interest may be referred to herein generally as "lossy" materials. Electrically lossy materials may be formed from lossy dielectric materials and/or poorly conductive materials and/or lossy magnetic materials.

Magnetically lossy materials may include, for example, materials traditionally regarded as ferromagnetic materials, such as those that have a magnetic loss tangent greater than approximately 0.05 in the frequency range of interest. The "magnetic loss tangent" is generally known to be the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest.

Electrically lossy materials may be formed from material traditionally regarded as dielectric materials, such as those that have an electric loss tangent greater than approximately 0.05 in the frequency range of interest. The "electric loss tangent" is generally known to be the ratio of the imaginary part to the real part of the complex electrical permittivity of the material. For example, an electrically lossy material may be formed of a dielectric material in which is embedded a conductive web that results in an electric loss tangent greater than approximately 0.05 in the frequency range of interest.

Electrically lossy materials may be formed from materials that are generally thought of as conductors, but are relatively poor conductors over the frequency range of interest, or contain conductive particles or regions that are sufficiently dispersed that they do not provide high conductivity, or are prepared with properties that lead to a relatively weak bulk conductivity compared to a good conductor (e.g., copper) over the frequency range of interest.

Electrically lossy materials typically have a bulk conductivity of about 1 Siemens/meter to about 100,000 Siemens/meter and preferably about 1 Siemens/meter to about 10,000 siemens/meter. In some embodiments, material with a bulk conductivity of between about 10 Siemens/meter and about 200 Siemens/meter may be used. As a specific example, material with a conductivity of about 50 Siemens/meter may be used. However, it should be appreciated that the conductivity of the material may be selected empirically or through electrical simulation using known simulation tools to determine a suitable conductivity that provides both a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material may have a surface resistivity between 10 Ω/square and 1000 Ω/square. As a specific example, the electrically lossy material may have a surface resistivity of between about 20 Ω/square and 80 Ω/square.

In some embodiments, an electrically lossy material may be formed by adding to a binder a filler that contains conductive particles. In an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers, or other particles may also be used to provide suitable electrically lossy properties. Alternatively, combinations of fillers may be used. For example, metal-plated carbon particles may be used. Silver and nickel may be suitable metals for metal-plating fibers. Coated particles may be used alone or in combination with other fillers, such as carbon flakes. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such thermoplastic materials include liquid crystal polymer (LCP) and nylon. However, many alternative forms of binder materials may be used. Curable materials, such as epoxies, may serve as a binder. Alternatively, materials such as thermosetting resins or adhesives may be used as a binder.

Also, although the binder materials discussed above may be used to create an electrically lossy material by forming a matrix around conductive particle fillers, the present technology described herein is not so limited. For example, conductive particles may be impregnated into a formed matrix material or may be coated onto a formed matrix material, such as by applying a conductive coating to a plastic component or a metal component. As used herein, the term "binder" may encompass a material that encapsulates the filler, is impregnated with the filler or otherwise serves as a substrate to hold the filler.

In some embodiments, the fillers may be present in a sufficient volume percentage to allow conducting paths to be created from particle to particle. For example, when metal fiber is used, the fiber may be present at about 3% to 40% by volume. The amount of filler may impact the conducting properties of the material.

Filled materials may be purchased commercially, such as materials sold under the trade name Celestran® by Celanese Corporation of Irving, Tex., USA, which can be filled with carbon fibers or stainless steel filaments.

A lossy member may be formed from a lossy conductive-carbon-filled adhesive preform, which may be obtained from Techfilm of Billerica, Mass., US, may be used as a lossy material. This preform may include an epoxy binder filled with carbon fibers and/or other carbon particles. The binder may surround carbon particles, which act as a reinforcement for the preform. Such a preform may be inserted in a connector lead frame subassembly to form all or part of the housing. In some embodiments, the preform may adhere through an adhesive in the preform, which may be cured in a heat treating process. In some embodiments, the adhesive may take the form of a separate conductive or non-conductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated, may be used. For example, non-woven carbon fiber may be a suitable reinforcing fiber. As will be appreciated, other suitable reinforcing fibers may be used instead or in combination.

Alternatively, a lossy member may be formed in other ways. In some embodiments, a lossy member may be formed by interleaving layers of lossy and conductive material such as metal foil. These layers may be rigidly attached to one another, such as through the use of epoxy or another adhesive, or may be held together in any other suitable way. The layers may be of the desired shape before being secured to one another or may be stamped or otherwise shaped after they are held together. Alternatively or additionally, a lossy material may be formed by depositing or otherwise forming a diffuse layer of conductive material, such as metal, over an insulative substrate, such as plastic, to provide a composite part with lossy characteristics, as described above.

Turning now to the figures, FIG. 1 depicts an example of a receptacle electrical connector 1 that includes an insulative housing 100 coupled to a receptacle shell 200, according to some embodiments of the present technology. Such a receptacle electrical connector ("receptacle connector," herein) may be used, for example, in an electronic assembly with a configuration in which a cable carries signal to or from a midboard location. The receptacle connector 1 may be mounted at an interior portion of a printed circuit board (PCB) next to a processor, switch, or other high-performance electronic component, such that high frequency signals passing through the cable may be coupled to that component with low attenuation. The connector 1 may have a low height to enable mounting to the PCB while enabling a compact electronic assembly to be formed.

In some embodiments, the receptacle connector 1 may mate with a plug connector (not shown) from which a plurality of cables may extend. The cables may connect to or near an I/O connector mounted at the edge of the PCB. In this way, high-integrity signal paths between the I/O connector and the high-performance electronic component may be provided. In such embodiments, providing reliable high frequency performance of the connector in a small space, using techniques as described herein, may improve the performance of the electronic assembly.

Figure 2:
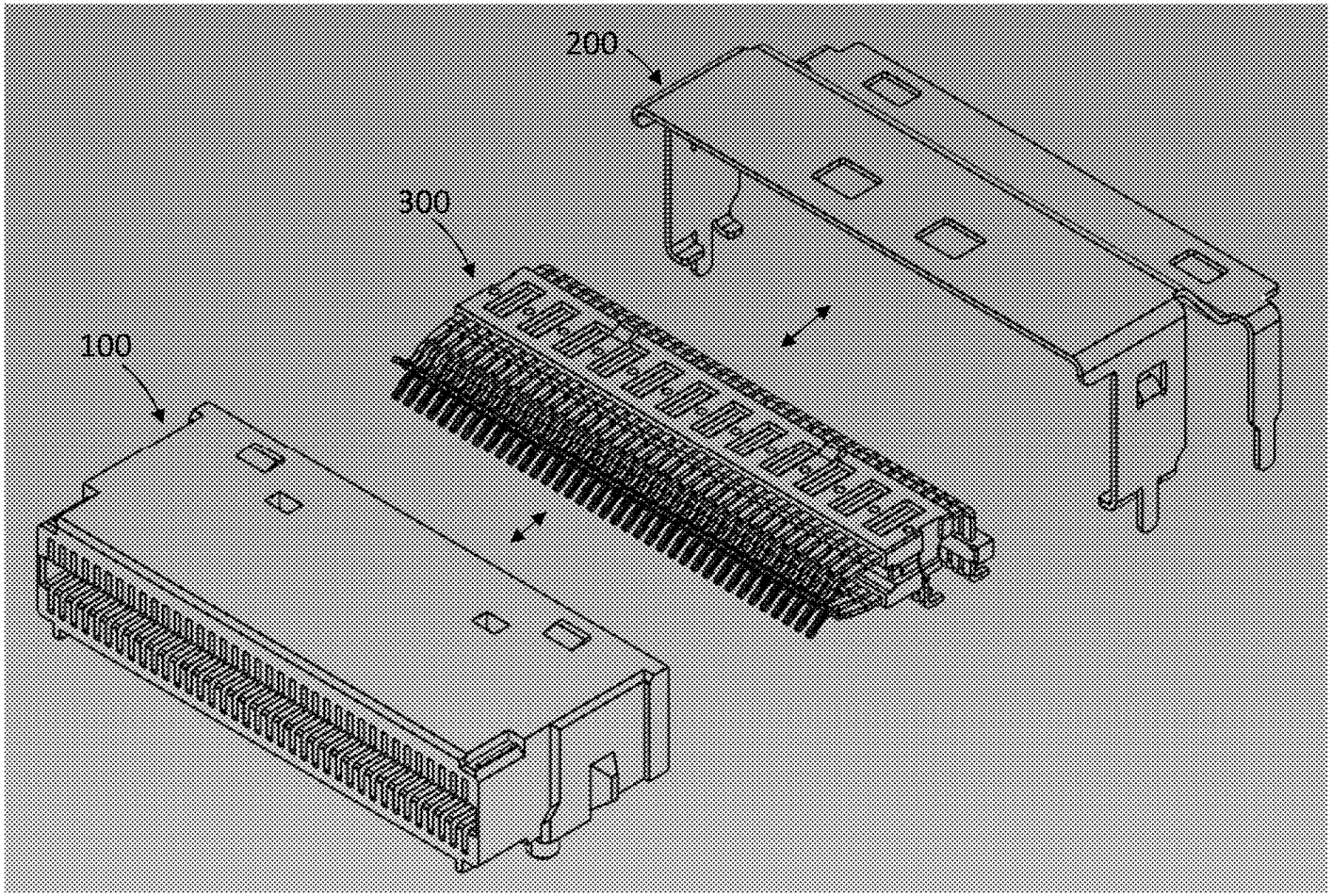
FIG. 2 is a top perspective view of the receptacle connector of FIG. 1 in a partially disassembled state, according to some embodiments.

FIG. 2 depicts an example of the receptacle connector 1 in a partially disassembled state, in accordance with some embodiments described herein. The receptacle connector 1 includes the insulative housing 100 coupled to the receptacle shell 200 and a terminal assembly 300, in accordance with some embodiments described herein. The double-headed arrows show the directions along which the receptacle connector 1 has been partially disassembled in this example.

In some embodiments, the terminal assembly 300 may be positioned within the insulative housing 100 to receive one or more plug contacts from a mating plug connector. The one or more plug contacts may be received between the first and second rows of terminals and through a face of the insulative housing 100. Accordingly, it may be appreciated that a mating plug connector may mate with the receptacle connector 1 by being moved along the directions indicated by the double-headed arrows. In some embodiments where the receptacle connector 1 is mounted to a PCB via the receptacle shell 200, it may be appreciated that a mating plug connector may mate with the receptacle connector 1 in a direction parallel to the surface of the PCB.

Figure 3A:
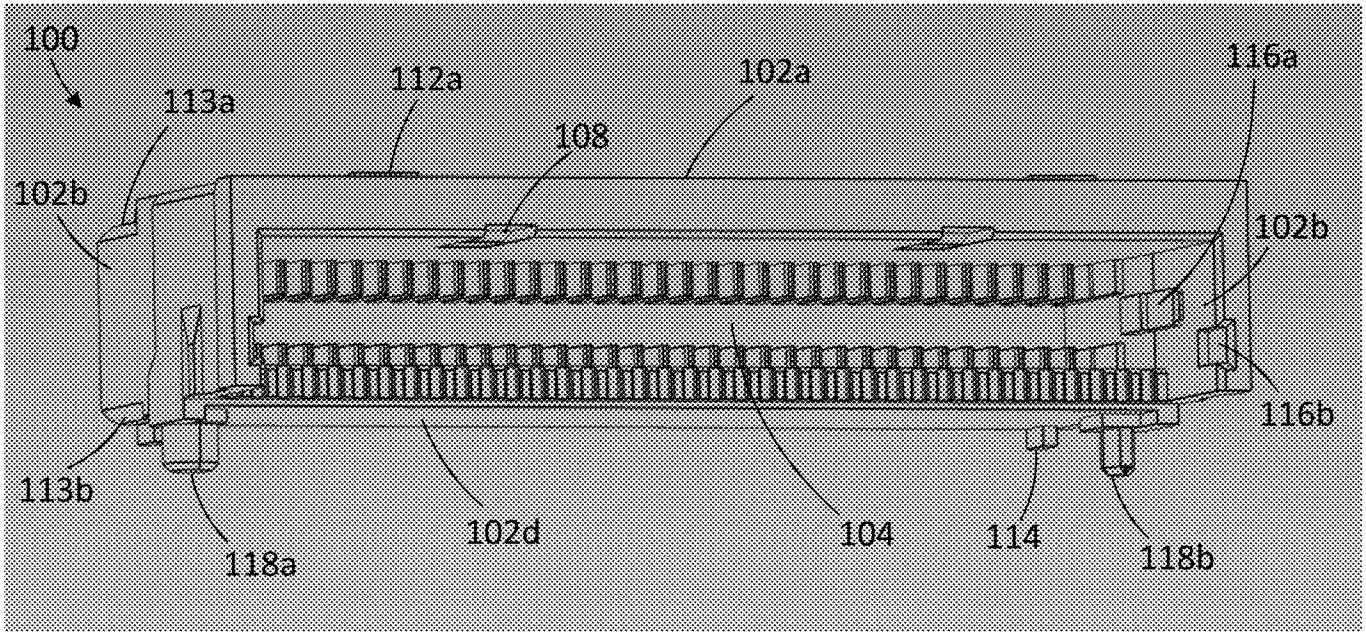
FIG. 3A is a rear perspective view of the insulative housing of the receptacle connector of FIG. 1, according to some embodiments.
Figure 3B:
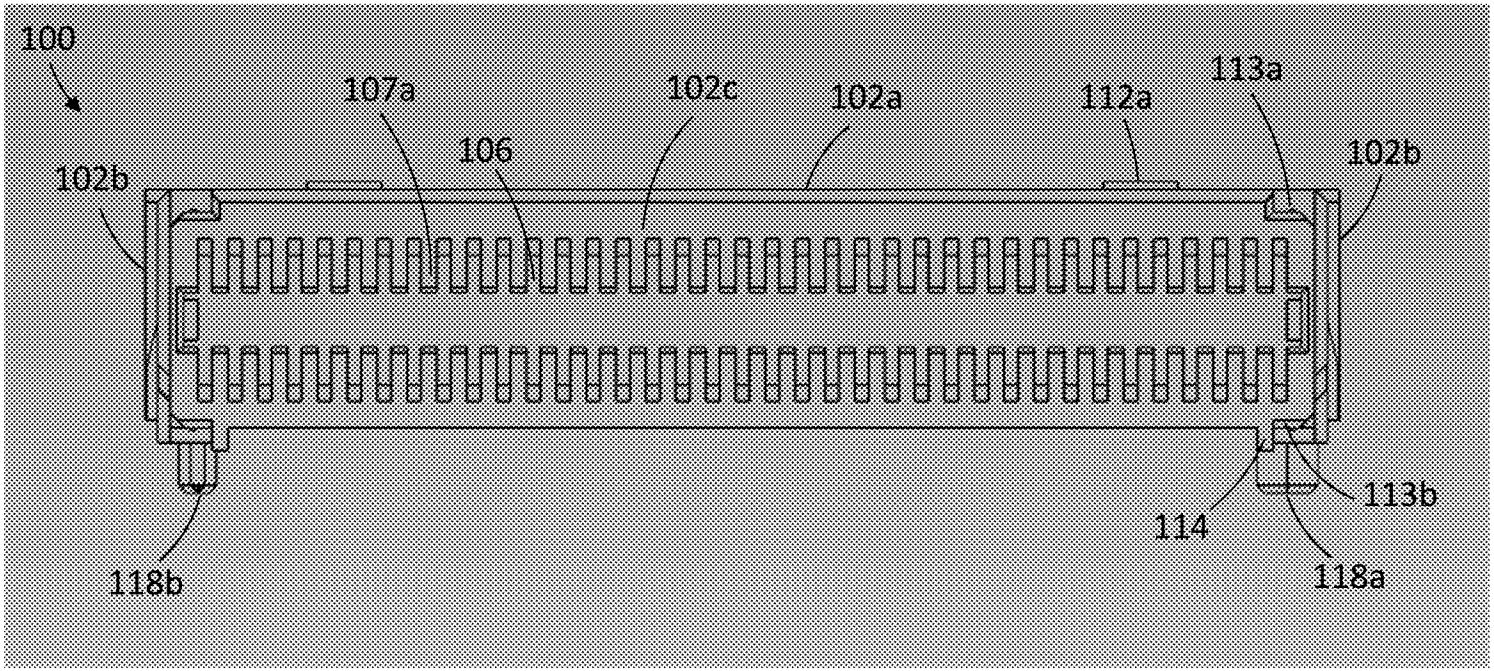
FIG. 3B is a front elevation view of the insulative housing of the receptacle connector of FIG. 1, according to some embodiments.
Figure 3C:
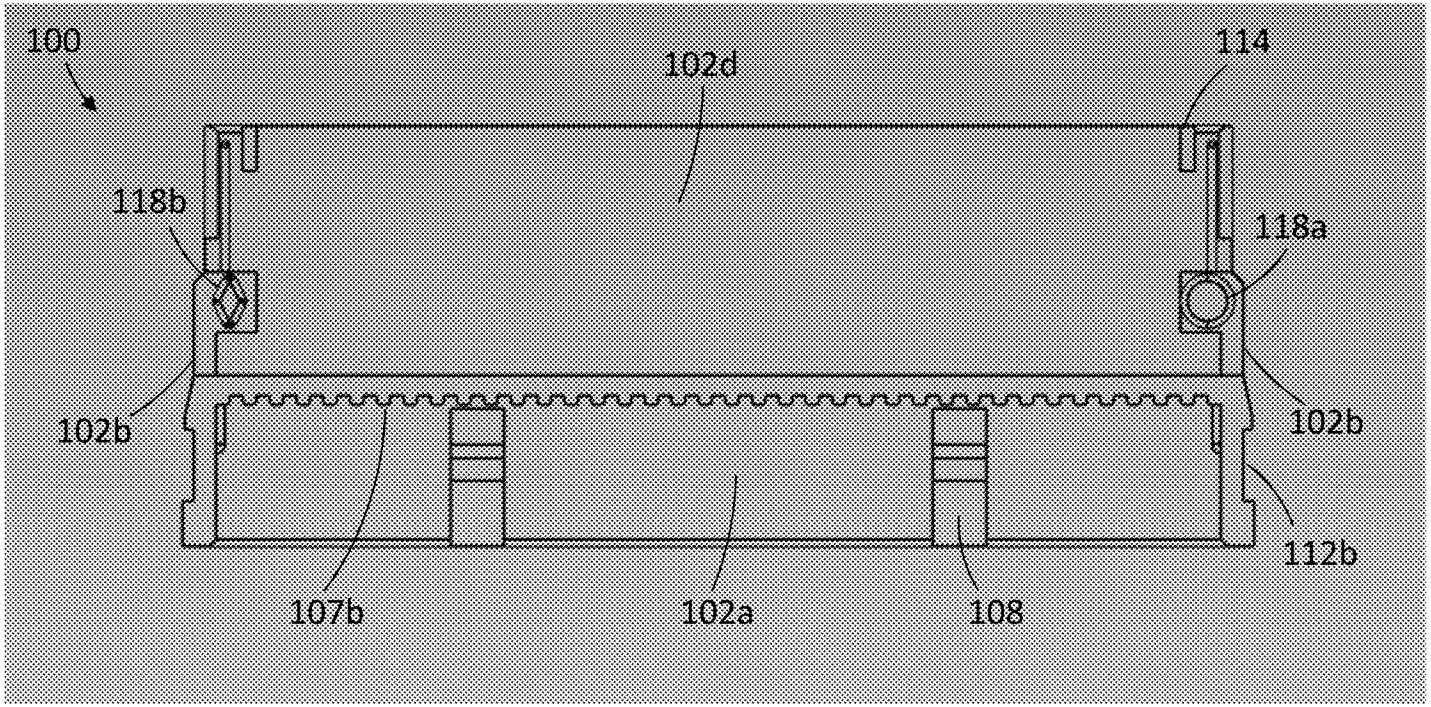
FIG. 3C is a bottom plan view of the insulative housing of the receptacle connector of FIG. 1, according to some embodiments.
Figure 3D:
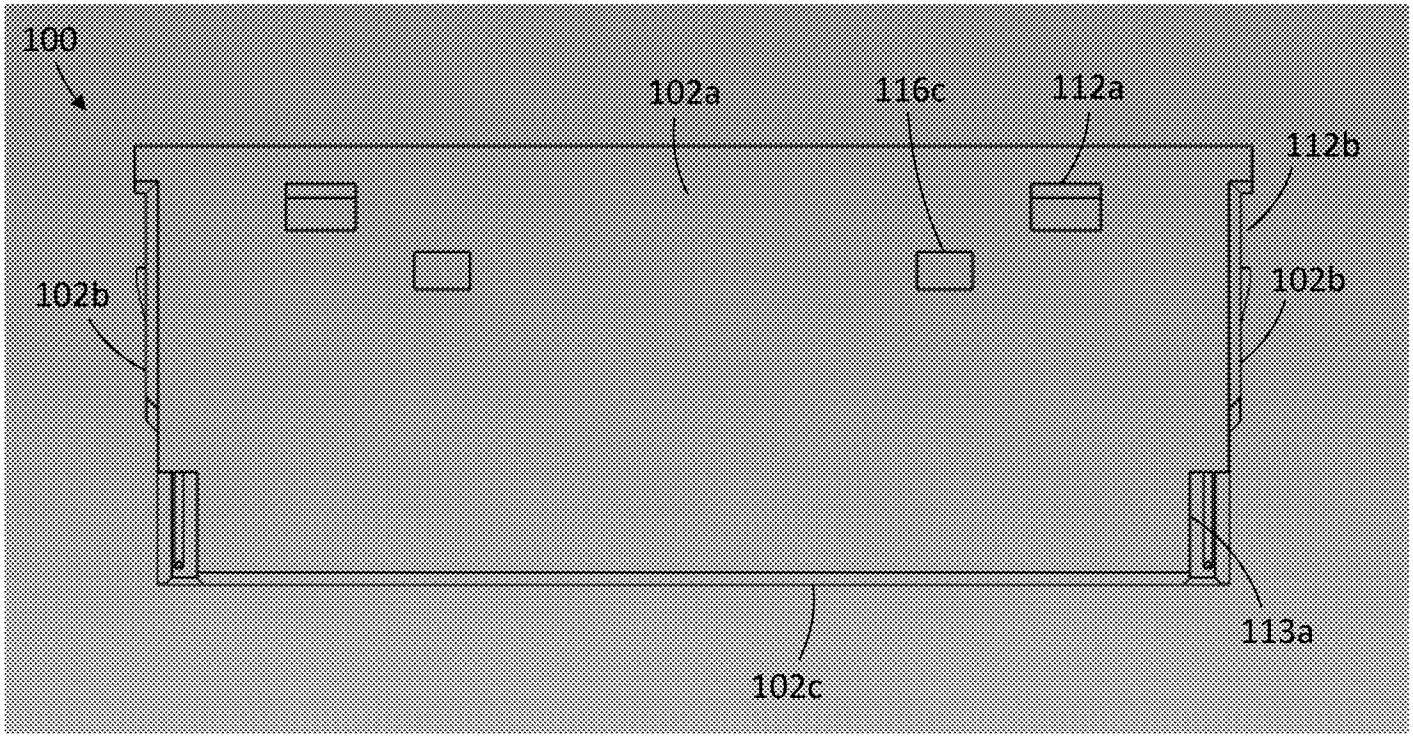
FIG. 3D is a top plan view of the insulative housing of the receptacle connector of FIG. 1, according to some embodiments.
Figure 3E:
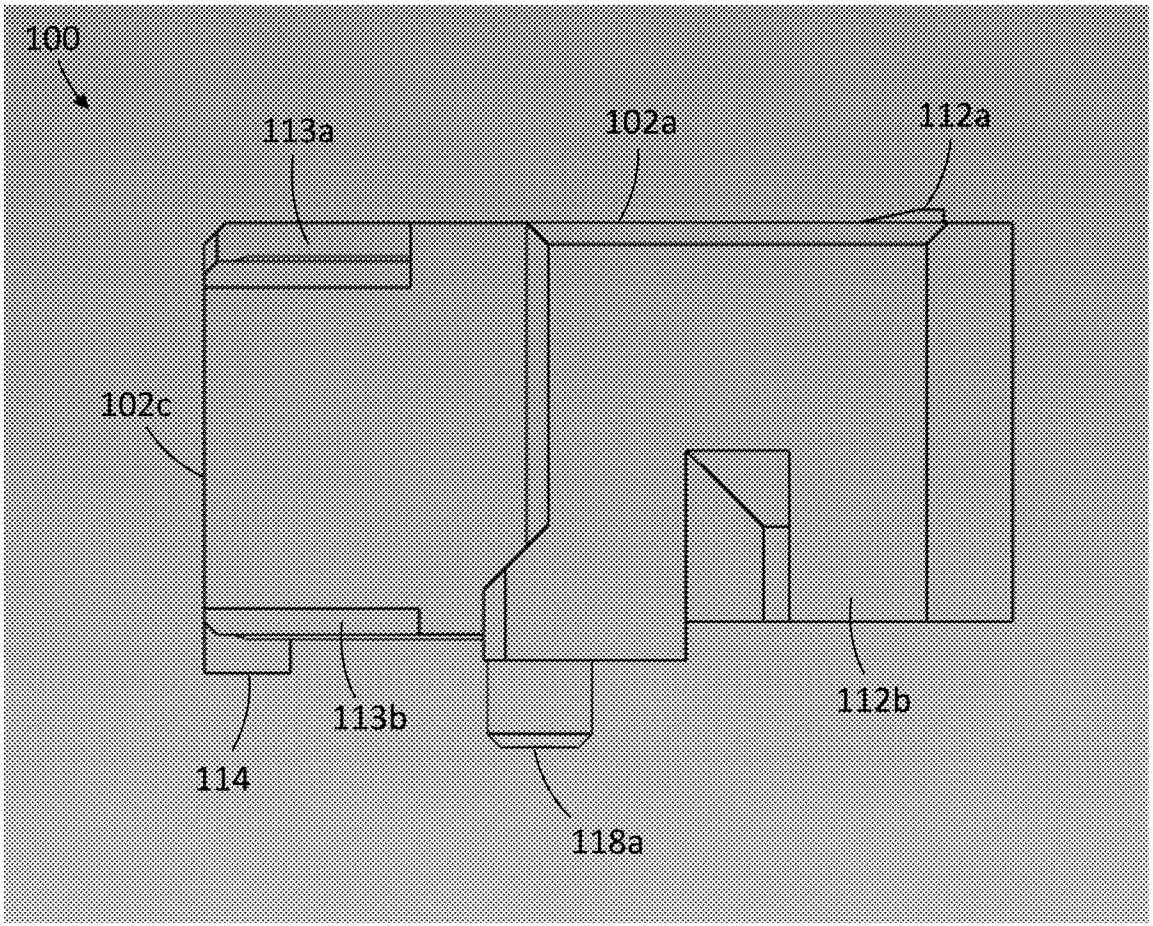
FIGS. 3E and 3F are elevation side views of the insulative housing of the receptacle connector of FIG. 1, according to some embodiments.
Figure 3F:
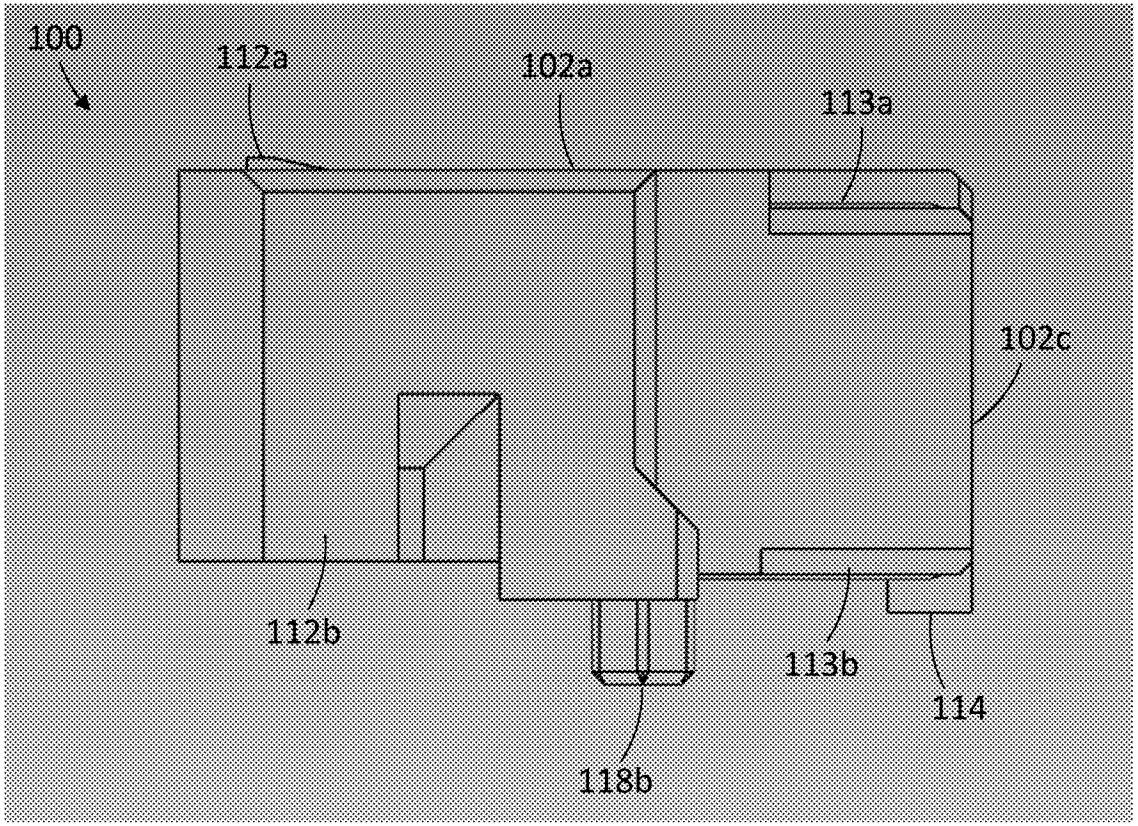

FIG. 3A depicts an example of a rear perspective view of an interior of the insulative housing 100, in accordance with some embodiments described herein. FIG. 3B depicts an example of a front elevational view of the insulative housing 100. FIGS. 3C and 3D depict, respectively, examples of bottom and top plan views of the insulative housing 100. FIGS. 3E and 3F depict, respectively, examples of right-side and left-side elevational views of the insulative housing 100.

In some embodiments, the insulative housing 100 may include an upper wall 102*a*, side walls 102*b*, a front wall 102*c*, and a bottom wall 102*d*. The upper wall 102*a*, side walls 102*b*, front wall 102*c*, and bottom wall 102*d* define an interior cavity 104. When the receptacle connector 1 is assembled, the terminal assembly 300 may be disposed within the cavity 104.

In some embodiments, the front wall 102*c* may include an opening having alternating terminal cavities 106 and terminal barriers 107*a*. Terminals of the terminal assembly 300 may be disposed within the terminal cavities 106 when the terminal assembly 300 is disposed within cavity 104. The terminal barriers 107*a* may prevent individual terminals of the terminal assembly 300 from accidentally making physical and electrical contact with each other during and/or after manufacture of the receptacle connector 1.

The bottom wall 102*d* may be a partial wall, which may not extend the full length of side walls 102*b*, in some embodiments. When the terminal assembly 300 is disposed in the cavity 104, the opening in the bottom wall 102*d* may accommodate the mounting ends of the terminals of the terminal assembly 300. The bottom wall 102*d* may include additional terminal barriers 107*b*, as seen in FIG. 3C, to prevent accidental physical and electrical contact between individual terminals of the terminal assembly 300.

In some embodiments, one or more features of the insulative housing 100 may assist in proper coupling of the insulative housing 100 to other components of the receptacle connector 1. For example, the receptacle shell 200 may couple to the insulative housing 100 via receptacle-shell engagement features 112*a* and/or 112*b*. The receptacle-shell engagement features 112*a* and 112*b* may engage clips of the receptacle shell 200. Alternatively or additionally, receptacle-shell tab engagement features 113*a* and 113*b* may engage with and fit within receptacle-shell tabs (described below) to maintain the position of receptacle shell 200. Receptacle-shell stops 114 may also engage with the receptacle shell 200 to prevent the receptacle shell 200 from being bent during assembly.

In some embodiments, when the terminal assembly 300 is disposed in the cavity 104, parts of the terminal assembly 300 may engage with one or more of terminal-assembly engagement features 108, 116*a*, 116*b*, and/or 116*c*. For example, the terminal-assembly engagement features 108 may be recesses in the upper wall 102*a* such that projections of the terminal assembly 300 may slot into the terminal-assembly engagement features 108 when the receptacle connector is assembled. The terminal-assembly engagement features 116*a* may be projections from one or more side walls 102*b* such that the terminal assembly engagement features 116*a* engage with recesses and/or slots of the terminal assembly 300. The terminal-assembly engagement features 116*b* may be recesses in one or more of the side walls 102*b* such that projections of the terminal assembly 300 may slot into the terminal assembly engagement features 116*b* when the receptacle connector is assembled. The terminal-assembly engagement features 116*c* may be through holes in the upper wall 102*a* that connect with complementary engagement features (not shown) that extend outwards from the terminal assembly 300 to latch into the terminal assembly engagement features 116*c*.

In some embodiments, the insulative housing 100 may physically couple to a PCB. The insulative housing 100 may include one or more guide posts 118*a* and 118*b* extending from the bottom wall 102*d*. The guide posts 118*a* and 118*b* may have differently shaped cross sections to ensure that the receptacle connector 1 is mounted to the PCB in the correct orientation. In the examples of FIGS. 3A-3F, the guide posts 118*a* and 118*b* have circular and diamond-shaped cross sections, but it may be appreciated that any suitably shaped cross section may be used.

Figure 4A:
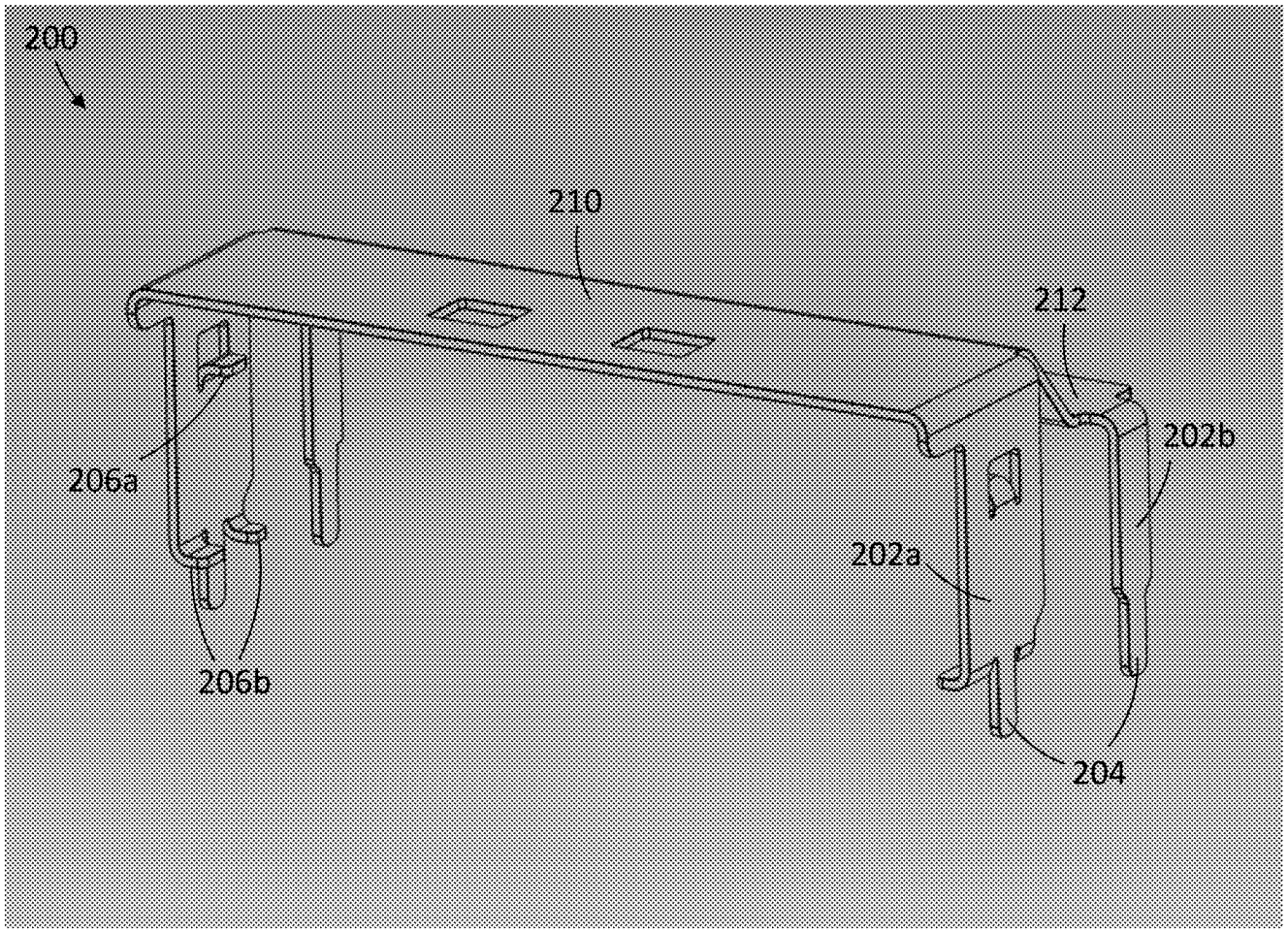
FIGS. 4A and 4B are perspective views of the front and rear of the receptacle shell of FIG. 1, according to some embodiments.
Figure 4B:
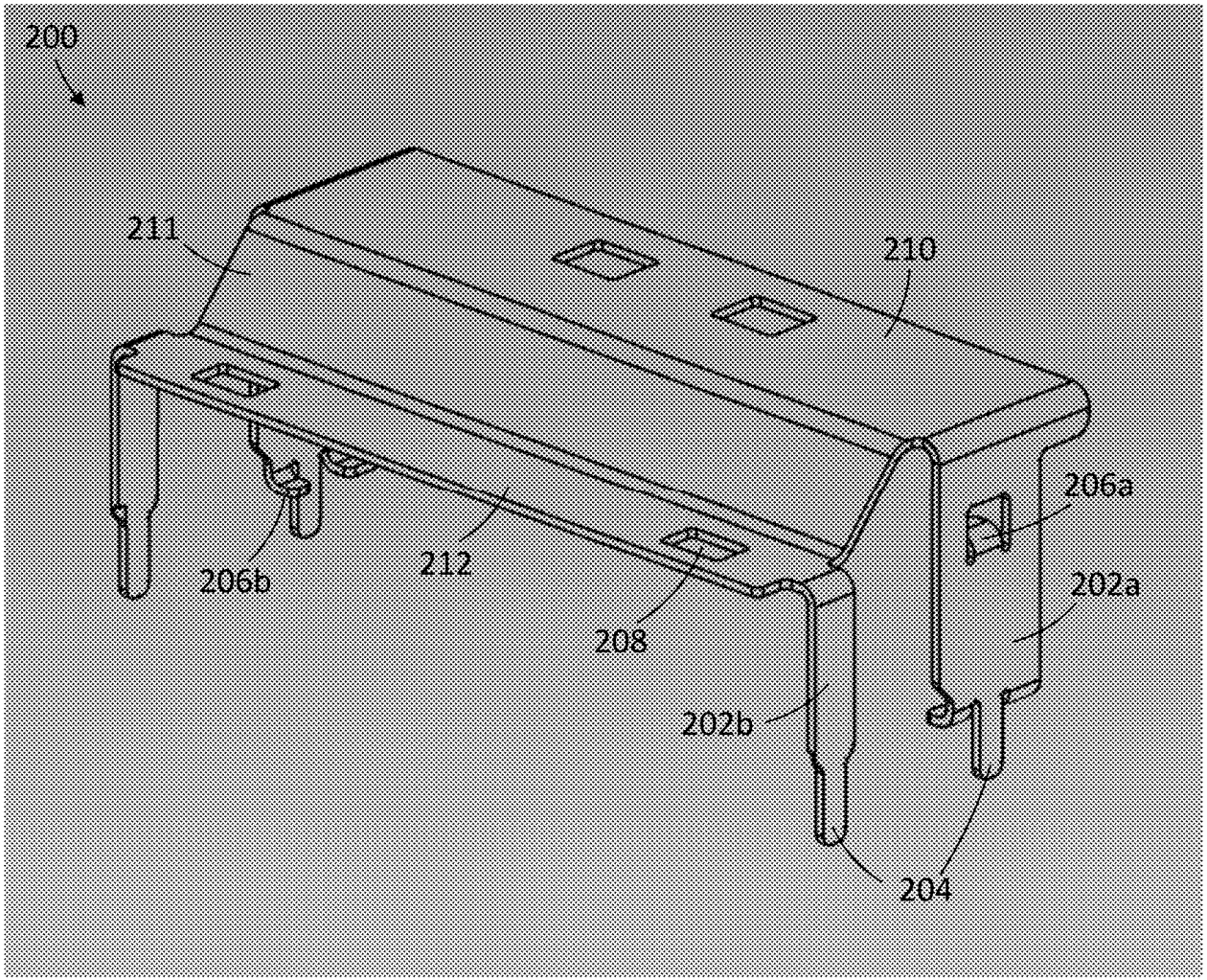

FIGS. 4A and 4B depict example perspective views of a receptacle shell 200, according to some embodiments described herein. The shell 200 of the receptacle connector 1 may be configured to surround an outer surface of the insulative housing 100. The receptacle shell 200 may include at least one conforming portion 212, which conforms with and is adjacent the upper wall 102*a* of the insulative housing 100. The receptacle shell 200 may include at least one spaced-apart portion 210, which is separated or spaced apart from the upper wall 102*a* of the insulative housing 100.

In some embodiments, the receptacle shell 200 may be formed of metal. For example, the receptacle shell 200 may be made from a single sheet of metal, which has features stamped out of the sheet and then is bent and formed to the illustrated shapes. In other embodiments, the receptacle shell 200 may be formed of more than one component joined together.

In some embodiments, the receptacle shell 200 may be formed with front legs 202*a* and back legs 202*b* that conform around the side walls 102*b* of the insulative housing 100. The front legs 202*a* and the back legs 202*b* may be arranged such that each side wall 102*b* has a single front leg 202*a* and a single back leg 202*b* conformed with the side wall 102*b*. In some embodiments, such as the examples of FIGS. 4A and 4B, the front legs 202*a* and the back legs 202*b* may have different dimensions and/or shapes, though it is to be appreciated that in some embodiments the front legs 202*a* and the back legs 202*b* may be of the same form.

The front legs 202*a* and the back legs 202*b* may include PCB mounting members 204 extending from ends of the front legs 202*a* and the back legs 202*b* opposite from ends attached to the conforming portion 212 and the spaced-apart portion 210. The PCB mounting members 204 may be tabs that are configured to engaged with one or more features of a PCB. The PCB mounting members 204 may be configured to be solder mounted or otherwise fixedly mounted to a PCB to provide a permanent engagement of the receptacle connector 1 to the PCB.

Additionally, in some embodiments, the receptacle shell 200 may include one or more engagement features for affixing the receptacle shell 200 to the insulative housing 100. For example, receptacle-shell tabs 206*a* and 206*b* may engage with the receptacle-shell tab engagement features 113*a* and 113*b* of the insulative housing 100. Additionally or alternatively, receptacle-shell engagement holes 208 may receive therein and surround the receptacle-shell engagement features 112*a* of the insulative housing 100.

The space between the insulative housing 100 and the spaced-apart portion 210 of the receptacle shell 200 may be structured to receive protrusions of a mating plug connector. The spaced-apart portion 210 of the receptacle shell 200 may enable the mating plug connector to achieve a general alignment with the receptacle connector 1 during an initial part of the mating operation. Although FIG. 4B shows the receptacle shell 200 including one spaced-apart portion 210, it should be understood that in various other embodiments of the present technology the receptacle shell 200 may have more than one spaced-apart portions 210 or no spaced-apart portion 210.

The conforming portion 212 of the receptacle shell 200 may conform with the front wall 102*a* of the insulative housing 100 except at the spaced-apart portion 210, which may be disposed along the front wall 102*a* of the receptacle shell 200. Optionally, the spaced-apart portion 210 may be disposed along one or both of the side walls 102*b* of the receptacle shell 200, or along any combination of the front wall 102*a* and the side walls 102*b*.

Figure 5A:
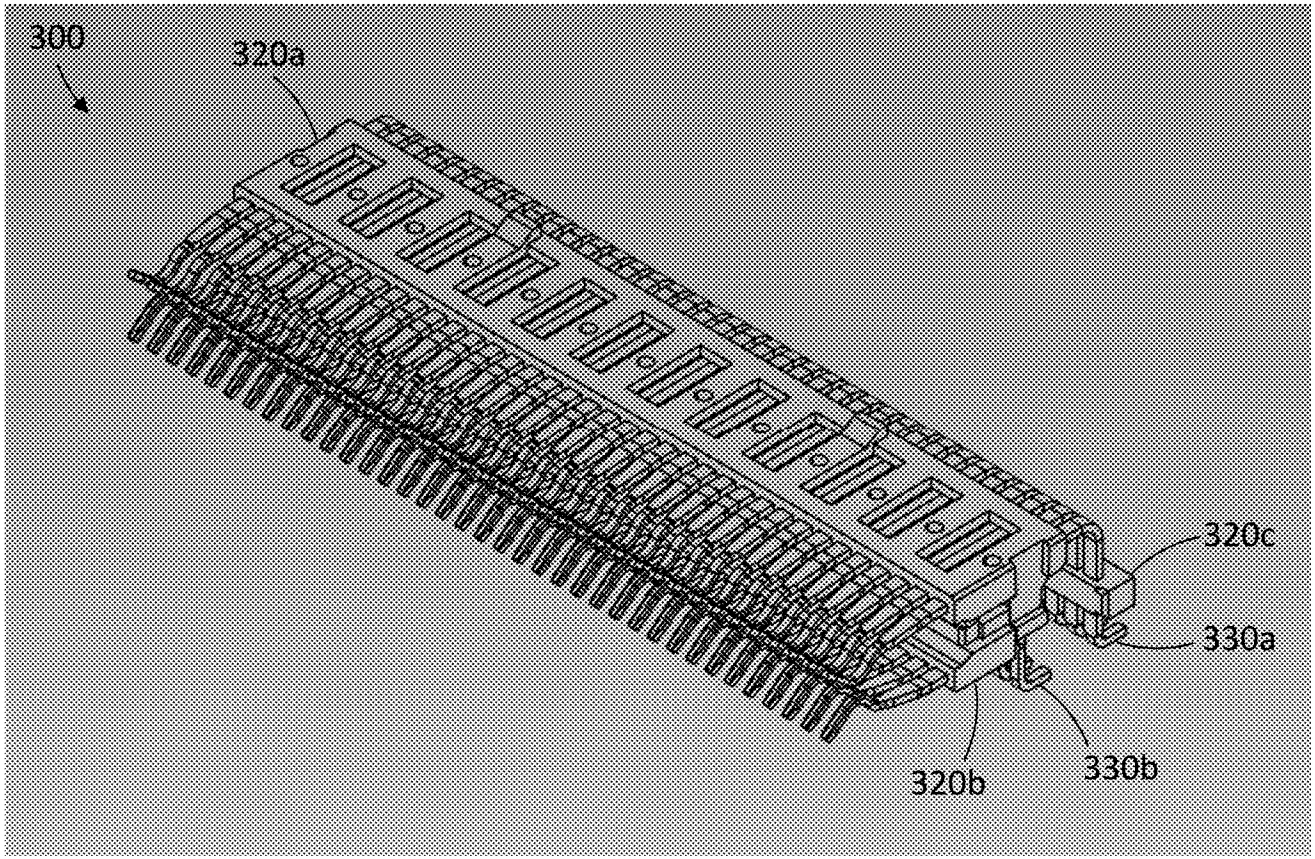
FIG. 5A is a top perspective view of the terminal assembly of FIG. 2, according to some embodiments.
Figure 5B:
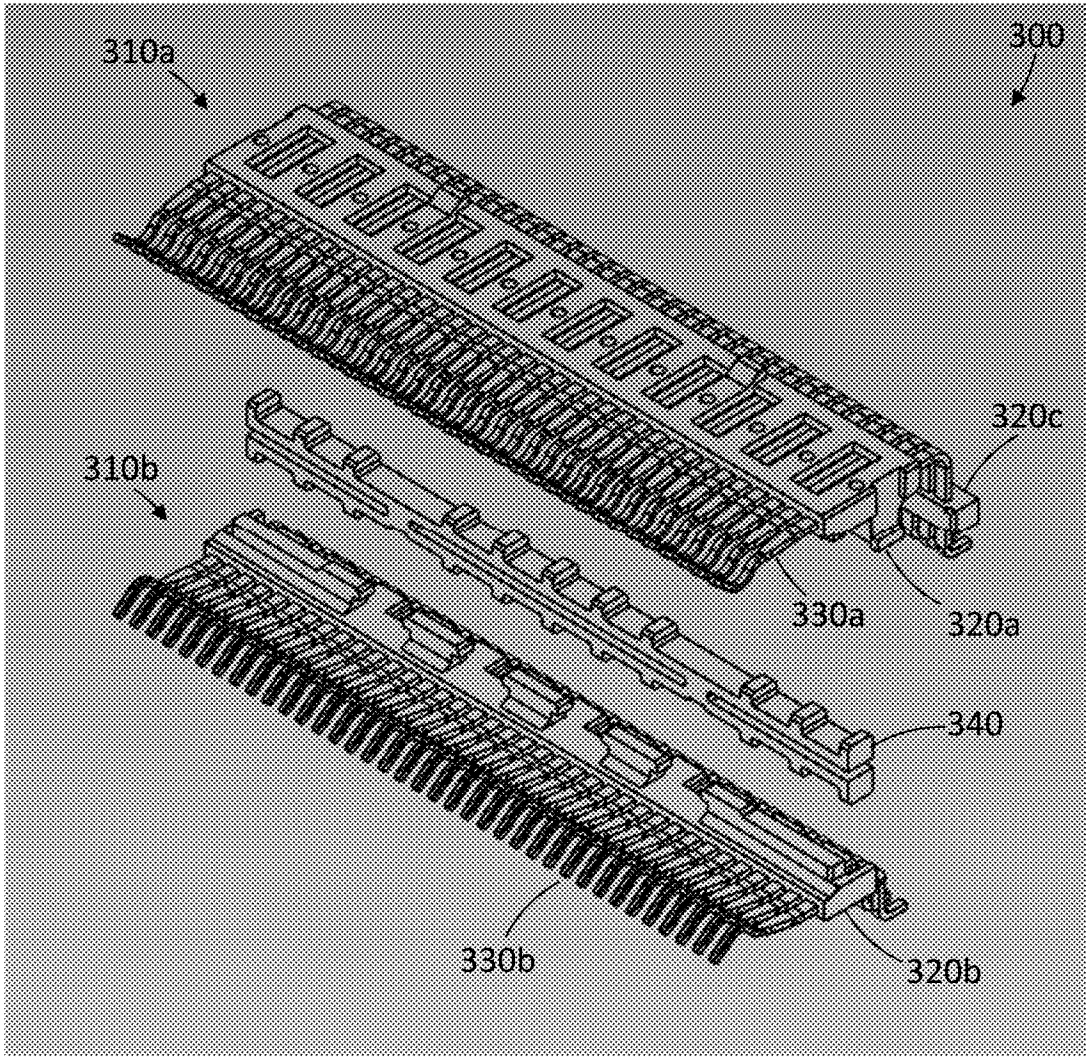
FIGS. 5B and 5C are a top perspective view of the terminal assembly of FIG. 2 in a partially disassembled state, according to some embodiments.
Figure 5C:
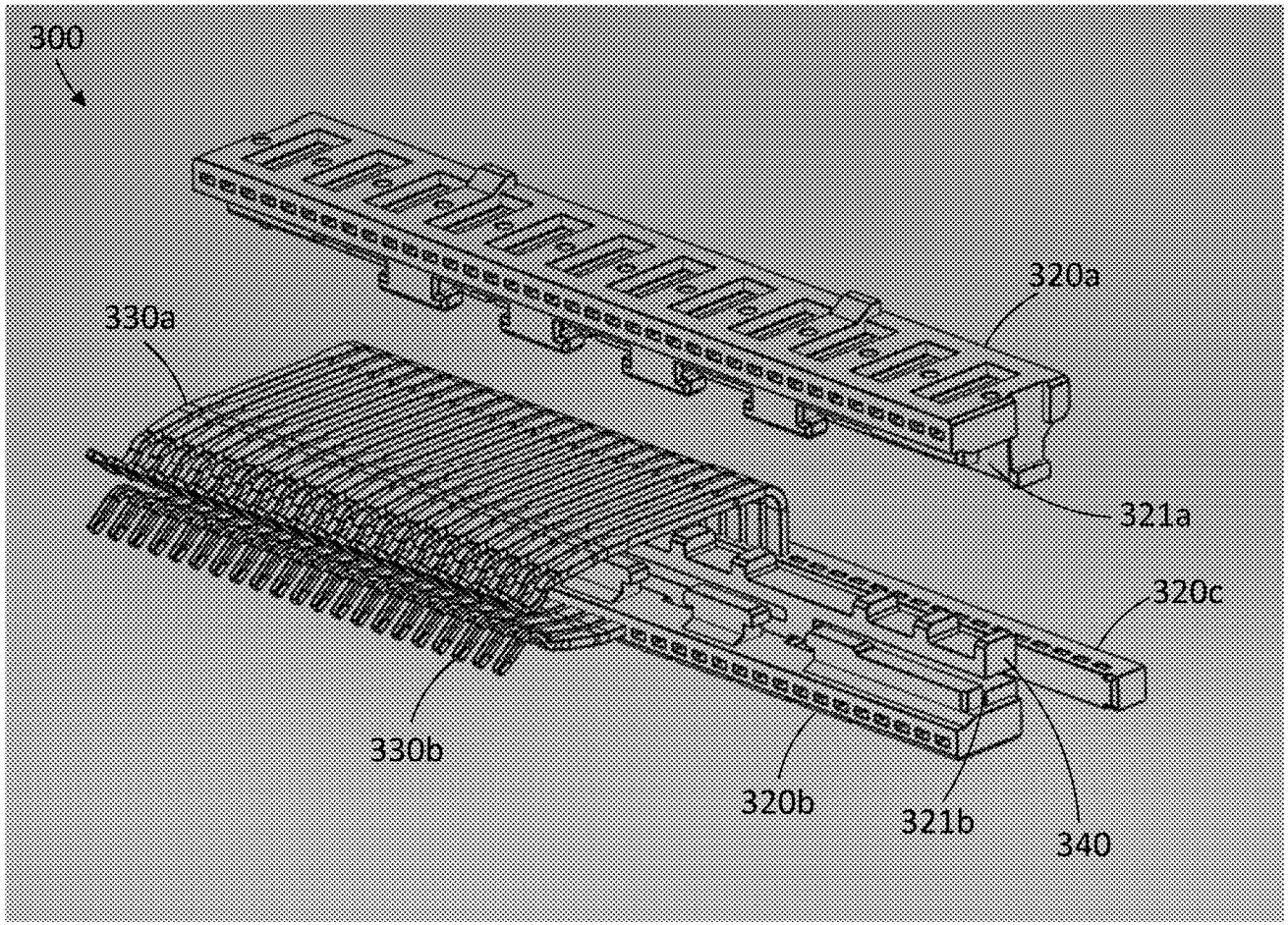
Figure 5E:
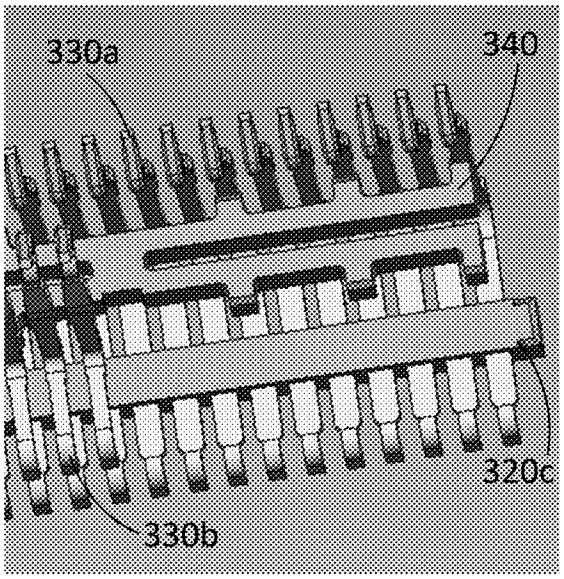
FIGS. 5D and 5E are a front perspective view of the terminal assembly of FIG. 2 in a partially disassembled state, according to some embodiments.
Figure 5D:
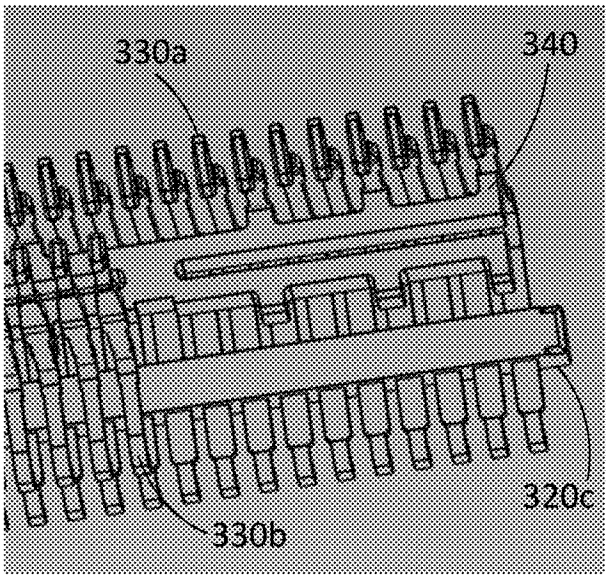

In accordance with some embodiments described herein, the receptacle connector 100 may include a terminal assembly 300 on which first terminals 330*a* and second terminals 330*b* are arranged, as depicted in the example of FIG. 5A. FIG. 5B depicts a partially exploded view of the terminal assembly 300. FIG. 5C depicts a partially exploded view of the terminal assembly 300, with some of the first terminals 330*a* and some of the second terminals 330*b* hidden to reveal various structural aspects of the terminal assembly 300. FIGS. 5D and 5E depict another perspective view of the terminal assembly 300, partially disassembled to reveal various structural aspects of the terminal assembly 300. FIG. 5E is a three-dimensional rendering of the line drawings of FIG. 5D, to more clearly illustrate curvatures and other features that may not be easily seen in the line drawing.

In some embodiments, the terminal assembly 300 may include a first terminal subassembly 310*a* and a second terminal subassembly 310*b*. The first terminal subassembly 310*a* may include the first terminals 330*a*, a first insulative member 320*a*, and a third insulative member 320*c*. The second terminal subassembly 310*b* may include the second terminals 330*b* and a second insulative member 320*b*. Terminals of the first and second terminals 330*a* and 330*b* may include ground terminals and signal terminals.

In some embodiments, the first terminal subassembly 310*a* and the second terminal subassembly 310*b* may couple to each other such that a lossy member 340 may be disposed between the two subassemblies 310*a*, 310*b*. The lossy member 340 may be elongated in a row or longitudinal direction X (e.g., see FIG. 7A) of the terminal assembly 300. The first terminal subassembly 310*a* may include a group of first terminals 330*a* arranged in a first row and the second terminal subassembly 310*b* may include a group of second terminals 330*b* arranged in a second row parallel to the first row formed by the first terminals 330*a*. The row or longitudinal direction X may correspond to the direction of the first row of first terminals 330*a* and the second row of second terminals 330*b*.

In some embodiments, the first insulative member 320*a*, the second insulative member 320*b*, and the third insulative member 320*c* may be formed of an insulative material. The insulative members may be formed to stabilize the first and/or second terminals 330*a*, 330*b* and to prevent electrical shorting. For example, the first insulative member 320*a*, the second insulative member 320*b*, and the third insulative member 320*c* may be formed of a plastic material. The plastic material may be molded around the first terminals 330*a* or the second terminals 330*b* during formation of the first and second terminal subassemblies 310*a* and 310*b*. For example, as shown in FIG. 5B, the first terminals 330*a* may be embedded in and extend from the first insulative member 320*a* and the third insulative member 320*c*. However, other means for holding the first and/or second terminals 330*a*, 330*b* in a row may be used, such as pressing the first and/or second terminals 330*a*, 330*b* into slots in the insulative members or compressing the terminals between insulative components.

In some embodiments, the first terminal subassembly 310*a* and the second terminal subassembly 310*b* may couple to each other through coupling members present on the first insulative member 320*a* and the second insulative member 320*b*, as will be described herein. As shown in FIG. 5C, the first insulative member 320*a* may include a first recess 321*a*, which is elongated along the row direction X. When the first and second terminal subassemblies 310*a* and 310*b* are coupled, the lossy member 340 may be disposed within the first recess 321*a*.

In some embodiments, when the first terminal subassembly 310*a* and the second terminal subassembly 310*b* are coupled together, a cross-sectional area of the first recess 321*a*, perpendicular to the row direction X, may be less than a cross-sectional area of the lossy member 340 when the lossy member 340 is not compressed between the first and second terminal subassemblies 310*a* and 310*b*. In this way, the lossy member 340 may be compressed such that projections of the lossy member 340 are pushed against and in contact with terminals of the first and second terminal subassemblies 310*a* and 310*b* when the assemblies are coupled together. Projections of the lossy member 340 may be coupled to the ground terminals but not the signal terminals of the first and second terminals 330*a* and 330*b*. As shown in the example of FIGS. 5D and 5E, where the terminal assembly 340 has been depicted as partially disassembled, projections of the lossy member 340 may be coupled with terminals (e.g., ground terminals) that are separated by two other terminals (e.g., signal terminals). It may be appreciated that in some embodiments only one terminal or more than two terminals may separate the terminals coupled to the lossy member 340.

In some embodiments, a second recess 321*b* may be disposed on the longitudinal ends of the second insulative member 320*b*. The second recess 321*b* may engage with the engagement feature 116*a* of the insulative housing 100 by fitting around engagement feature 116*a* when the terminal assembly 300 is inserted into the insulative housing 100. The second recess 321*b* and the engagement feature 116*a* may prevent the terminal assembly 300 from shifting in a direction Z, perpendicular to the row direction X.

Figure 6A:
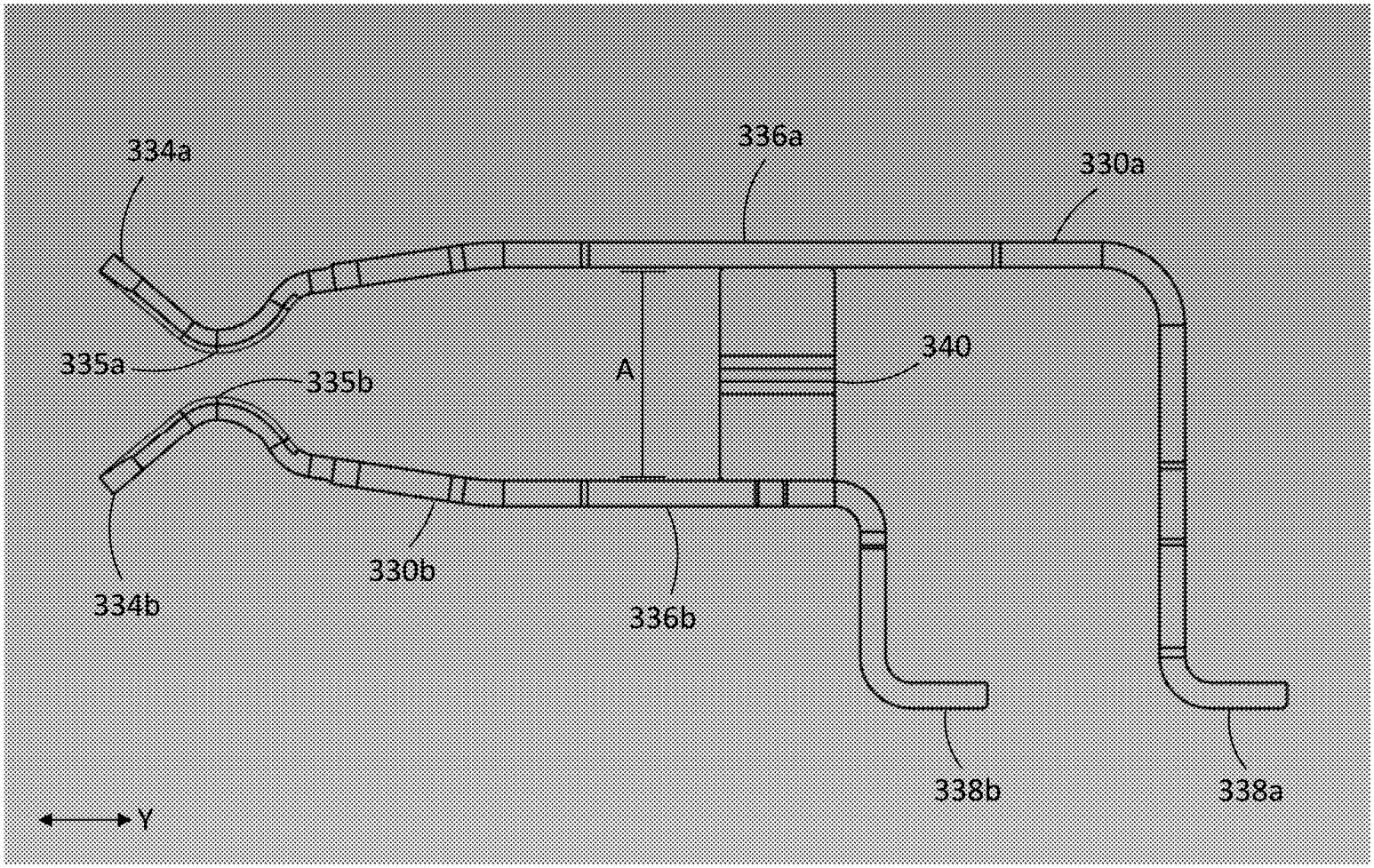
FIG. 6A is a side elevation view of terminals of the terminal assembly of FIG. 2, according to some embodiments.

FIG. 6A shows a side elevational view of one of the first terminals 330*a*, one of the second terminals 330*b*, and the lossy member 340, with the insulative members 320*a*, 320*b*, and 320*c* removed, in accordance with some embodiments described herein. Each terminal of the first and second terminals 330*a* and 330*b* may be formed of a conductive material such as a metal. The first and second terminals 330*a* and 330*b* may include a free distal end 334*a*, 334*b*, an intermediate portion 336*a*, 336*b*, and a mounting end 338*a*, 338*b* opposite the free distal end 334*a*, 334*b*.

In some embodiments, the free distal end 334*a*, 334*b* may be hooked relative to the intermediate portion 336*a*, 336*b*. A contact surface 335*a*, 335*b* may be disposed near the free distal end 334*a*, 334*b* of the first and second terminals 330*a* and 330*b*. The first and second terminals 330*a* and 330*b* may be bent at the free distal ends 334*a*, 334*b*, and the contact surfaces 335*a*, 335*b* may be arranged such that a complementary mating terminal (not pictured) may be accepted between the first and second terminals 330*a* and 330*b* and in contact with the contact surfaces 335*a*, 335*b*.

The contact surfaces 335*a*, 335*b* may be fully or partially plated with a noble metal, such as gold, or another suitable metal or alloy that resists oxidation and provides a low-resistance contact with a complementary terminal of a mating connector. In some embodiments, both ground terminals and signal terminals of the first and second terminals 330*a* and 330*b* may be plated in order to promote low-resistance contacts with the complementary terminals of a mating connector. Alternatively, a selection of ground terminals and signal terminals (e.g., only the ground terminals, only the signal terminals, and/or a subset of both the ground and signal terminals) of the first and second terminals 330*a* and 330*b* may be plated with on their contact surfaces 335*a*, 335*b*. The intermediate portions 336*a*, 336*b* of at least the ground terminals of the first and second terminals 330*a* and 330*b* may also be plated to provide additional contact surfaces for making electrical contact to the lossy member 340.

In accordance with some embodiments described herein, the mounting ends 338*a*, 338*b* may be configured to be fixedly mounted to a substrate (e.g., a PCB). As shown in the example of FIG. 6A, the intermediate portions 336*a*, 336*b* may be bent to provide a right-angle configuration for the terminal assembly. Accordingly, the mounting ends 338*a*, 338*b* may be hooked to provide a flat surface for bonding (e.g., solder-mounting) the terminals of the first and second terminals 330*a* and 330*b* to a substrate. It may be appreciated that the configurations shown in FIG. 6A are merely examples, and the first and second terminals 330*a* and 330*b* may have other configurations than those shown. For example, the first and second terminals 330*a* and 330*b* may have mounting ends 338*a*, 338*b* configured as press-fits for insertion into holes in a substrate, or may be shaped for terminating at a cable or a wire, in embodiments in which the receptacle connector 1 is configured for use in a cable assembly.

As mentioned above, the mounting ends 338*a*, 338*b* may be considered a fixable end of the first and second terminals 330*a* and 330*b*, because the mounting ends 335*a*, 335*b* may be fixable to a PCB (not shown). In contrast, the free distal ends 334*a*, 334*b* may be configured to bend or move in response to a force, including a force applied by terminals of a mating connector (e.g., a plug-type connector).

Figure 6B:
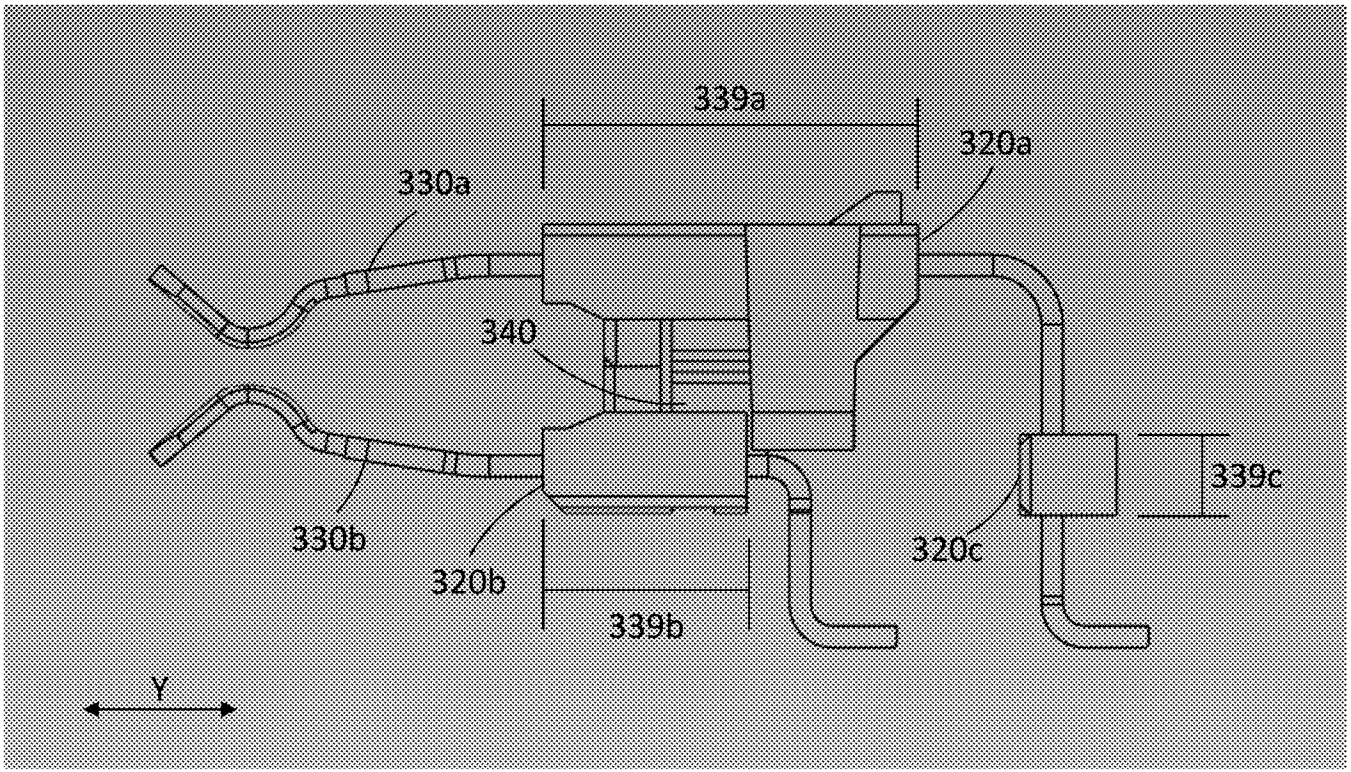
FIG. 6B is a side elevation view of terminals housed in the insulative members of the terminal assembly of FIG. 2, according to some embodiments.

FIG. 6B shows a side elevational view of one of the first terminals 330*a*, one of the second terminals 330*b*, the lossy member 340, and the insulative members 320*a*, 320*b*, and 320*c*, in accordance with some embodiments described herein. The first insulative member 320*a* may be disposed around a first segment 339*a* of the intermediate portion 336*a* of first terminal 330*a*. The third insulative member 320*c* may be disposed around a second segment 339*c* of the intermediate portion 336*a* of first terminal 330*a*, where the second segment 339*c* may be separated from the first segment 339*a* by a right angle bend in terminal 330*a*. The third insulative member 320*c* may be configured to support the mounting ends 338*a* of the first terminals 330*a* and to prevent the first terminals 330*a* from bending prior to the receptacle connector 1 being mounted to a substrate (e.g., a PCB).

In some embodiments, the second insulative member 320*a* may be disposed around a segment 339*b* of the intermediate portion 336*b* of second terminal 330*b*. The location of the segment 339*b* in a direction Y perpendicular to the row direction X may overlap partly or entirely with the location in a direction parallel to the direction Y of the first segment 339*a* of the first terminal 330*a*. The segment 339*b* may be shorter in length than first segment 339*a* so that the first and second insulative members 320*a* and 320*b* may be coupled while the lossy member 340 is supported between the first and second insulative members 320*a* and 320*b*, as shown in the example of FIG. 6B.

Figure 7A:
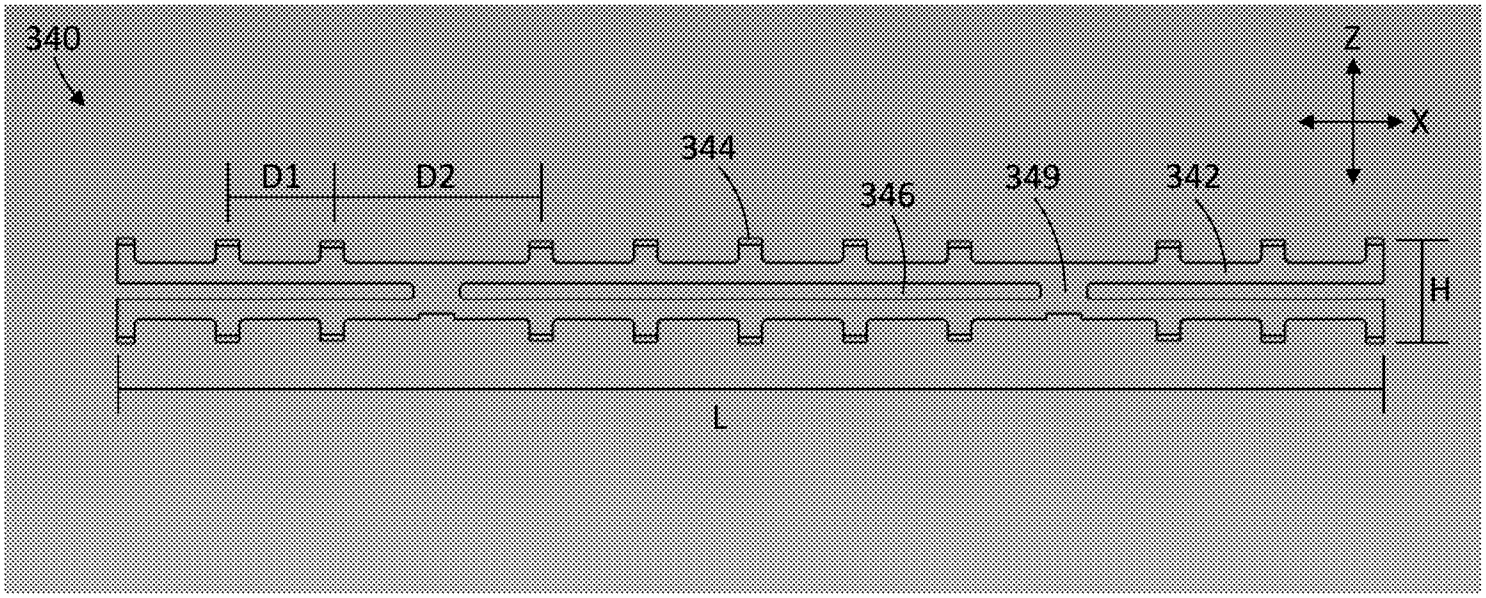
FIG. 7A is a front elevation view of an example of a lossy member, according to some embodiments.
Figure 7B:
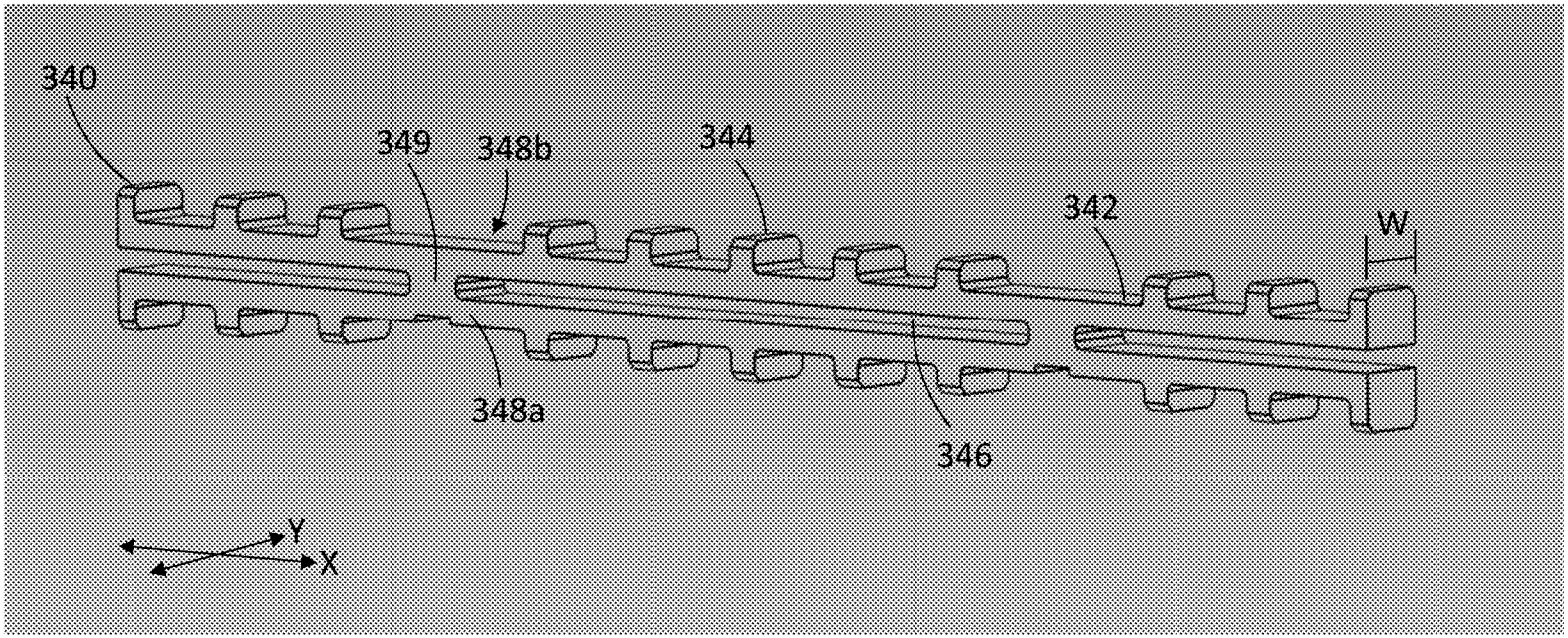
FIG. 7B is a perspective view of the lossy member of FIG. 7A, according to some embodiments.

FIGS. 7A and 7B show a front elevational view and a perspective view, respectively, of an example of the lossy member 340, in accordance with some embodiments described herein. The lossy member 340 may include a body portion 342, which extends in the longitudinal row direction X. One or more projections 344 may extend from the body portion 342 in the direction Z perpendicular to the longitudinal row direction X. The projections 344 may be positioned to contact ground terminals of the first and second terminals 330*a* and 330*b*, as described herein, when the lossy member 340 is incorporated into the terminal assembly 300.

In some embodiments, the projections 344 may be uniformly spaced at the same distance or non-uniformly spaced at various different distances along the body portion 342. For example, in the example of FIG. 7A, the projections 344 may be grouped such that the projections within the groups are a distance D1 apart from each other, and end projections of adjacent groups are a distance D2 apart, where D2 is greater than D1. It may be appreciated that the example of FIG. 7A is non-limiting, and any number of projections may be disposed within a group, not only the 3 or 5 projections 344 shown in the example of FIG. 7A. It may also be appreciated that while the examples of FIGS. 7A and 7B show a symmetric arrangement of projections on the top and bottom sides of the body portion 342, the projections 344 on the top and bottom sides of the body portion 342 need not be mirror images of each other.

In some embodiments, one or more through-holes 346 may pass through the body portion 342 from a first side 348*a* to a second side 348*b* opposite first side 348*a* along the direction Y perpendicular to the longitudinal row direction X. The through-holes 346 may be of a same length or may be of different lengths. In the embodiment shown in FIGS. 7A and 7B, the through-holes 346 may be elongated slots through the body portion 342. The presence of the one or more through-holes 346 may make the lossy member 340 more flexible and/or compressible, improving electrical contact between the projections 344 and the ground terminals of the first and second terminals 330*a* and 330*b*. In some embodiments, the through-holes 346 may comprise a total length that sums up to greater than or equal to 80% of a length L of the body portion 342 (i.e., the through-holes may extend over a combined length of greater than or equal to 80% of L). In some embodiments, the through-holes 346 may comprise a total length that sums up to greater than or equal to 90% of the length L of the body portion 342.

In some embodiments, the one or more through-holes 346 may extend along the row direction such that one or both ends of the body portion 342 are split, as depicted in FIGS. 7A and 7B. Such a configuration may provide further flexibility and/or compressibility to the lossy member 340. However, it may be appreciated that the through-hole(s) 346 may not extend such that one or both ends of the body portion 342 are split.

In accordance with some embodiments described herein, the through-hole(s) 346 may be separated by one or more bridges 349 extending between the top and bottom sides of the body portion 342. It may be appreciated that any number of bridge(s) 349 and through-hole(s) 346 may be used in combination, not only the two bridges 349 and three through-holes 346 of the example of FIGS. 7A and 7B.

In some embodiments, a height H of lossy member 340 may be greater than a distance A between the terminals 336*a* and the terminals 336*b* (as shown in FIG. 6A). For example, the height H of lossy member 340 (as shown in FIGS. 7A-7B) may be within a range of 0.8 mm and 2.5 mm, or may be in a range between 1.0 mm and 2.3 mm, or may be in a range between 1.6 mm and 2.0 mm. The distance A between the terminals 336*a* and the terminals 336*b* may be, for example, between 5% and 50% larger than the height H of the lossy member 340. The maximum dimension of the recess 321*a* may be, for example, between 10% and 30% larger than the height H of lossy member 340.

In some embodiments, a width W of the lossy member 340 may be less than the height H of lossy member 340. For example, the width W of lossy member 340 may be within a range of 0.5 mm and 1.5 mm, or may be within a range of 0.7 mm and 1.1 mm.

It should be understood that a lossy member according to the present technology described herein is not limited to the arrangements of FIGS. 7A-7B. A lossy member according to the present technology may be positioned differently and structured differently than what is shown, as long as the lossy member performs the functions discussed herein.

Figure 8A:
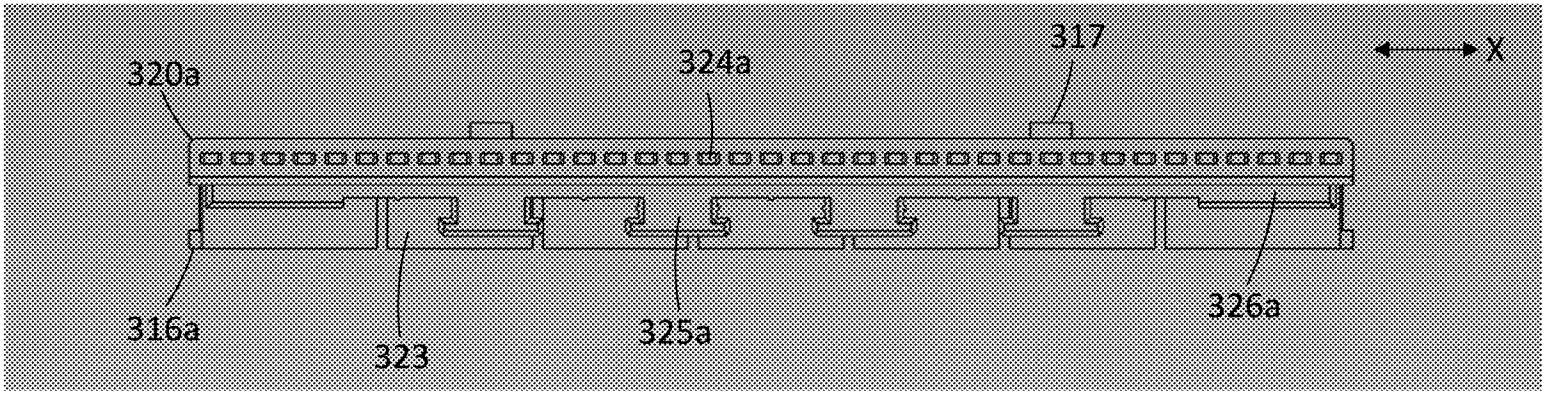
FIGS. 8A and 8B are front and rear elevation views of an insulative member of the terminal assembly of FIG. 2, according to some embodiments.
Figure 8B:
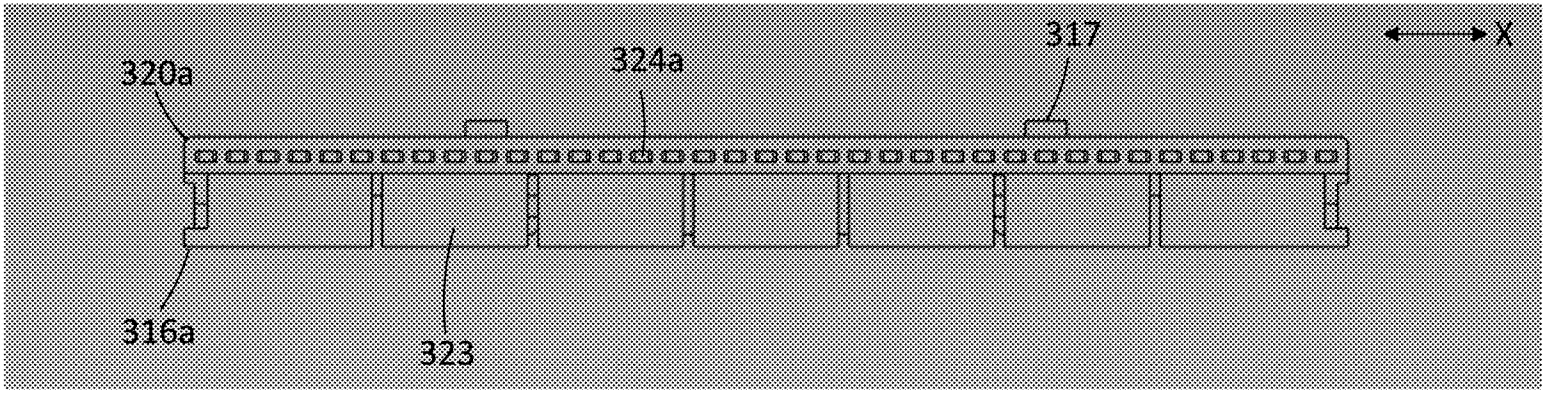
Figure 8C:
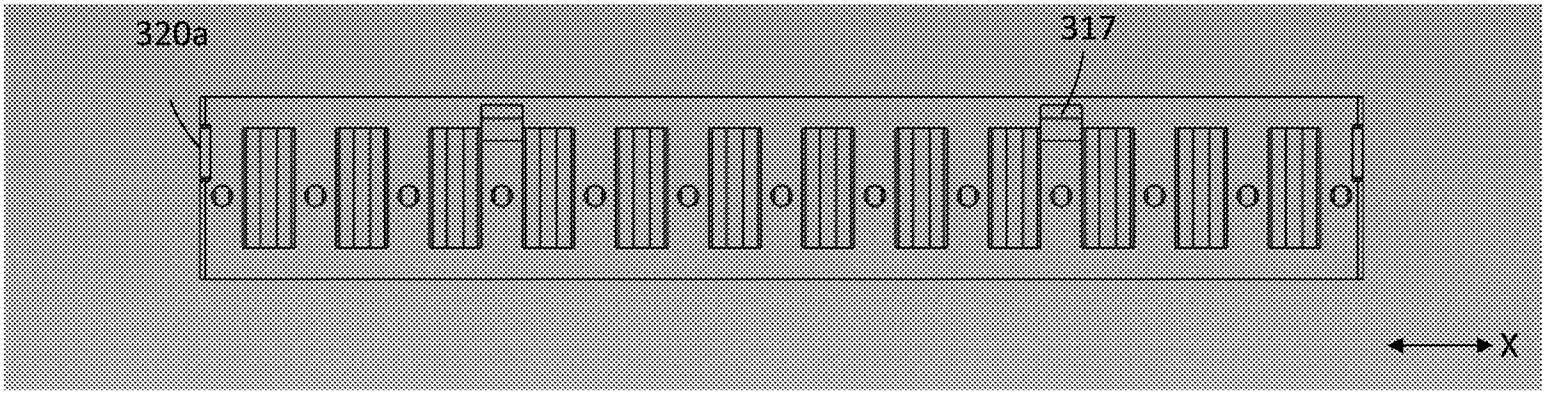
FIGS. 8C and 8D are top and bottom plan views of an insulative member of the terminal assembly of FIG. 2, according to some embodiments.
Figure 8D:
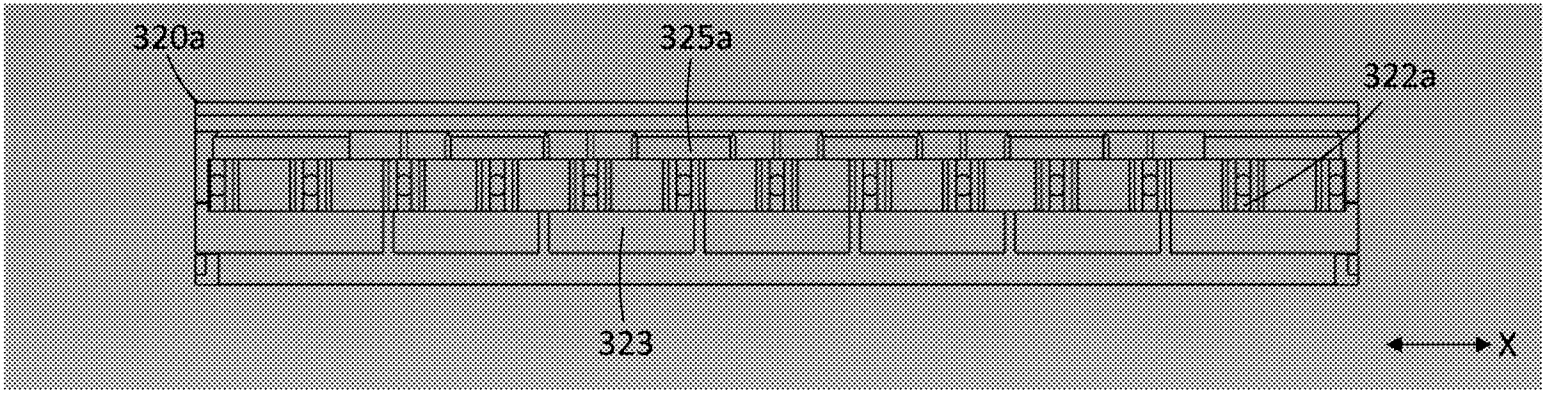
Figure 8F:
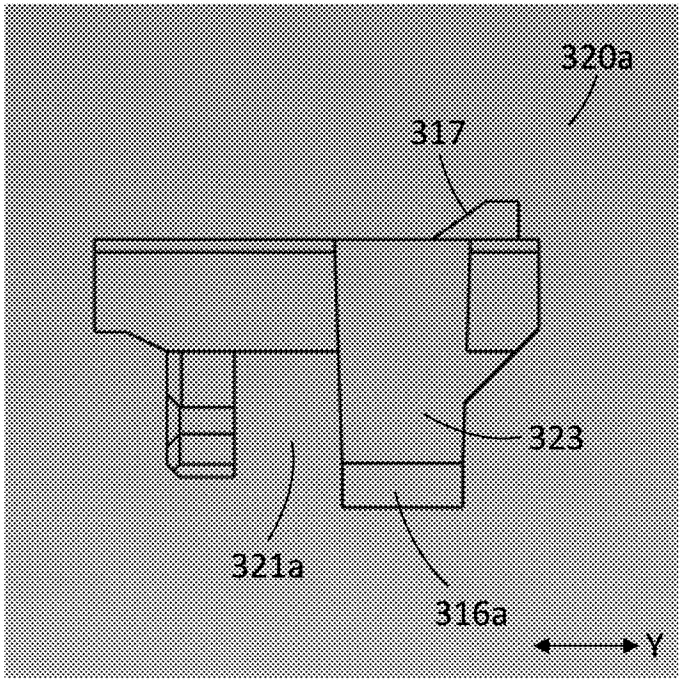
FIGS. 8E and 8F are side elevation views of an insulative member of the terminal assembly of FIG. 2, according to some embodiments.
Figure 8E:
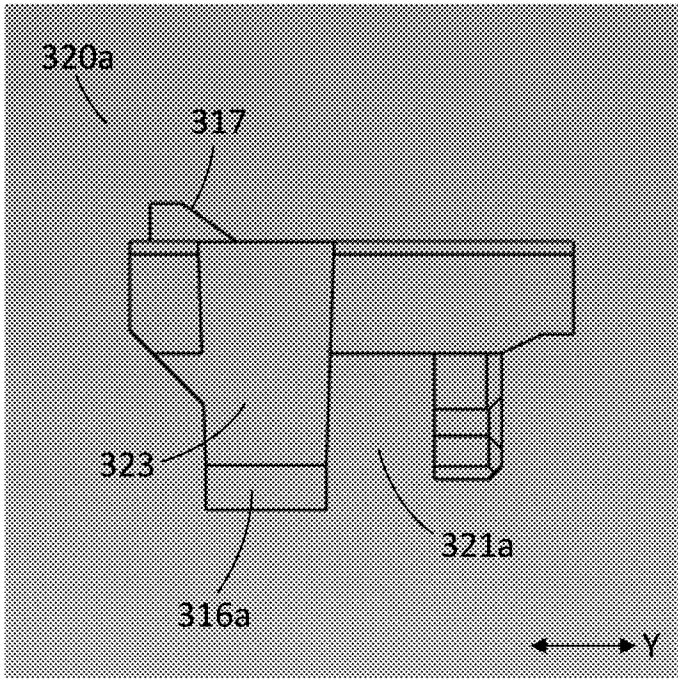
Figure 8G:
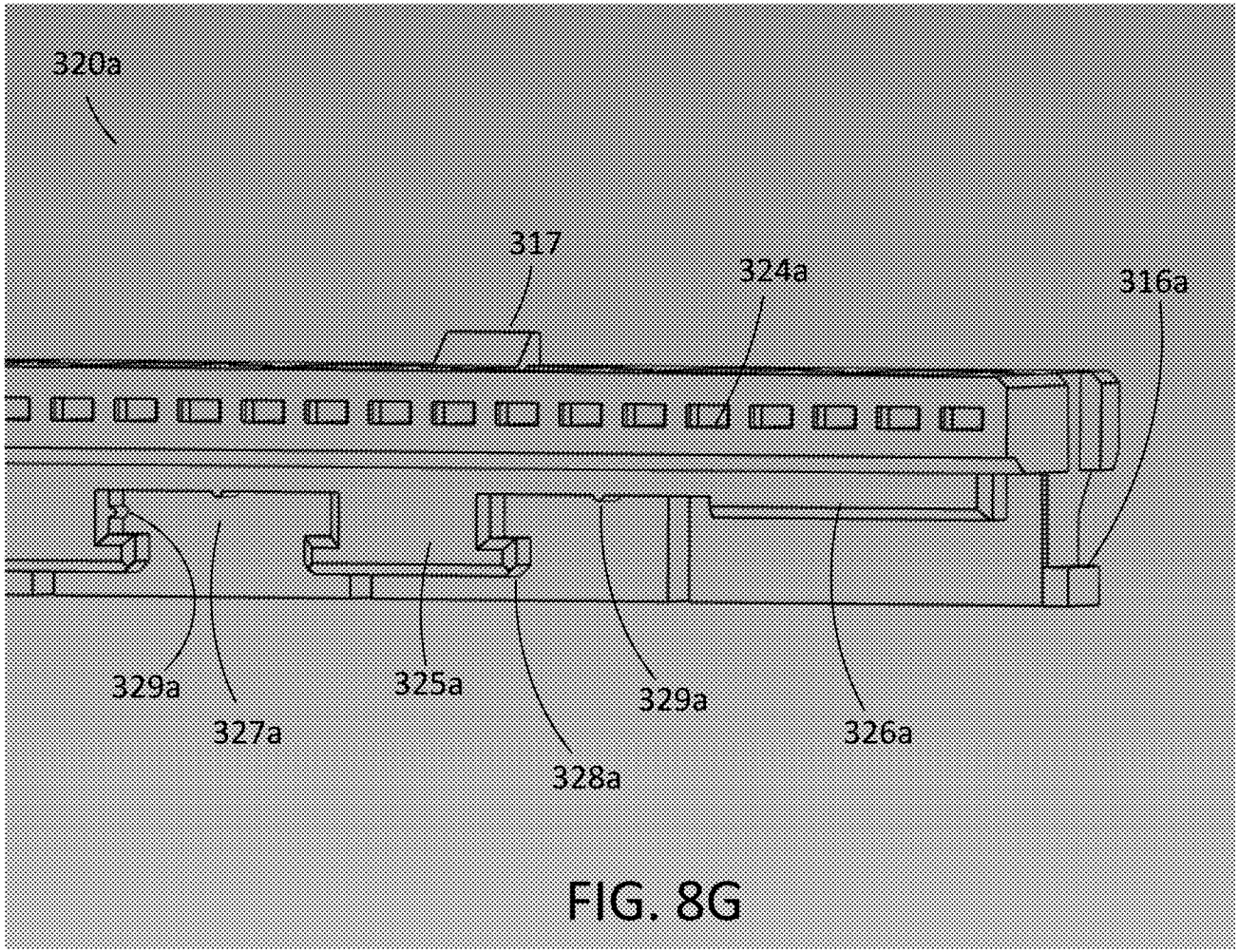
FIG. 8G is a close-up, front perspective view of an insulative member of the terminal assembly of FIG. 2, according to some embodiments.
Figure 8H:
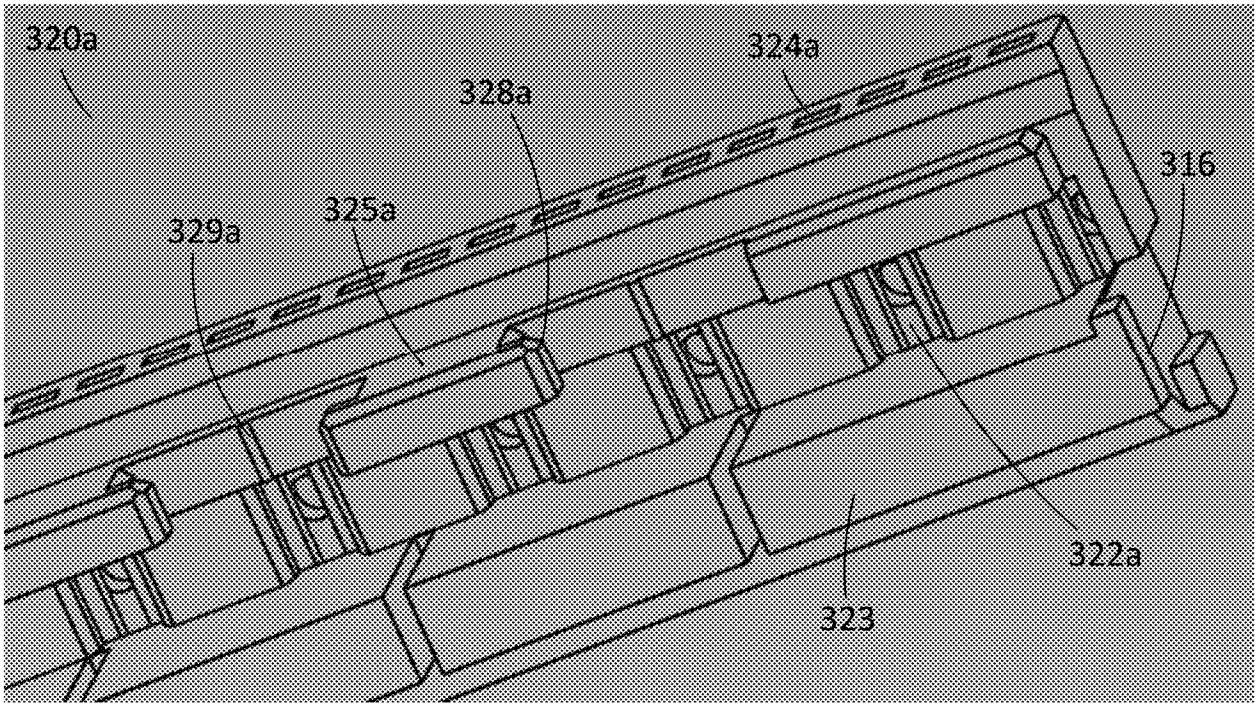
FIG. 8H is a close-up, bottom perspective view of an insulative member of the terminal assembly of FIG. 2, according to some embodiments.

As mentioned above and in accordance with some embodiments described herein, the terminal assembly 300 may include the first insulative member 320*a*. FIGS. 8A and 8B show front and rear elevational views, respectively of the first insulative member 320*a*. FIGS. 8C and 8D show top and bottom plan views, respectively, of first insulative member 320*a*. FIGS. 8E and 8F show side elevational views of the first insulative member 320*a*. FIG. 8G shows a front perspective close-up view of the first insulative member 320*a*, and FIG. 8H shows a bottom perspective close-up view of the first insulative member 320*a*.

The first insulative member 320*a* may comprise one or more engagement features to secure the terminal assembly 300 to the insulative housing 100, in accordance with some embodiments. For example, engagement features (e.g., protrusions) 316*a* formed on a backstop 323 of the first insulative member 320*a* may engage with the engagement features 116*a* of the insulative housing 100 (see e.g., FIG. 3A). Alternatively or additionally, engagement features 317 formed on a top surface of the first insulative member 320*a* may engage with the engagement features 108 of the insulative housing 100 (see e.g., FIG. 3A). It may be appreciated that engagement features 316*a* and 317 of the examples of FIGS. 8A-8H may be implemented in any suitable way to secure the terminal assembly 300 within the insulative housing 100.

In some embodiments, the first insulative member 320*a* may be formed around the first terminals 330*a* (instances of reference numeral 324*a* represent sections of the first terminals 330*a*). The projections 344 of the lossy member 340 may contact the ground terminals of the first terminals 330*a* through terminal channel openings 322*a*, as shown in the examples of FIGS. 8D and 8H. It may be appreciated that the number and arrangement of the terminal channel openings 322*a* may depend on the number and arrangement of the ground terminals of the first terminals 330*a*.

The first insulative member 320*a* may further include interlocking members 325*a* and interlocking end members 326*a* to interlockingly couple the first insulative member 320*a* with the second insulative member 320*b*, in accordance with some embodiments described herein. Adjacent interlocking members 325*a* may be separated by interlocking recesses 327*a*. It may be appreciated that the interlocking recesses 327*a* may be of a uniform longitudinal width in the row direction, as shown in the examples of FIGS. 8A-8H, or may be of differing longitudinal widths. Additionally, it may be appreciated that the interlocking members 325*a* may be of a uniform longitudinal width in the row direction, as shown in the examples of FIGS. 8A-8H, or may be of differing longitudinal widths.

In some embodiments, the interlocking members 325*a*, 325*b* and the interlocking recesses 327*a*, 327*b* may be interlockingly coupled by sliding the first and second insulative members 320*a* and 320*b* towards each other along the direction Y perpendicular to the row direction X. The interlocking members 325*a* of the first insulative member 320*a* may couple with corresponding interlocking recesses 327*b* of the second insulative member 320*b*. The interlocking recesses 327*a* of the first insulative member 320*a* may receive the interlocking members 325*b* of the second insulative member 320*b*. To prevent accidental decoupling along the direction Z perpendicular to both directions X and Y of the first and second insulative members 320*a* and 320*b*, arms

328*a* may be disposed on the interlocking members 325*a*, so that the first and second insulative members 320*a* and 320*b* form T-shaped members. The arms 328*a* may extend along the longitudinal row direction X and may engage with corresponding arms 328*b* of the interlocking members 325*b* of the second insulative member 320*b*. The arms 328*a* and corresponding arms 328*b* may prevent the first and second insulative members 320*a* and 320*b* from being pulled apart in the direction Z perpendicular to the direction Y.

In some embodiments, to ensure secure coupling, ribs 329*a* may be disposed such that one or more ribs project into the interlocking recesses 327*a*. The ribs 329*a* may be disposed on sidewalls of the interlocking members 325*a* and/or on upper surfaces of the interlocking recesses 327*a*. The ribs 329*a* may press against corresponding ones of the interlocking members 325*b* of the second insulative member 320*b* so that the first and second insulative members 320*a* and 320*b* do not easily slide apart once coupled. In some embodiments, the interlocking members 325*b* may be smaller than the corresponding recesses 327*a*. In such embodiments, the ribs 329*a* may hold the interlocking members 325*b* securely in the recesses 327*a*. Additionally or alternatively, the ribs 329*a* may deform or cut into the interlocking members 325*b* to further secure the interlocking members 325*b* in the recesses 327*a*. This function may assist in securing the first and second insulative members 320*a* and 320*b* together in the case that one or more components do not meet manufacturing tolerances.

In some embodiments, the backstop 323 may be provided to prevent the first and second insulative members 320*a* and 320*b* from being slid too far along the direction Y perpendicular to the row direction X when being coupled. By ensuring that the first and second insulative members 320*a* and 320*b* are positioned properly, the backstop 323 may further ensure that the lossy member 340 may fit in the recess 321*a* defined by the backstop 323, the interlocking members 325*a*, and end interlocking members 326*a* of the first insulative member 320*a*.

Figure 9A:
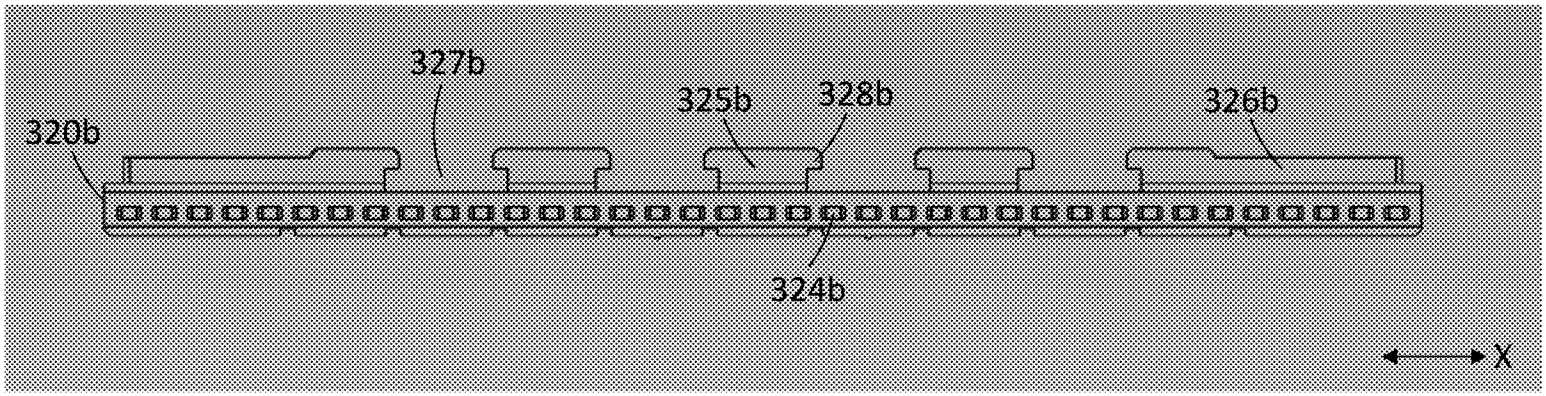
FIGS. 9A and 9B are front and rear elevation views of another insulative member of the terminal assembly of FIG. 2, according to some embodiments.
Figure 9B:
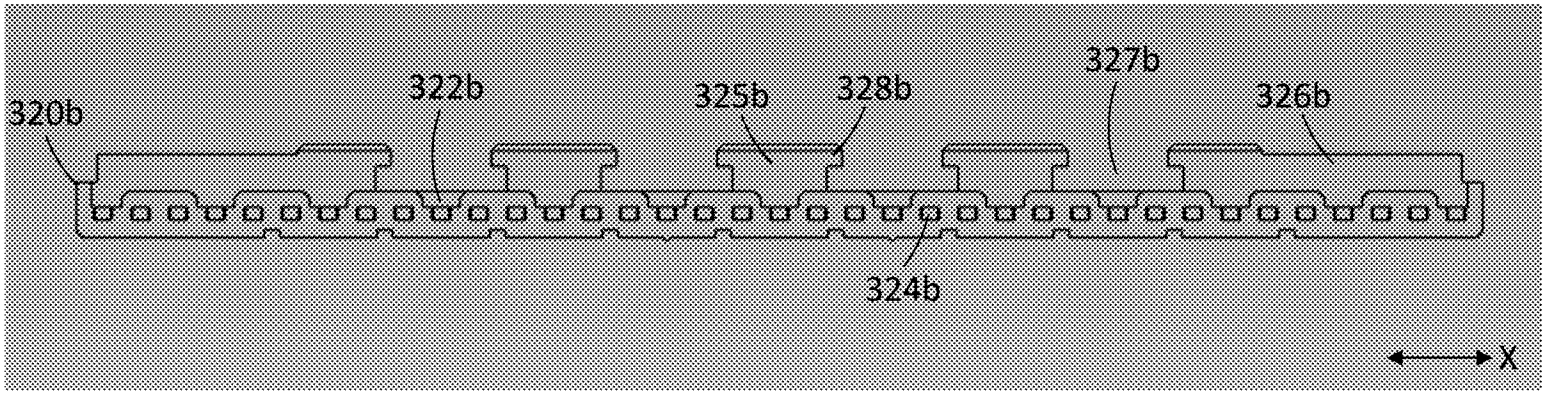
Figure 9C:
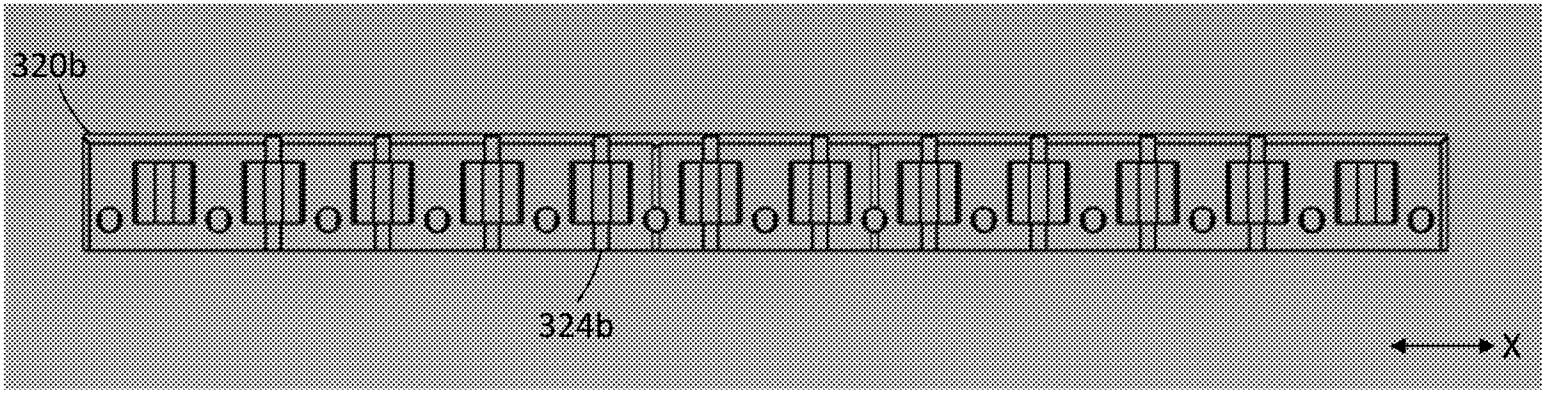
FIGS. 9C and 9D are top and bottom plan views of another insulative member of the terminal assembly of FIG. 2, according to some embodiments.
Figure 9D:
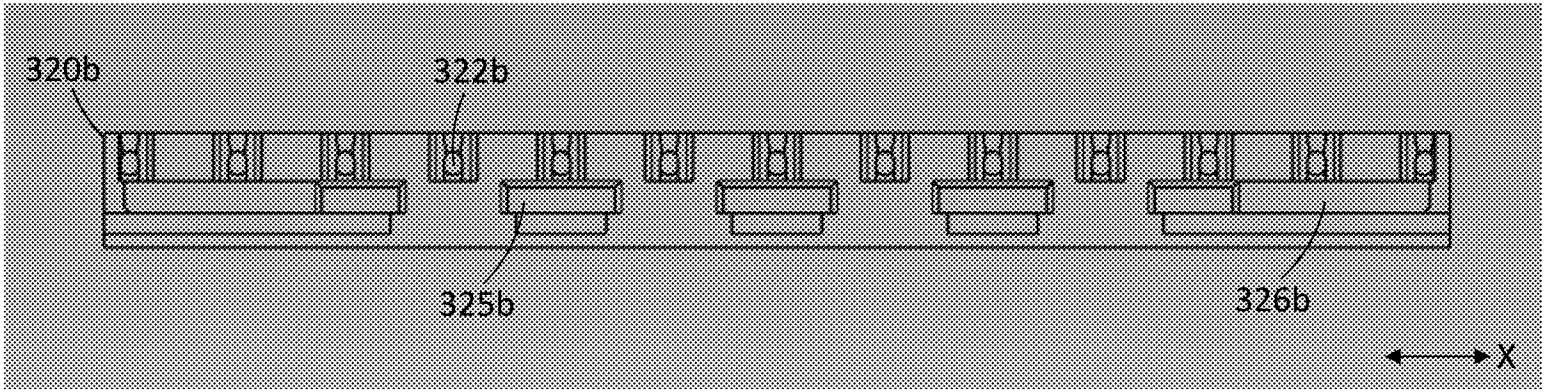
Figure 9F:
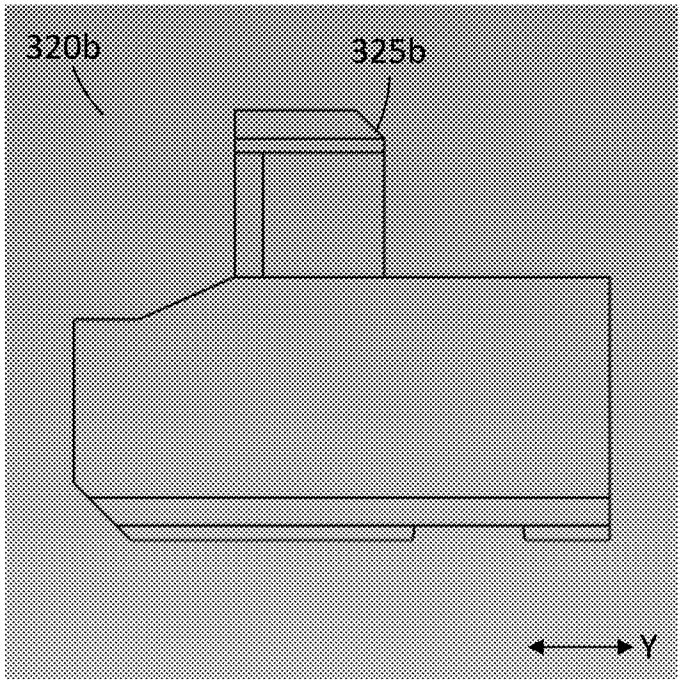
FIGS. 9E and 9F are side elevation views of another insulative member of the terminal assembly of FIG. 2, according to some embodiments.
Figure 9E:
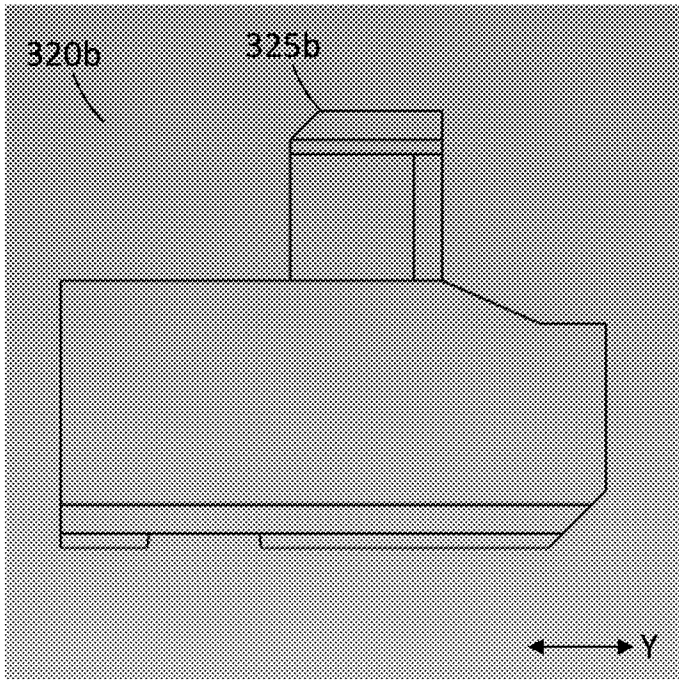
Figure 9G:
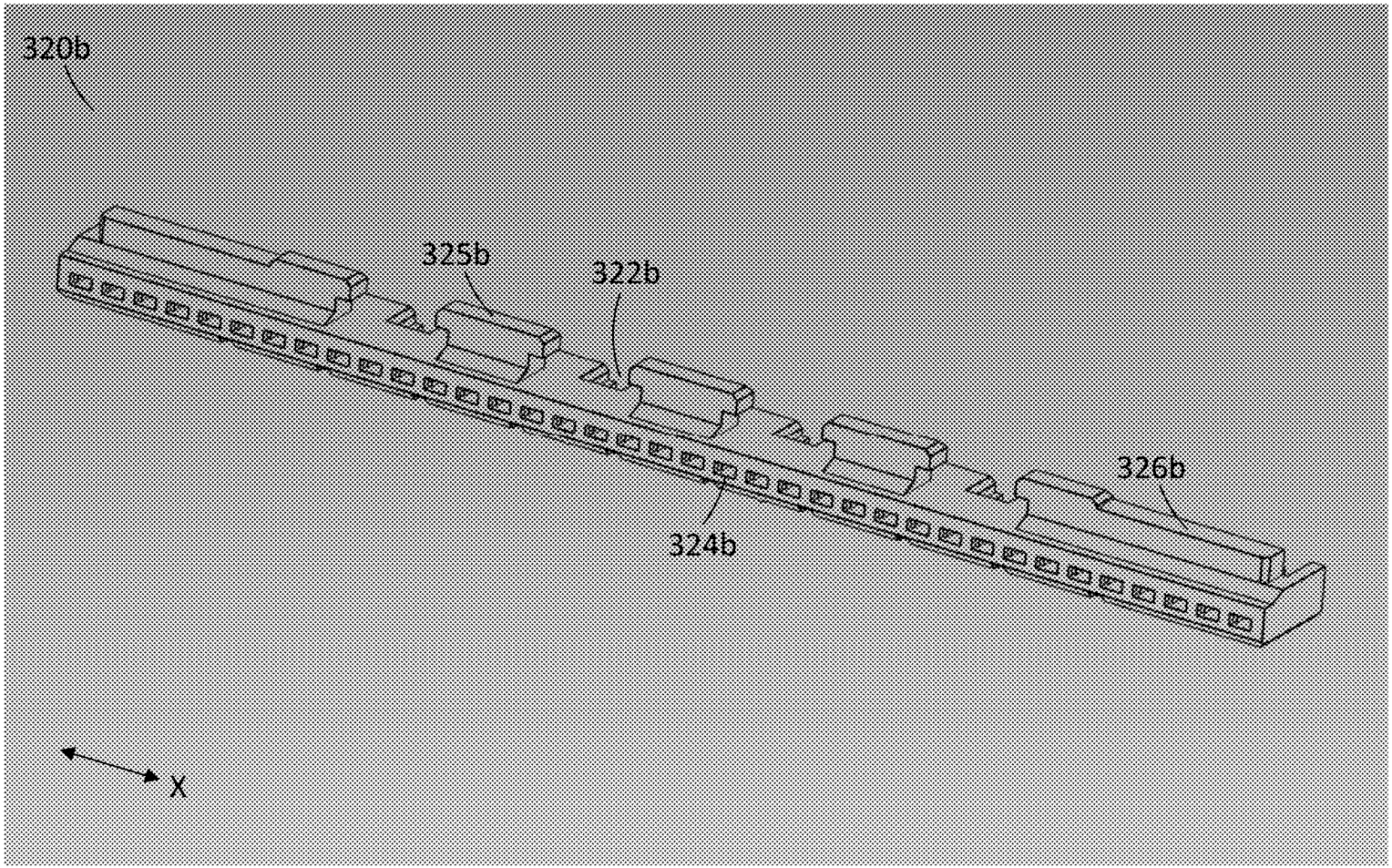
FIG. 9G is a front perspective view of another insulative member of the terminal assembly of FIG. 2, according to some embodiments.
Figure 9H:
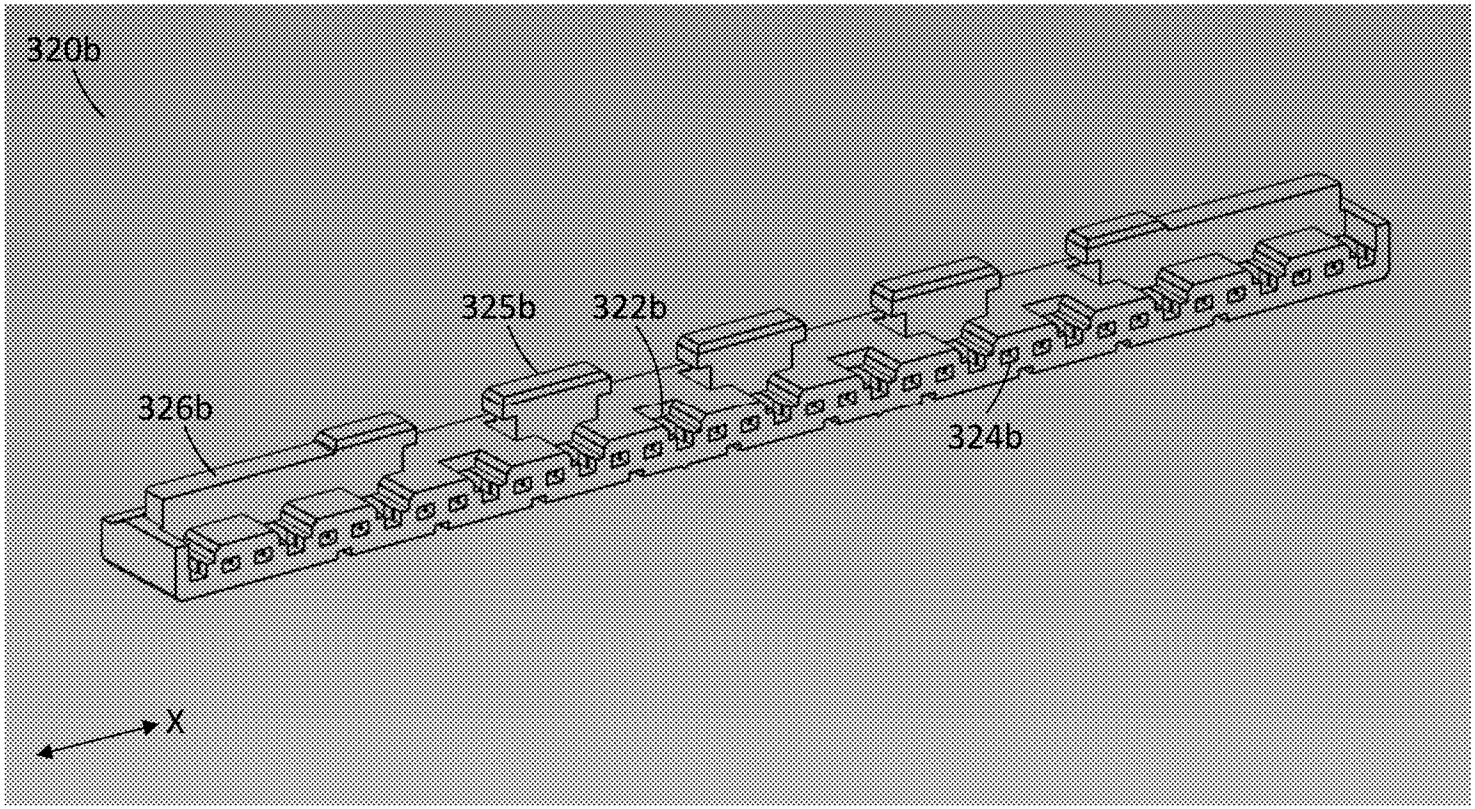
FIG. 9H is a rear perspective view of another insulative member of the terminal assembly of FIG. 2, according to some embodiments.

In accordance with some embodiments described herein, the terminal assembly 300 may include the second insulative member 320*b* as depicted in FIGS. 9A and 9B, which show front and rear elevational views, respectively of the second insulative member 320*b*. FIGS. 9C and 9D show top and bottom plan views, respectively, of the second insulative member 320*b*. FIGS. 9E and 9F show side elevational views of the second insulative member 320*b*. FIG. 9G shows a front perspective view of the second insulative member 320*b*, and FIG. 9H shows a bottom perspective close-up view of the second insulative member 320*b*.

In some embodiments, the second insulative member 320*b* may be formed around the second terminals 330*b* (instances of reference numeral 324*b* represent sections of the second terminals 330*b*). The projections 344 of the lossy member 340 may contact the ground terminals of the second terminals 330*b* through openings 322*b*, as shown in the examples of FIGS. 9D and 9H. It may be appreciated that the number and arrangement of the openings 322*b* may depend on the number and arrangement of the ground terminals of the second terminals 330*b*.

The second insulative member 320*b* may include one or more of the interlocking members 325*b* configured to couple with the interlocking recesses 327*a* of the first insulative member 320*a*, in accordance with some embodiments described herein. The interlocking members 325*b* may be separated by the interlocking recesses 327*b*, and the interlocking recesses 327*b* may be configured to accept corresponding interlocking members 325*a* of the first insulative member 320*a* when the first and second insulative members 320*a* and 320*b* are interlockingly coupled or interlocked. As will be appreciated, when the first and second insulative members 320*a* and 320*b* are interlocked, they may not be pulled apart without significant and possibly damaging force, i.e., decoupling of the members 320*a* and 320*b* may be difficult once interlocked.

In some embodiments, the end interlocking members 326*b* may be configured to couple with corresponding ones of the interlocking member 325*a* of the first insulative member 320*a* such that only one longitudinal side of the end interlocking members 326*b* engages with the corresponding interlocking member 325*a*. It may be appreciated that any suitable number of the interlocking members 325*b* and the interlocking recesses 327*b* may be disposed between the end interlocking members 326*b*; the three interlocking members 325*b* and the four interlocking recesses 327*b* of FIGS. 9A-9H are merely examples.

In some embodiments, the interlocking members 325*b* may include one or more arms 328*b* extending in the longitudinal row direction X. The arms 325*b* may be configured to prevent decoupling of first and second insulative members 320*a* and 320*b* in the direction Z perpendicular to the longitudinal row direction X by engaging with corresponding ones of the arms 328*a* of the interlocking members 325*a*. It may be appreciated that the arms 325*b* may be of any suitable length and/or configuration, not only as depicted in the examples of FIGS. 9A-9H, as long as they are configured to engage correspondingly with the arms 328*a* of the first insulative member 320*a*.

In some embodiments, such as the examples of FIGS. 9A-9H, there may be no ribs (e.g., the ribs 329*b*) projecting into the interlocking recesses 327*b*. It may be appreciated that in some embodiments, there may be one or more corresponding rib(s) 329*b* projecting into the interlocking recesses 327*b*. It may also be appreciated that in some embodiments there may be one or more rib(s) 329*b* projecting into the interlocking recesses 327*b*, but no rib(s) 329*a* projecting into the interlocking recesses 327*a* of the first insulative member.

Figure 10A:
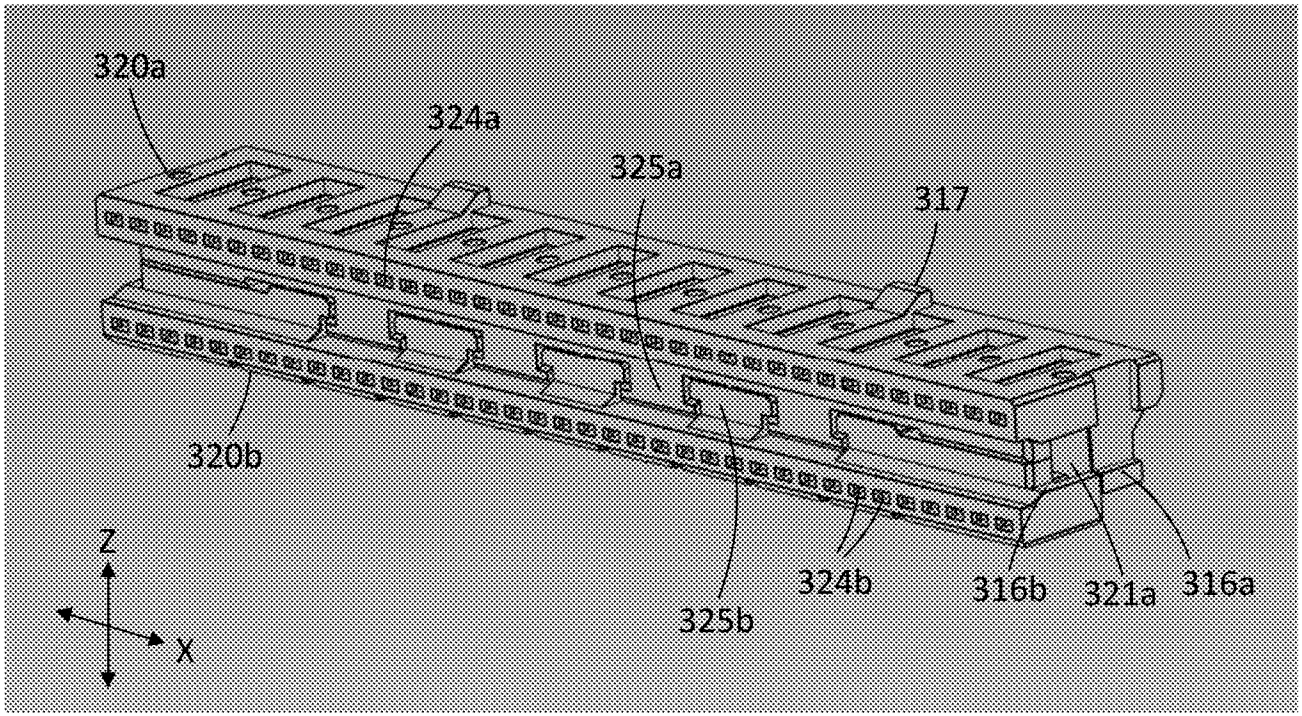
FIG. 10A is a front perspective view of the insulative members of FIGS. 8A-9H, coupled, according to some embodiments.
Figure 10B:
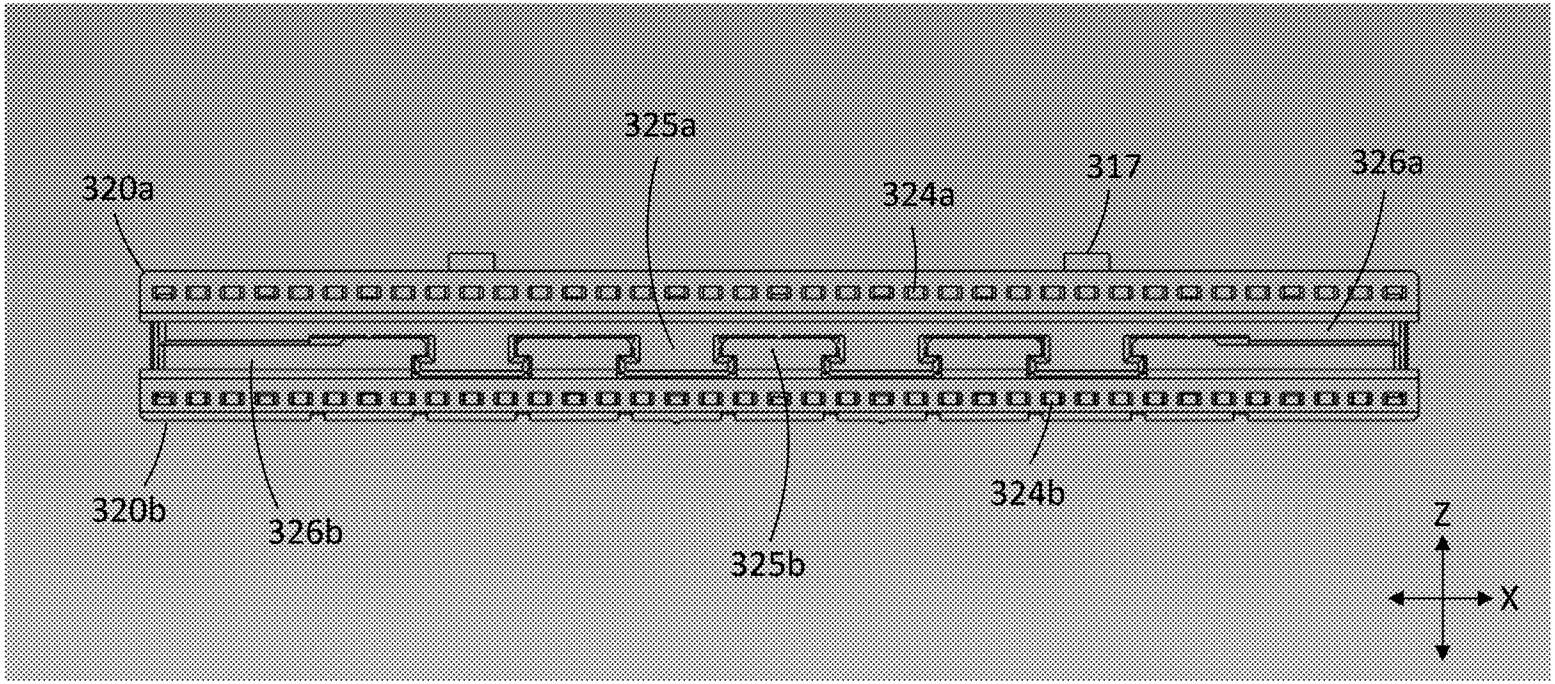
FIGS. 10B and 10C are front and rear elevation views of the insulative members of FIGS. 8A-9H, coupled, according to some embodiments.
Figure 10C:
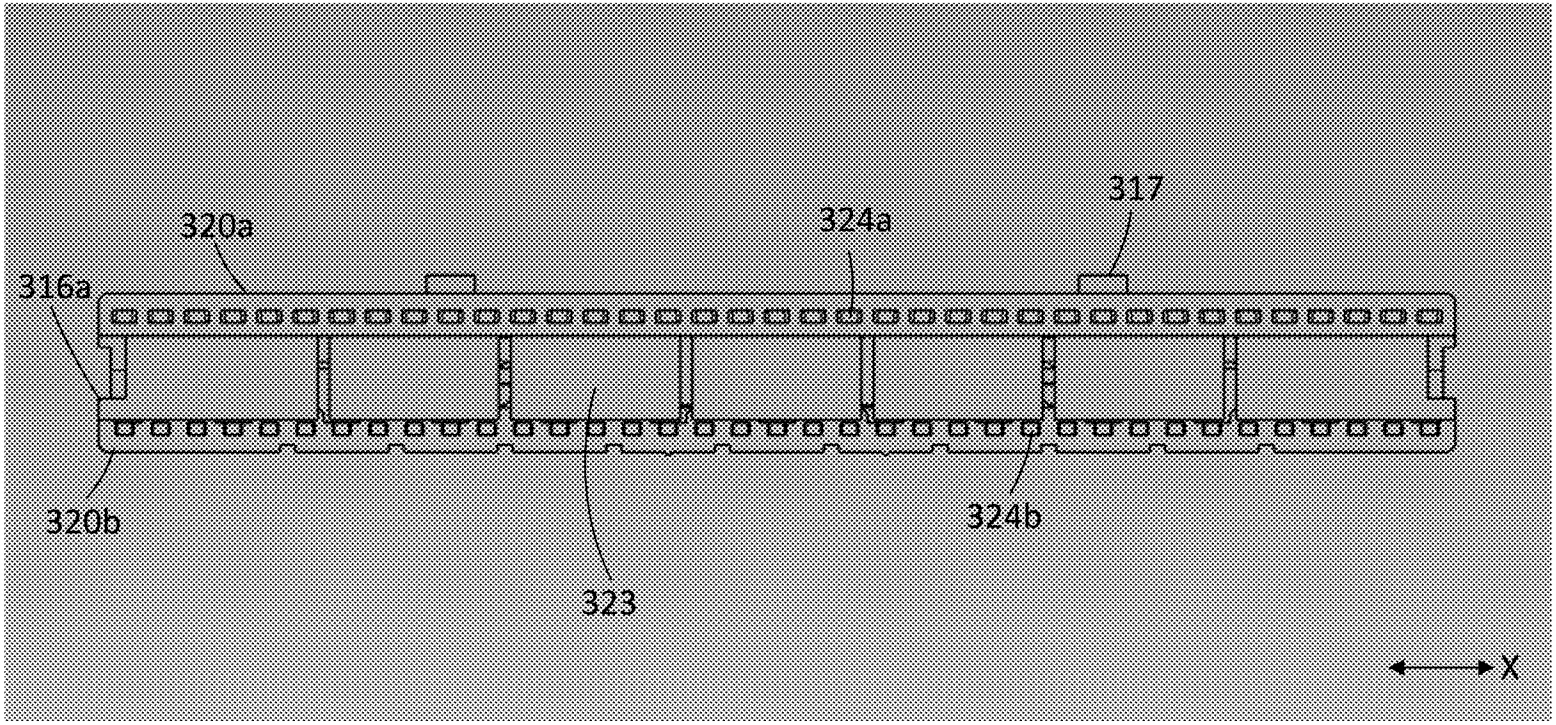
Figure 10E:
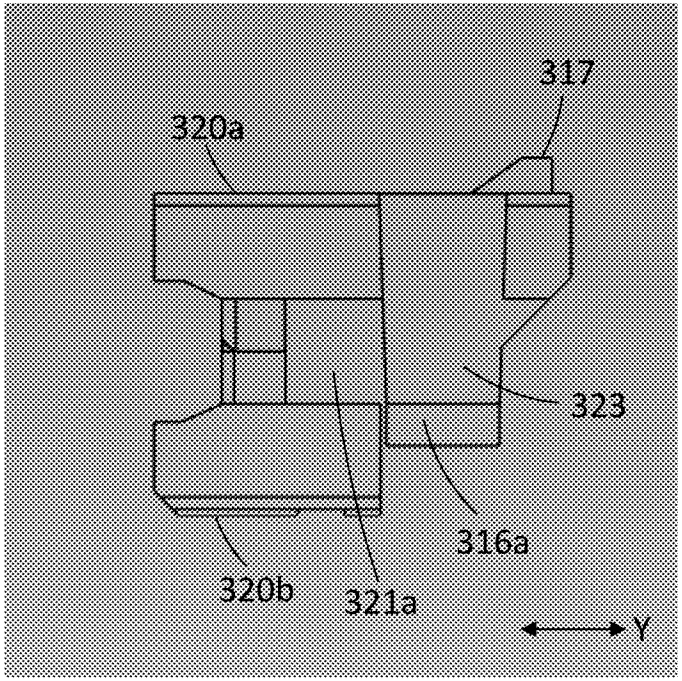
FIGS. 10D and 10E are side elevation views of the insulative members of FIGS. 8A-9H, coupled, according to some embodiments.
Figure 10D:
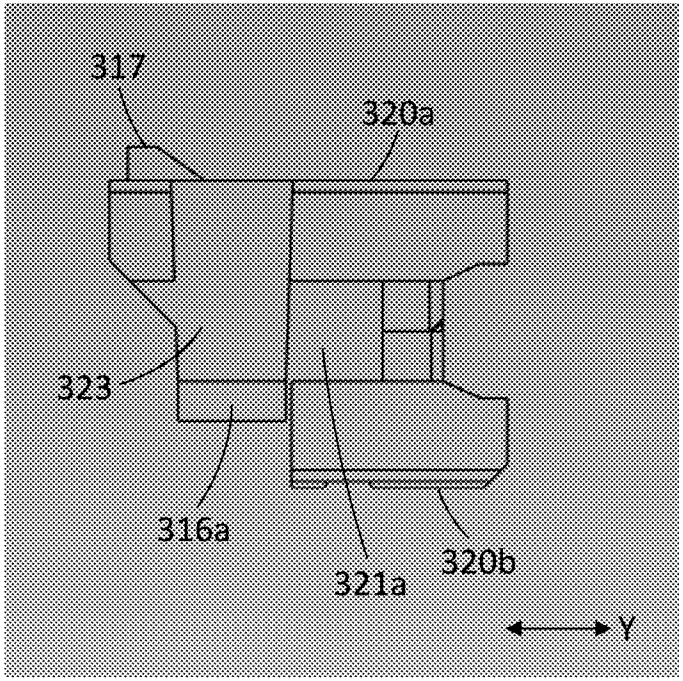

In accordance with some embodiments described herein, the first and second insulative members 320*a* and 320*b* may couple to each other when assembling the terminal assembly 300. FIG. 10A shows a front perspective view of the first and second insulative members 320*a* and 320*b* coupled together without first and second terminals 330*a* and 330*b* being shown, for the sake of clarity. FIGS. 10B and 10C show front and rear elevational views, respectively, of the first and second insulative members 320*a* and 320*b* coupled together without the first and second terminals 330*a* and 330*b* shown, for the sake of clarity. FIGS. 10D and 10E show side elevational views of the first and second insulative members 320*a* and 320*b* coupled together without the first and second terminals 330*a* and 330*b* being shown, for the sake of clarity.

As shown in FIGS. 10A and 10B, the interlocking members 325*a* and 325*b* may alternate along the longitudinal row direction X when the first and second insulative members 320*a* and 320*b* are coupled. The arms 328*a* and 328*b* of the interlocking members 325*a* and 325*b* may hookedly engage with each other, similar to engagement of puzzle pieces, when the first and second insulative members 320*a* and 320*b* are slidingly coupled along the direction Y perpendicular to the longitudinal direction X. The arms 328*a* and 328*b* may further hookedly engage like puzzle pieces so that the first and second insulative members 320*a* and 320*b* may not be easily decoupled in the direction Z perpendicular to the longitudinal row direction X.

As described in connection with FIGS. 8A-8H, the first insulative member 320*a* may be provided with the backstop 323, in accordance with some embodiments described herein. The backstop 323 may be structured to ensure proper coupling of the interlocking members 325*a* and 325*b* along the direction Y perpendicular to the row direction X. When the first and second insulative members 320*a* and 320*b* are slidingly engaged along the direction Y, the backstop 323 may engage with a rear surface of second insulative member 320*b* when interlocking members 325*a* and 325*b* are properly aligned and hookedly engaged. In these embodiments, the first and second insulative members 320*a* and 320*b* may be decoupled only in one (reverse) direction, i.e., by reverse sliding relative to each other in the direction Y.

As shown in FIGS. 10D and 10E, when the first and second insulative members 320*a* and 320*b* are coupled, the recess 321*a* may be formed between them. In the examples of FIGS. 10D and 10E, the recess 321*a* may be formed between the interlocking members 325*a*, 325*b* and the backstop 323 of the first insulative member 320*a*. The recess 321*a* may extend along the longitudinal row direction X.

In some embodiments, the lossy member 340 may be disposed in the recess 321*a* prior to coupling of the first and second insulative members 320*a* and 320*b*. The lossy member 340 may have a width and/or a height that are greater than a width and/or a height of the recess 321*a* such that the lossy member 340 may be compressed in one or more directions when the first and second insulative members 320*a* and 320*b* are coupled. For example, the lossy member 340 may have a height between 0.8 mm and 2.5 mm when not compressed by the first and second insulative members 320*a* and 320*b*, but the lossy member 340 may have a height between 0.4 mm and 1.3 mm when compressed between the first and second insulative members 320*a* and 320*b*. Substantially compressing the lossy member 340 within the recess 321*a* may improve electrical contact between the lossy member 340 and one or more ground terminals of the first and second terminals 330*a* and 330*b*.

Figure 11A:
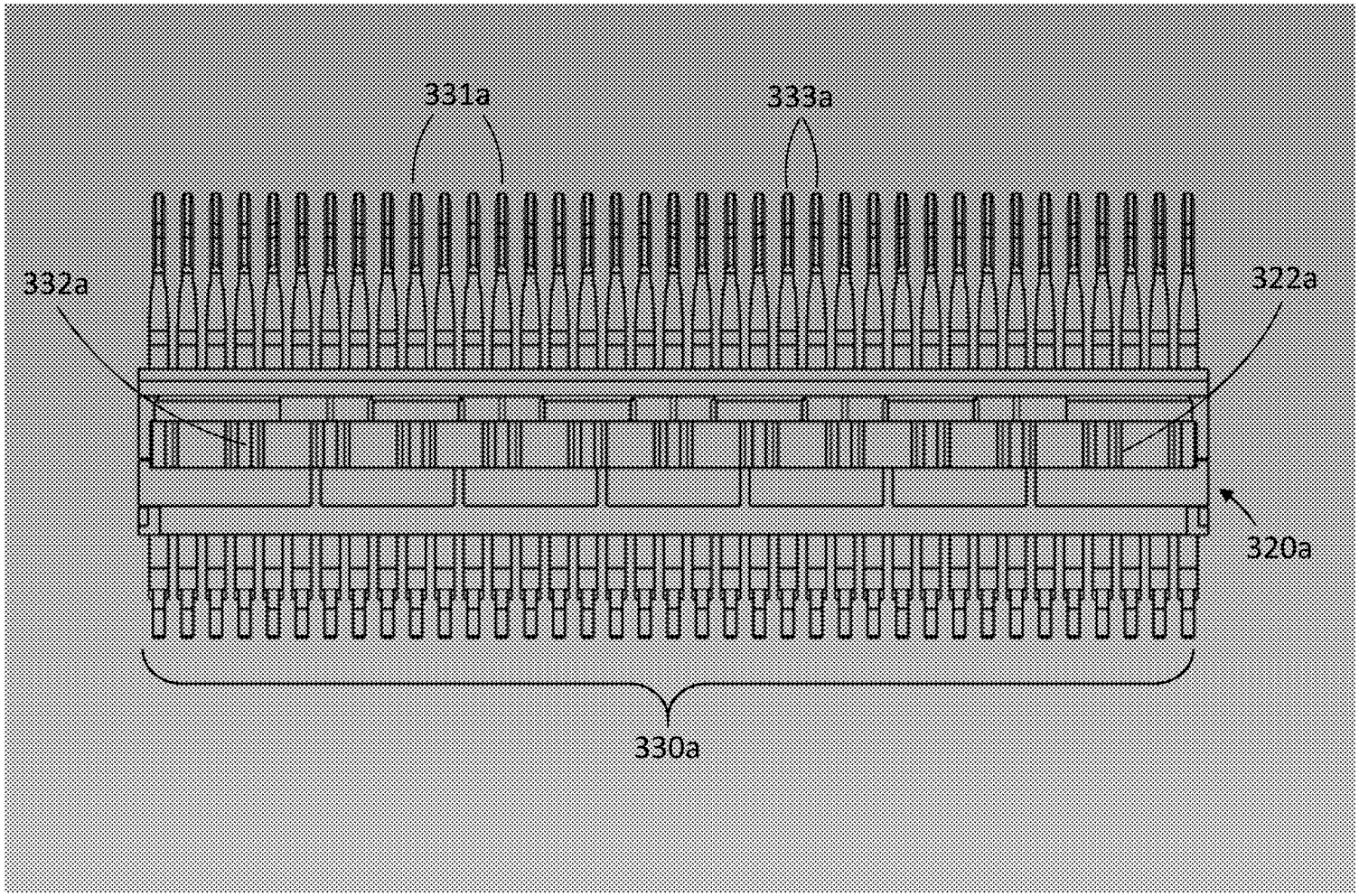
FIG. 11A is a bottom plan view of an insulative member assembled with terminals, according to some embodiments
Figure 11B:
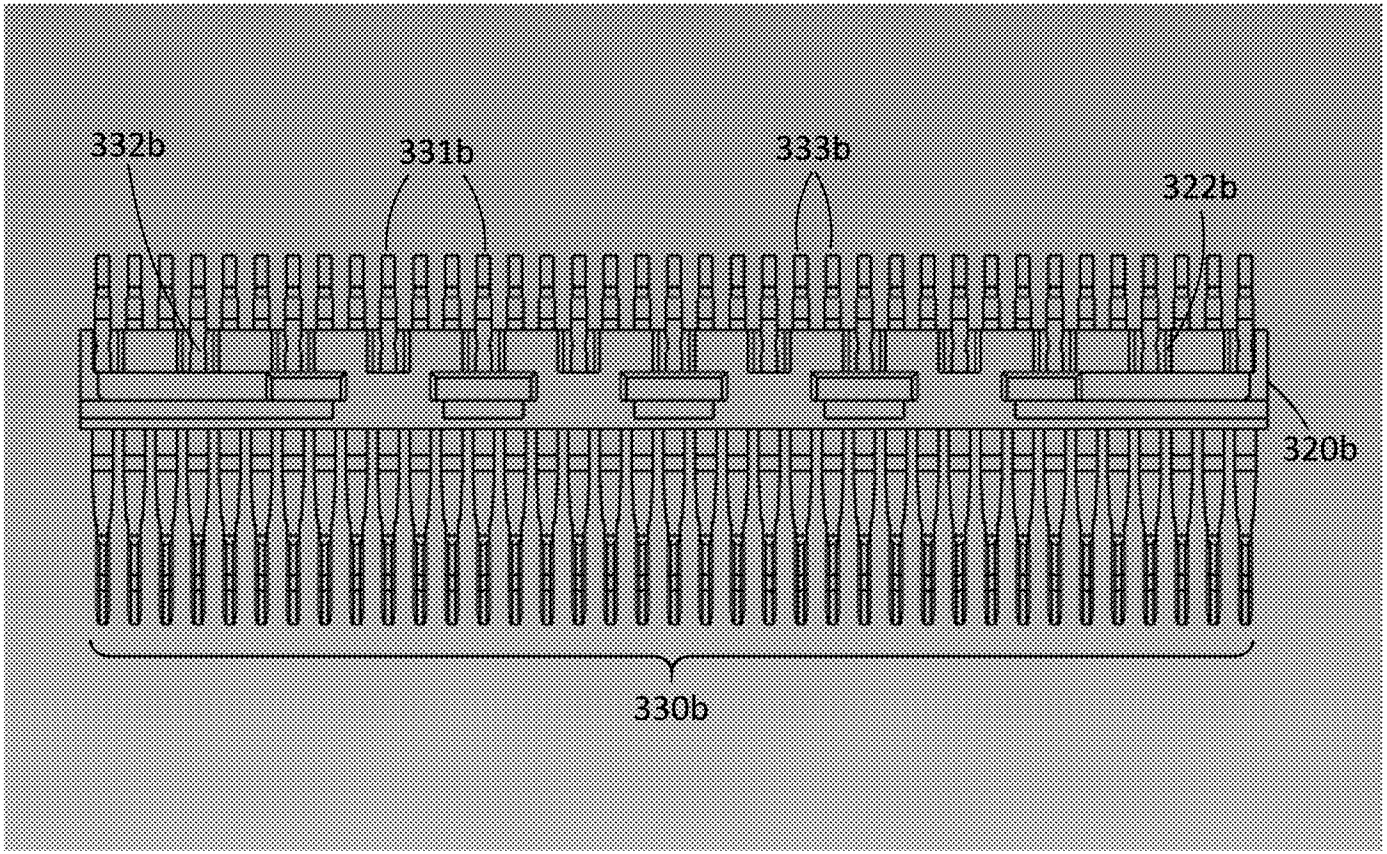
FIG. 11B is a top plan view of an insulative member assembled with terminals, according to some embodiments.

In accordance with some embodiments described herein, the first and second insulative members 320*a* and 320*b* may be formed around a plurality of first and second terminals 330*a* and 330*b*, respectively, as shown in bottom and top plan views of FIGS. 11A and 11B. The first and second insulative members 320*a* and 320*b* may include the terminal channel openings 322*a*, 322*b*, which expose the contact surfaces 332*a*, 332*b* of some or all of the first and/or the second terminals 330*a* and 330*b*. The projections 344 of the lossy member 340 may make electrical contact with the contact surfaces 332*a*, 332*b* of the first and second terminals 330*a* and 330*b*.

In the example of FIG. 11A, the terminal channel openings 322*a*, 322*b* may be provided for ground terminals 331*a*, 331*b* of the first and second terminals 330*a*, 330*b*, in some embodiments. The ground terminals 331*a*, 331*b* may be separated by one or more signal terminals 333*a*, 333*b*. It may be appreciated that any suitable number of the signal terminals 333*a*, 333*b* may separate the ground terminals 331*a*, 331*b*, not only the two signal terminals 333*a*, 333*b* of the examples of FIGS. 11A and 11B. The signal terminals 333*a*, 333*b* may be fully enclosed in the first and second insulative members 320*a* and 320*b* such that the signal terminals 333*a*, 333*b* do not have their contact surfaces 332*a*, 332*b* exposed through the terminal channel openings 322*a*, 322*b* and/or are not in electrical contact with projections 344 of lossy member 340.

Figure 11C:
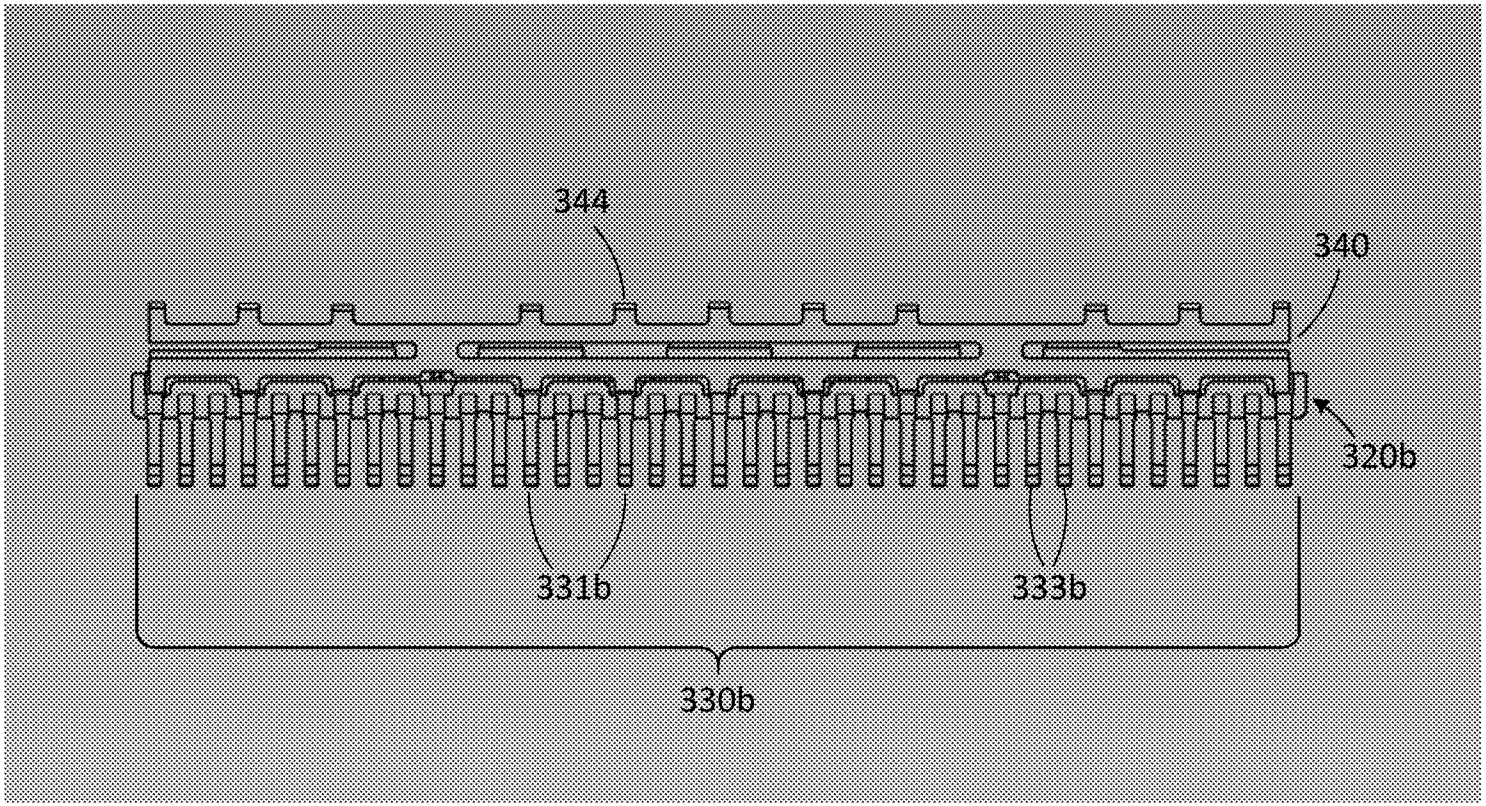
FIG. 11C is a front elevation view of terminals, an insulative member, and a lossy member, according to some embodiments.

FIG. 11C shows, in accordance with some embodiments described herein, a partially disassembled portion of the terminal assembly 330*b* with the projections 344 of lossy member 340 in contact with the ground terminals 331*b* of the second terminals 330*b*. The first insulative member 320*a* and the first terminals 330*a* are not shown in the example of FIG. 11C for the sake of clarity. The projections 344 extend into the terminal channel openings 322*b* such that the projections 344 may make electrical contact with the contact surfaces 332*b* of the ground terminals 331*b*. The signal terminals 333*b* may be, alternatively, fully enclosed within the second insulative member 320*b*. As may be appreciated from FIG. 11C, when the first and second insulative members 320*a* and 320*b* (not shown) are coupled together, the projections 344 may be urged against the ground terminals 331*a* (not shown) and 331*b*, ensuring good electrical contact with the ground terminals 331*a*, 331*b*. This is especially advantageous for high frequency applications (e.g., 25 GHz, 30 GHz, 35 GHz, 40 GHz, 45 GHz, etc.) where it is desired to reduce resonances within the connector to enable reliable operation at higher frequencies and consequently increase the operating range of the connector.

It should be understood that various alterations, modifications, and improvements may be made to the structures, configurations, and methods discussed above, and are intended to be within the spirit and scope of the invention disclosed herein.

For example, a thin lossy member, making reliable connections to ground terminals in a compact electrical connector was illustrated used in a right angle, board mount connector. Structures as described herein may be used in connectors of other styles. For example, a lossy member may be incorporated into a vertical board mount connector using some or all of the techniques described herein.

Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Further, terms denoting direction have been used, such as "left", "right", "top" or "bottom." These terms are relative to the illustrated embodiments, as depicted in the drawings, for ease of understanding. It should be understood that the components as described herein may be used in any suitable orientation.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

Definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ±20% of a target value in some embodiments, within ±10% of a target value in some embodiments, within ±5% of a target value in some embodiments, and within ±2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

What is claimed is:

1. An electrical connector, comprising:

a first insulative member;

a plurality of terminals supported by the first insulative member and disposed in a row along a row direction, wherein each terminal of the plurality of terminals comprises a first end, a mounting end, and an intermediate portion joining the first end to the mounting end; and a compressible lossy member disposed in a recess of the first insulative member, the compressible lossy member comprising a body portion elongated in the row direction and projections different than the body portion extending from the body portion, wherein:

the projections of the compressible lossy member project toward and make contact with surfaces of first terminals of the plurality of terminals such that the projections are in a state of compression.

2. The electrical connector of claim 1, further comprising a second insulative member, wherein the second insulative member is configured to couple to the first insulative member such that the compressible lossy member is compressed in a space between the first and second insulative members.

3. The electrical connector of claim 2, wherein a lateral cross-sectional area of the space between the first and second insulative members is smaller than a lateral cross-sectional area of the compressible lossy member when the compressible lossy member is in a stress-free state, such that when the compressible lossy member is disposed in the space between the first and second insulative members the compressible lossy member is in a state of compressive stress.

4. The electrical connector of claim 1, wherein the projections of the lossy member extend perpendicularly from the body portion of the lossy member toward the surfaces of the first terminals, wherein the surfaces to which the projections of the lossy member make contact are disposed on the intermediate portions of the first terminals.

5. The electrical connector of claim 4, wherein:

the first insulative member is molded around a segment of each of the intermediate portions of the plurality of terminals, and the projections of the lossy member contact the surfaces of the first terminals through openings in the first insulative member.

6. The electrical connector of claim 5, wherein:

the plurality of terminals further comprises second terminals, the projections of the lossy member are aligned with the surfaces of the first terminals and are separated in the row direction from the second terminals, and at least one of the first terminals is separated from another one of the first terminals by a pair of the second terminals.

7. The electrical connector of claim 6, wherein the first terminals are ground terminals, and the second terminals are signal terminals.

8. An electrical connector of claim 1, comprising:

a first insulative member;

a plurality of terminals supported by the first insulative member and disposed in a row along a row direction, wherein each terminal of the plurality of terminals comprises a first end, a mounting end, and an intermediate portion joining the first end to the mounting end; and a compressible lossy member disposed in a recess of the first insulative member, the compressible lossy member comprising a body portion elongated in the row direction and projections extending from the body portion, wherein:

the projections of the compressible lossy member project toward and make contact with surfaces of first terminals of the plurality of terminals such that the projections are in a state of compression, the body portion of the lossy member comprises a first surface and a second surface opposite the first surface, the first surface and the second surface extend along directions parallel to the row direction, at least one through-hole extends through the body portion from the first surface to the second surface, and the at least one through-hole is elongated in a direction parallel to the row direction.

9. The electrical connector of claim 8, wherein:

the body portion of the lossy member comprises a first end and a second end, the second end opposing the first end in the row direction;

each of the first and second ends comprises cantilevered beams facing each other in a direction perpendicular to the row direction; and at least a portion of the plurality of projections extend from the cantilevered beams.

10. The electrical connector of claim 9, wherein:

a through-hole of the at least one through-hole is disposed between the cantilevered beams at the first end and the cantilevered beams at the second end; and a portion of the of the plurality of projections extend from the body adjacent the through-hole between the cantilevered beams.

11. The electrical connector of claim 8, wherein a length of the at least one though-hole in the direction parallel to the row direction is at least as long as a distance between three, four, or five of the projections of the lossy member in the row direction.

12. The electrical connector of claim 8, wherein:

the at least one through-hole is a plurality of through-holes elongated in the direction parallel to the row direction, and each of the through-holes is separated from another one of the through-holes by a bridge connecting opposite sides of the lossy member, the opposite sides not including the first surface and second surface of the lossy member.

13. The electrical connector of claim 12, wherein the at least one through-hole is adjacent only one bridge.

14. The electrical connector of claim 8, wherein the projections of the lossy member extend longitudinally from the first surface to the second surface, and project outward from a third surface perpendicular to the first and second surfaces.

15. The electrical connector of claim 8, wherein a cross section of the lossy member in a plane perpendicular to the row direction has a maximum dimension in a range from 0.8 mm to 2.5 mm.

16. The electrical connector of claim 15, wherein a perpendicular distance from the first surface to the second surface of the lossy member is in a range from 0.5 mm to 1.5 mm.

17. A compressible lossy member, comprising:

a body portion extending along a first direction, the body portion comprising a first side and a second side opposite the first side; and a plurality of projections different than the body portion extending away from the body portion from the first side and the second side of the body portion, the plurality of projections being configured to make contact with ground terminals of an electrical connector.

18. The compressible lossy member of claim 17, wherein the body portion further comprises:

a first surface and a second surface opposite the first surface, the first surface and the second surface extend along directions parallel to the first direction, and at least one through-hole that extends through the body portion from the first surface to the second surface.

19. The compressible lossy member of claim 18, wherein the body portion further comprises:

a first end face and a second end face opposite the first end face along the first direction; and at least one opening extending through the body portion from the first face to the second face of the body portion and through at least one of the first end face and the second end face.

20. The compressible lossy member of claim 19, wherein the body portion comprises at least two openings separated by a bridge extending from the first side to the second side.

21. The compressible lossy member of claim 20, the body portion being formed of a compressible material.

22. The compressible lossy member of claim 17, wherein the lossy member is structured to withstand a compressive stress when deployed in the electrical connector.

23. A method of manufacturing an electrical connector, the method comprising:

placing a lossy member comprising a body portion and a plurality of projections different than the body portion extending from the body portion proximate a first insulative member; and forming an assembly by coupling the first insulative member and a second insulative member so that the lossy member is compressed between the first insulative member and the second insulative member.

24. The method of manufacturing an electrical connector of claim 23, wherein a height of the body portion when compressed between the first insulative member and the second insulative member is at least half of a height of the body portion when not compressed by the first insulative member and the second insulative member.

25. The method of manufacturing an electrical connector of claim 24, wherein the height of the body portion when not compressed between the first insulative member and the second insulative member is in a range from 0.8 mm to 2.5 mm.

26. The method of manufacturing an electrical connector of claim 24, wherein, when the lossy member is compressed between the first insulative member and the second insulative member, the height of the lossy member is compressed by an amount in a range from 1% to 20%.

27. The method of manufacturing an electrical connector of claim 23, the method further comprising:

forming the first insulative member and the second insulative member by molding the first insulative member and second insulative member around terminals configured to make electrical contact with terminals of a mating electrical connector.

* * * * *